US008194006B2

(12) United States Patent
Koyama et al.

(10) Patent No.: US 8,194,006 B2
(45) Date of Patent: Jun. 5, 2012

(54) DISPLAY DEVICE, DRIVING METHOD OF THE SAME, AND ELECTRONIC DEVICE COMPRISING MONITORING ELEMENTS

(75) Inventors: Jun Koyama, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1130 days.

(21) Appl. No.: 11/201,375

(22) Filed: Aug. 11, 2005

(65) Prior Publication Data

US 2006/0038501 A1 Feb. 23, 2006

(30) Foreign Application Priority Data

Aug. 23, 2004 (JP) ..... 2004-242820

(51) Int. Cl.
*G09G 3/30* (2006.01)

(52) U.S. Cl. ..... 345/76

(58) Field of Classification Search ..... 345/76–84, 345/204, 212, 690; 315/168–169.3, 307; 324/760.01

See application file for complete search history.

(56) References Cited

U.S. PATENT DOCUMENTS 4,308,556 A 12/1981 Osaka
5,033,023 A * 7/1991 Hsia et al. ..... 365/185.12
5,247,190 A 9/1993 Friend et al.
5,325,108 A * 6/1994 Salam ..... 345/108
5,399,502 A 3/1995 Friend et al.
5,594,463 A 1/1997 Sakamoto
5,597,223 A 1/1997 Watanabe et al.
5,745,085 A 4/1998 Tomio et al.
5,844,535 A 12/1998 Itoh et al.
5,882,761 A 3/1999 Kawami et al.
5,886,474 A 3/1999 Asai et al.
5,893,730 A 4/1999 Yamazaki et al.

(Continued)

FOREIGN PATENT DOCUMENTS

CN 1329368 A 1/2002

(Continued)

OTHER PUBLICATIONS

Hermann Schenk et al.; "Polymers for Light Emitting Diodes"; *EuroDisplay* '99; pp. 33-37; 1999.

(Continued)

*Primary Examiner* — Sumati Lefkowitz
*Assistant Examiner* — Rodney Amadiz
(74) *Attorney, Agent, or Firm* — Fish & Richardson P.C.

(57) ABSTRACT

A light emitting element has a property that a luminance changes when an environment temperature changes. In view of this, the invention provides a display device which suppresses the influence of variations of a current value supplied to a light emitting element caused by a temperature change. In particular, luminance variations caused by a temperature gradient in a pixel portion due to a heat generated from a source signal line driver circuit are suppressed. In a display device including a gate signal line provided in a row direction, a source signal line provided in a column direction, and a light emitting element in a pixel portion arranged in matrix corresponding to the gate signal line and the source signal line, a column of monitor elements is provided beside the pixel portion, a constant current is supplied to each row of the monitor elements, and a voltage generated at the monitor element for each row of pixels is applied to light emitting elements of the corresponding row.

48 Claims, 26 Drawing Sheets

U.S. PATENT DOCUMENTS

| | | | | |
|---|---|---|---|---|
| 5,990,629 | A | 11/1999 | Yamada et al. | |
| 6,005,350 | A | 12/1999 | Hachiya et al. | |
| 6,049,321 | A | 4/2000 | Sasaki | |
| 6,054,976 | A | 4/2000 | Kubota et al. | |
| 6,069,676 | A | 5/2000 | Yuyama | |
| 6,072,448 | A | 6/2000 | Kojima et al. | |
| 6,097,302 | A | 8/2000 | Zinzell | |
| 6,147,451 | A | 11/2000 | Shibata et al. | |
| 6,219,113 | B1 | 4/2001 | Takahara | |
| 6,320,325 | B1 | 11/2001 | Cok et al. | |
| 6,335,713 | B1 | 1/2002 | Imai | |
| 6,373,459 | B1 | 4/2002 | Jeong | |
| 6,376,994 | B1 | 4/2002 | Ochi et al. | |
| 6,380,558 | B1 | 4/2002 | Yamazaki et al. | |
| 6,392,617 | B1 | 5/2002 | Gleason | |
| 6,396,468 | B2 | 5/2002 | Matsushima et al. | |
| 6,396,508 | B1 | 5/2002 | Noecker | |
| 6,404,137 | B1 | 6/2002 | Shodo | |
| 6,411,306 | B1 | 6/2002 | Miller et al. | |
| 6,414,443 | B2 | 7/2002 | Tsuruoka et al. | |
| 6,414,661 | B1 | 7/2002 | Shen et al. | |
| 6,417,824 | B1 | 7/2002 | Tokunaga et al. | |
| 6,424,326 | B2 | 7/2002 | Yamazaki et al. | |
| 6,452,576 | B1 | 9/2002 | Van Velzen et al. | |
| 6,486,862 | B1 | 11/2002 | Jacobsen et al. | |
| 6,496,218 | B2 | 12/2002 | Takigawa et al. | |
| 6,518,941 | B1 | 2/2003 | Kimura | |
| 6,518,962 | B2 | 2/2003 | Kimura et al. | |
| 6,525,704 | B1 | 2/2003 | Kondo et al. | |
| 6,528,951 | B2 | 3/2003 | Yamazaki et al. | |
| 6,534,925 | B2 | 3/2003 | Kawashima | |
| 6,552,736 | B2 | 4/2003 | Honda et al. | |
| 6,680,577 | B1 | 1/2004 | Inukai et al. | |
| 6,788,003 | B2 | 9/2004 | Inukai et al. | |
| 6,816,144 | B2 | 11/2004 | Tsuchi | |
| 6,828,950 | B2 | 12/2004 | Koyama | |
| 7,061,186 | B2 | 6/2006 | Inukai et al. | |
| 7,180,515 | B2 | 2/2007 | Miyagawa et al. | |
| 7,218,297 | B2 | 5/2007 | Inukai et al. | |
| 7,298,347 | B2 | 11/2007 | Yamazaki et al. | |
| 7,453,453 | B2 | 11/2008 | Miyagawa et al. | |
| 7,589,698 | B2 | 9/2009 | Osame et al. | |
| 7,635,863 | B2 * | 12/2009 | Yamazaki et al. | 257/59 |
| 7,773,082 | B2 | 8/2010 | Miyagawa et al. | |
| 7,999,769 | B2 | 8/2011 | Miyagawa et al. | |
| 2001/0017618 | A1 | 8/2001 | Azami | |
| 2001/0026257 | A1 | 10/2001 | Kimura | |
| 2001/0033252 | A1 | 10/2001 | Yamazaki et al. | |
| 2002/0005696 | A1 | 1/2002 | Yamazaki et al. | |
| 2002/0053884 | A1 | 5/2002 | Kimura | |
| 2002/0145602 | A1 | 10/2002 | Matsueda | |
| 2002/0154151 | A1 | 10/2002 | Koyama | |
| 2002/0167381 | A1 * | 11/2002 | Ide et al. | 335/60 |
| 2002/0180672 | A1 | 12/2002 | Yamazaki et al. | |
| 2002/0180721 | A1 | 12/2002 | Kimura et al. | |
| 2003/0063081 | A1 | 4/2003 | Kimura et al. | |
| 2003/0132716 | A1 | 7/2003 | Yamazaki et al. | |
| 2003/0209989 | A1 | 11/2003 | Anzai et al. | |
| 2005/0012731 | A1 | 1/2005 | Yamazaki et al. | |
| 2005/0017933 | A1 | 1/2005 | Koyama | |
| 2005/0017963 | A1 | 1/2005 | Yamazaki et al. | |
| 2005/0017964 | A1 | 1/2005 | Yamazaki et al. | |
| 2005/0219167 | A1 * | 10/2005 | Hattori et al. | 345/76 |
| 2006/0038804 | A1 * | 2/2006 | Hayakawa et al. | 345/204 |
| 2006/0139254 | A1 * | 6/2006 | Hayakawa et al. | 345/76 |
| 2007/0182675 | A1 * | 8/2007 | Yamazaki et al. | 345/76 |

FOREIGN PATENT DOCUMENTS

| | | | |
|---|---|---|---|
| EP | 0 923 067 | A1 | 6/1999 |
| EP | 1 103 947 | A2 | 5/2001 |
| EP | 1 168 291 | A2 | 1/2002 |
| EP | 1 227 467 | A2 | 7/2002 |
| EP | 2 256 718 | A2 | 12/2010 |
| JP | 05-094151 | | 4/1993 |
| JP | 07-036410 | | 2/1995 |
| JP | 09-148066 | | 6/1997 |
| JP | 10-092576 | | 4/1998 |
| JP | 10-214060 | | 8/1998 |
| JP | 10-232649 | | 9/1998 |
| JP | 11-272223 | | 10/1999 |
| JP | 11-273856 | | 10/1999 |
| JP | 2001-109433 | | 4/2001 |
| JP | 2001-222240 | A | 8/2001 |
| JP | 2001-223074 | A | 8/2001 |
| JP | 2002-072964 | A | 3/2002 |
| JP | 2002-175046 | A | 6/2002 |
| JP | 2002-304155 | A | 10/2002 |
| JP | 2003-323159 | | 11/2003 |
| JP | 2004-170943 | A | 6/2004 |
| JP | 2004-279824 | A | 10/2004 |
| TW | 250560 | A | 7/1995 |
| WO | WO 90/13148 | A1 | 11/1990 |
| WO | WO 98/40871 | A1 | 9/1998 |
| WO | WO 01/27910 | A1 | 4/2001 |
| WO | 2004/040541 | A1 | 5/2004 |

OTHER PUBLICATIONS

Mayumi Mizukami et al.; "6-Bit Digital VGA OLED"; *SID 00 Digest*; pp. 912-915; 2000.

R.M.A. Dawson et al.; "Design of an Improved Pixel for a Polysilicon Active-Matrix Organic LED Display"; *SID 98 Digest*; pp. 11-14; 1998.

Office Action (U.S. Appl. No. 09/833,673) dated Dec. 1, 2004.

Chinese Office Action issued in Application No. 200510092492.2; dated Mar. 6, 2009 with English translation, 22 pages.

* cited by examiner

DISPLAY DEVICE, DRIVING METHOD OF THE SAME, AND ELECTRONIC DEVICE COMPRISING MONITORING ELEMENTS

BACKGROUND OF THE INVENTION

1. Field of the Invention

The present invention relates to a semiconductor device provided with a function to control by a transistor a current supplied to a load. More particularly, the invention relates to a display device including a pixel formed of a current drive type light emitting element of which luminance changes according to a current, a signal line driver circuit thereof, and a driving method thereof. Further, the invention relates to an electronic device including the display device in a display portion.

2. Description of the Related Art

In recent years, so-called a self-luminous type display device of which pixels are formed of light emitting elements such as light emitting diodes (LEDs) is attracting attention. As a light emitting element used for such a self-luminous type display device, an organic light emitting diode (OLED), an organic EL element, and an electroluminescence (EL) element are attracting attention and becoming to be used for an organic EL display and the like.

A light emitting element such as an OLED which emits light by itself is advantageous in that visibility of pixels is higher as compared to a liquid crystal display, a backlight is not required, and response is fast. The luminance of a light emitting element is controlled by a current value supplied to the light emitting element. Therefore, a constant current drive in which a constant amount of current is supplied to the light emitting element is suggested for accurately displaying gray scales (see Patent Document 1).

[Patent Document 1]

Japanese Patent Laid-Open No. 2003-323159

A light emitting element has a property that resistance (internal resistance) changes in accordance with the temperature. In specific, when the temperature becomes higher than the normal temperature, the resistance decreases while the resistance increases when the temperature becomes lower than the normal temperature. Accordingly, when the temperature rises, a luminance higher than desired is obtained as a current value increases and the current value decreases when the temperature falls, even though a constant voltage is applied by a constant voltage drive.

Due to the aforementioned properties of a light emitting element, luminance thereof varies when the temperature changes. In view of the aforementioned, the invention provides a display device which suppresses the influence of luminance variations of a light emitting element due to a temperature change.

SUMMARY OF THE INVENTION

A display device of the invention includes a pixel portion including a plurality of light emitting elements of which resistance changes by a temperature change, and a voltage source for supplying a voltage to the light emitting elements. In the case where there is a temperature gradient in a pixel portion and a difference in temperature generates among the light emitting elements, the voltage source has a unit for supplying a lower voltage to a light emitting element of a high temperature and a higher voltage to a light emitting element of a low temperature.

Further, a display device of the invention includes a first signal line driver circuit which outputs a signal to a plurality of first signal lines provided in a column direction, a second signal line driver circuit which outputs a signal to a plurality of second signal lines provided in a row direction, and a pixel portion in which pixels are arranged in matrix corresponding to a column direction of the first signal line and a row direction of the second signal line. The pixel includes a light emitting element. The display device further includes a monitor element provided beside the light emitting elements in a periphery of the pixel portion for each row of the pixels, a current source which supplies a current to the monitor element, and an amplifier for applying approximately the same voltage as a voltage generated in the monitor element to the light emitting element provided beside the monitor element.

A display device of the invention includes a first signal line driver circuit which outputs a signal to a plurality of first signal lines provided in a column direction, a second signal line driver circuit which outputs a signal to a plurality of second signal lines provided in a row direction, and a pixel portion in which pixels are arranged in matrix corresponding to the column direction of the first signal line and the row direction of the second signal line. The pixel includes a light emitting element. The display device further includes a monitor element provided beside the light emitting elements for each row of the pixels in a periphery of the pixel portion, a current source which supplies a current to the monitor element, and an amplifier for inputting approximately the same potential as a potential of an anode of the monitor element to an anode of the light emitting elements provided beside the monitor element.

A display device of the invention includes a first signal line driver circuit which outputs a signal to a plurality of first signal lines provided in a column direction, a second signal line driver circuit which outputs a signal to a plurality of second signal lines provided in a row direction, and a pixel portion in which pixels are arranged in matrix corresponding to the column direction of the first signal line and the row direction of the second signal line. The pixel includes a light emitting element. The display device further includes a monitor element provided beside the light emitting elements for each row of the pixels in a periphery of the pixel portion, a current source which supplies a current to a plurality of monitor elements provided in a plurality of rows of the pixels, and an amplifier for applying approximately the same voltage as a voltage in the plurality of monitor elements to a plurality of rows of light emitting elements provided beside the plurality of monitor elements. Among the plurality of monitor elements provided for rows of the pixels, a plurality of monitor elements provided beside the plurality of light emitting elements to which the amplifier applies a voltage are connected in parallel.

According to a display device of the invention having the aforementioned structure, the amplifier is a voltage follower circuit.

According to a display device of the invention having the aforementioned structure, the pixel portion is formed of pixels with a plurality of color components, and the monitor element and the amplifier are provided for each color component.

According to a display device of the invention having the aforementioned structure, the monitor elements and the light emitting elements are EL elements.

According to a display device of the invention having the aforementioned structure, the monitor elements and the light emitting elements are formed of the same material.

According to an electronic device of the invention, the aforementioned display device is provided in a display portion.

An active matrix display device of the invention includes a source signal line driver circuit which outputs a signal to a plurality of source signal lines provided in a column direction, a gate signal line driver circuit which outputs a signal to a plurality of gate signal lines provided in a row direction, and a pixel portion in which pixels are arranged in matrix corresponding to the column direction of the source signal lines and the row direction of the gate signal lines. The pixel includes a light emitting element and a transistor which drives the light emitting element. The active matrix display device further includes a monitor element provided beside the light emitting elements for each row of the pixels in a periphery of the pixel portion, a current source which supplies a current to the monitor element, and an amplifier which inputs approximately the same potential as a potential of an anode of the monitor element to a source terminal of the transistor which drives the light emitting element provided beside the monitor element are provided.

Further, an active matrix display device of the invention includes a source signal line driver circuit which outputs a signal to a plurality of source signal lines provided in a column direction, a gate signal line driver circuit which outputs a signal to a plurality of gate signal lines provided in a row direction, and a pixel portion in which pixels are arranged in matrix corresponding to the column direction of the source signal lines and the row direction of the gate signal lines. The pixel includes a light emitting element and a transistor which drives the light emitting element. The active matrix display device further includes a monitor element provided beside the light emitting elements for each row of the pixels at the next to the pixel portion, a current source which supplies a current to a plurality of monitor elements provided in a plurality of rows of the pixels, and an amplifier which inputs approximately the same potential as a potential of an anode of the monitor element(s) to a source terminal of the transistor which drives the light emitting element provided beside the monitor element. Among the plurality of monitor elements provided for each row of the pixels, a plurality of monitor elements provided beside the plurality of rows of light emitting elements to which the amplifier applies a voltage are connected in parallel.

Further, according to an active matrix display device of the invention having the aforementioned structure, the amplifier is a voltage follower circuit.

According to an active matrix display device of the invention having the aforementioned structure, the pixel portion is formed of pixels with a plurality of color components, and the monitor element and the amplifier are provided for each color component.

According to an active matrix display device of the invention having the aforementioned structure, the monitor element and the light emitting element are EL elements.

According to an active matrix display device of the invention having the aforementioned structure, the monitor element and the light emitting element are formed of the same material.

According to an electronic device of the invention, the aforementioned active matrix display device is provided in a display portion.

A passive matrix display device of the invention includes a column signal line driver circuit which outputs a signal to a plurality of column signal lines provided in a column direction, a row signal line driver circuit which outputs a signal to a plurality of row signal lines provided in a row direction, and a pixel portion in which pixels are arranged in matrix corresponding to the column direction of the column signal line and the row direction of the row signal line. The pixel includes a light emitting element in which a layer containing an organic compound is sandwiched by a first electrode formed of a part of the column signal line and a second electrode formed of a part of the row signal line. The passive matrix display device further includes a monitor element provided beside the light emitting elements for each for of the pixels in a periphery of the pixel portion and in which a layer containing an organic compound is sandwiched by a first electrode formed of a part of the column signal line and a second electrode formed of a part of the row signal line, a current source which supplies a current to the monitor element, and an amplifier which inputs approximately the same potential as a potential of an anode of the monitor element to the column signal lines.

According to a passive matrix display device of the invention having the aforementioned structure, the amplifier is a voltage follower circuit.

According to a passive matrix display device of the invention having the aforementioned structure, the pixel is formed of a pixel with a plurality of color components, and the monitor element and the amplifier provided in a periphery of the pixel portion are provided for each pixel of the color component.

According to a passive matrix display device of the invention having the aforementioned structure, the monitor element and the light emitting element are EL elements.

According to a passive matrix display device of the invention having the aforementioned structure, the monitor element and the light emitting element are formed of the same material.

According to an electronic device of the invention, a passive matrix display device having the aforementioned structure is provided in a display portion thereof.

A display device of the invention includes a first heat dissipation layer over a first substrate, a pixel portion having a light emitting element of which resistance changes by a temperature change over the first heat dissipation layer, and a driver circuit provided in the periphery of the pixel portion. The pixel portion is sandwiched by the first substrate and a second substrate.

A display device of the invention includes a first heat dissipation layer over a first substrate, a pixel portion having a light emitting element of which resistance changes by a temperature change over the first heat dissipation layer, and a driver circuit formed of a thin film transistor provided in the periphery of the pixel portion. The pixel portion is sandwiched by the first substrate and a second substrate.

According to a display device of the invention having the aforementioned structure, the first heat dissipation layer has heat conductivity of 10 to 300 W/mK.

According to a display device of the invention having the aforementioned structure, the first heat dissipation layer contains aluminum nitride (AlN) or aluminum nitride oxide.

According to a display device of the invention having the aforementioned structure, the first heat dissipation layer contains aluminum nitride oxide ($AlN_xO_y$).

According to a display device of the invention having the aforementioned structure, aluminum nitride oxide contains 0.1 to 30 atomic % of oxygen (O).

According to a display device of the invention having the aforementioned structure, a second heat dissipation layer is formed over an external surface of the second substrate.

According to a display device of the invention, the second heat dissipation film is a metal film.

According to a display device of the invention having the aforementioned structure, the metal film is formed of a film containing copper.

According to an electronic device of the invention, a display device having the aforementioned structure is provided in a display portion.

A driving method of a display device of the invention including a pixel portion formed of a plurality of light emitting elements of which resistance changes by a temperature change is that when a temperature gradient occurs in the pixel portion, a low voltage is applied to a light emitting element of a high temperature while a high voltage is applied to a light emitting element of a low temperature.

The invention provides a display device having a light emitting element of which luminance variations due to a temperature change are reduced.

DETAILED DESCRIPTION OF THE INVENTION

Although the invention will be fully described by way of Embodiment Modes with reference to the accompanying drawings, it is to be understood that various changes and modifications will be apparent to those skilled in the art. Therefore, unless otherwise such changes and modifications depart from the scope of the invention, they should be construed as being included therein.

Figure 23:
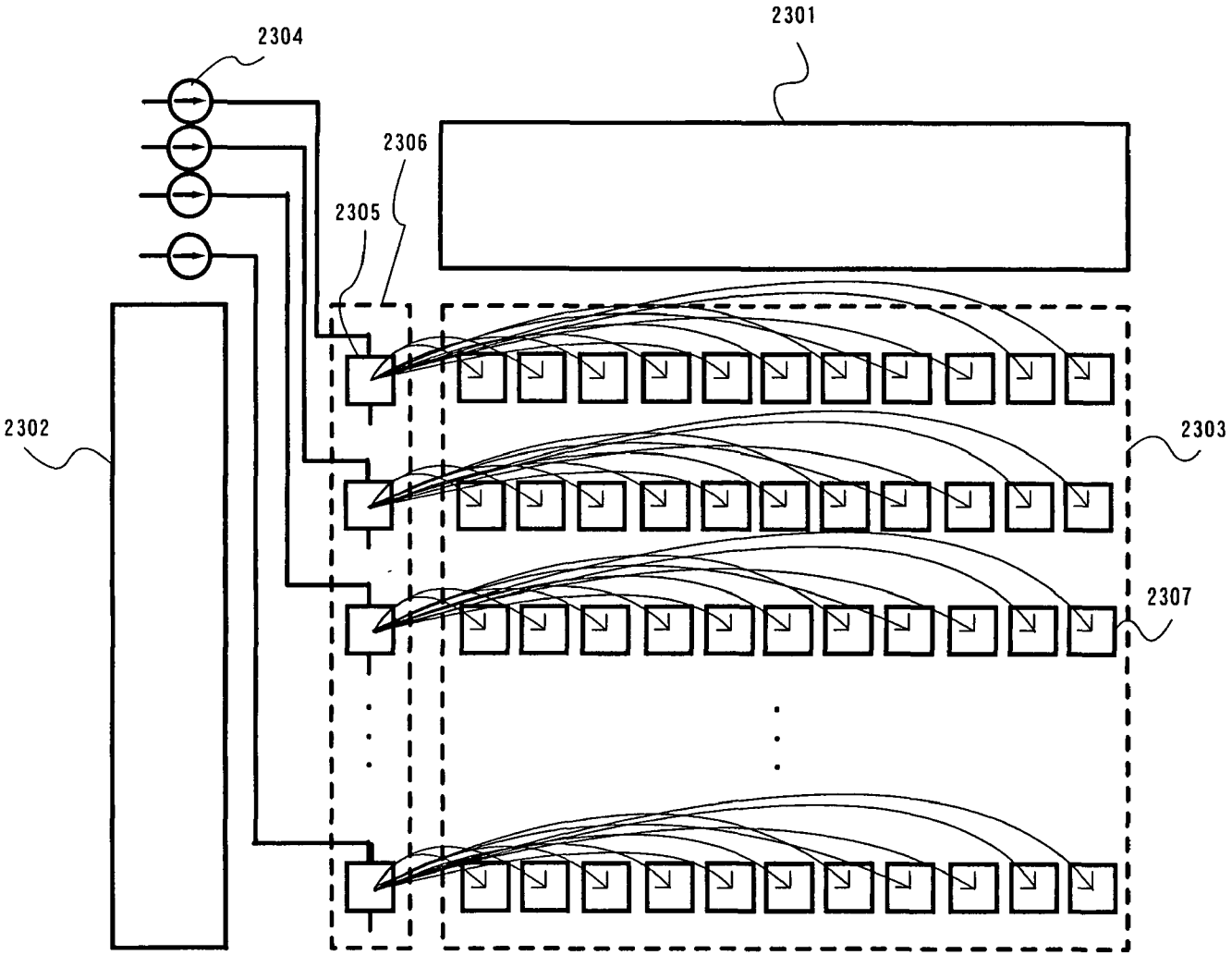
FIG. 23 is a diagram showing a basic principle of a display device of the invention.

FIG. 23 shows a schematic diagram of a display device of the invention. A display device of the invention includes a first signal line driver circuit 2301, a second signal line driver circuit 2302, and a pixel portion 2303. A plurality of light emitting elements 2307 are arranged in matrix in the pixel portion 2303. Here, the light emitting element 2307 has a characteristic that resistance decreases as a temperature rises. In this display device, the first signal line driver circuit 2301 operates at a higher frequency than the second signal line driver circuit 2302.

In the periphery of the pixel portion 2303, a monitor element group 2306 in which monitor elements 2305 are arranged in a column direction is provided. That is, the monitor elements 2305 are provided in a row direction of the light emitting elements 2307 of the pixel portion 2303. Further, a reference current source 2304 which supplies a constant current to each monitor element 2305 is provided.

An operation principle of a display device of the invention is briefly described. The reference current source 2304 supplies a constant current to the monitor element 2305. That is, a constant current drive is performed. As shown by an arrow in FIG. 23, a voltage generated in the monitor element 2305 is applied to a plurality of light emitting elements provided in a row direction of the monitor elements 2305. That is, a constant voltage drive is performed for the light emitting element 2307.

In this manner, a higher voltage can be applied to the light emitting element 2307 arranged further from the first signal line driver circuit 2301 which is a heat source due to a high frequency operation. In other words, a lower voltage can be applied to the light emitting element 2307 arranged nearer to the first signal line driver circuit 2301. Accordingly, luminance variations due to a temperature gradient in the pixel portion 2303 can be reduced.

Figure 24:
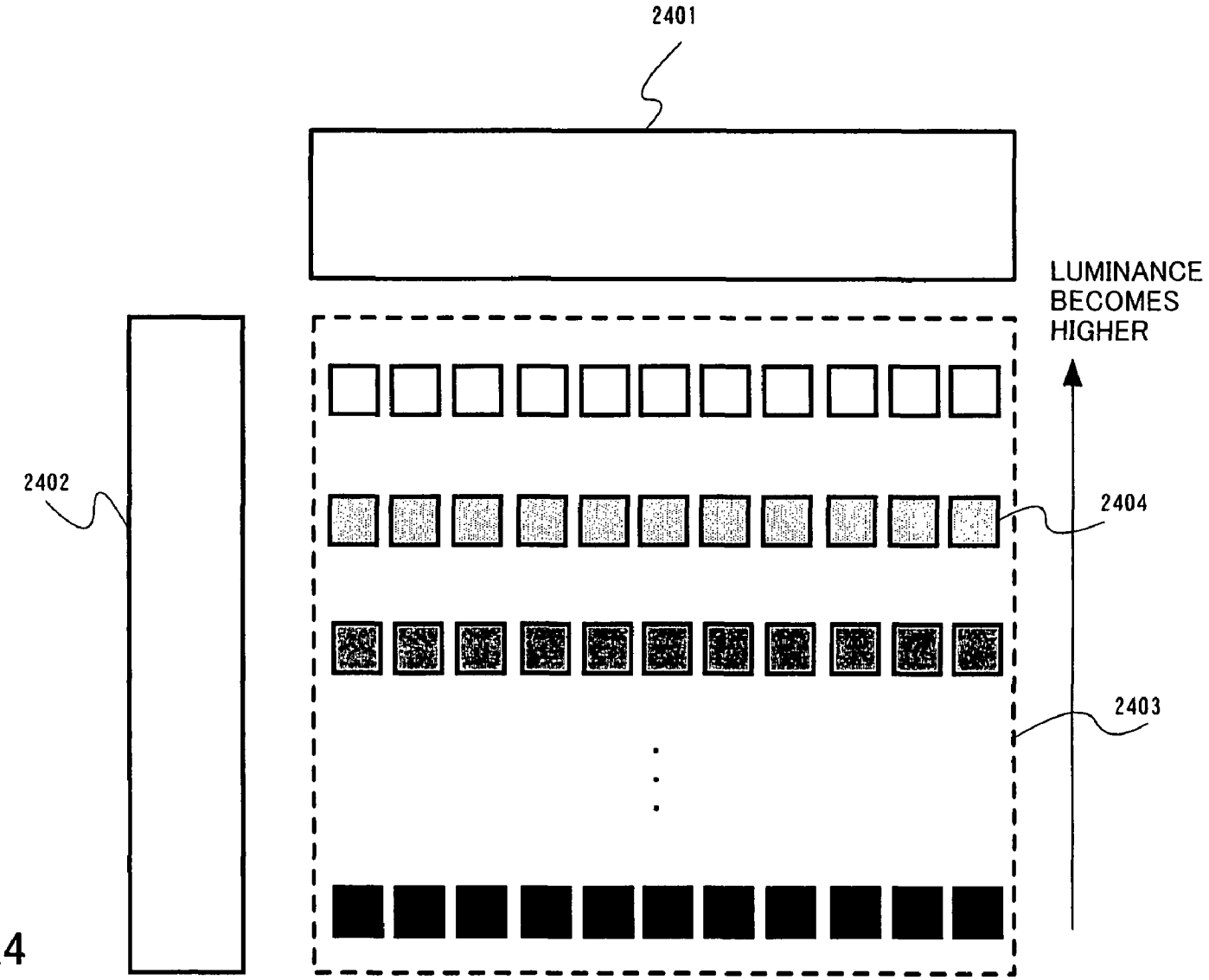
FIG. 24 is a diagram showing a temperature gradient in a pixel portion of a display device.

Here, FIG. 24 shows a schematic diagram of a display device in the case of supplying a common voltage to light emitting elements in the display. The display device shown in FIG. 24 includes a first signal line driver circuit 2401, a second signal line driver circuit 2402, and a pixel portion 2403. A plurality of light emitting elements 2404 are arranged in matrix in the pixel portion 2403. Here, the light emitting element 2404 has a characteristic that resistance decreases as a temperature rises. In this display device, the first signal line driver circuit 2401 operates at a higher frequency than the second signal line driver circuit 2402.

Here, as the first signal line driver circuit 2401 operates at a high frequency, a higher temperature is generated than the second signal line driver circuit 2402. Then, a portion in the pixel portion 2403 near the first signal line driver circuit 2401 is brought to a high temperature while an effect of the heat generation becomes smaller at a further portion from the first signal line driver circuit 2401. Then, the light emitting element 2404 in the pixel portion near the first signal line driver circuit 2401 is also brought to a high temperature, thereby resistance is decreased. On the other hand, in a pixel further from the first signal line driver circuit 2401, resistance does not change much as an effect of the heat generation of the first signal line driver circuit 2401 is small.

At this time, by applying a common voltage to the light emitting elements 2404 of the pixel portion 2403, the light emitting element 2404 in the pixel portion 2303 becomes brighter near the first signal line driver circuit 2401. That is, a luminance becomes higher.

According to a display device of the invention, however, this display variation is reduced.

It is to be noted that the first signal line driver circuits 2301 and 2401 are the heat sources in FIGS. 23 and 24, however, the invention is not limited to this. In the case where a connecting portion of an FPC to connect a panel of the display device and a module is a heat source, a higher voltage is applied to a light emitting element at a further place from the FPC connecting portion as the heat source.

Embodiment Mode 1

In this embodiment mode, the case of applying the invention to an active matrix display device is described. First, a basic principle of a temperature and deterioration compensation circuit (hereinafter simply referred to as a compensation circuit) included in the display device of the invention is described with reference to FIG. 11.

Figure 1:
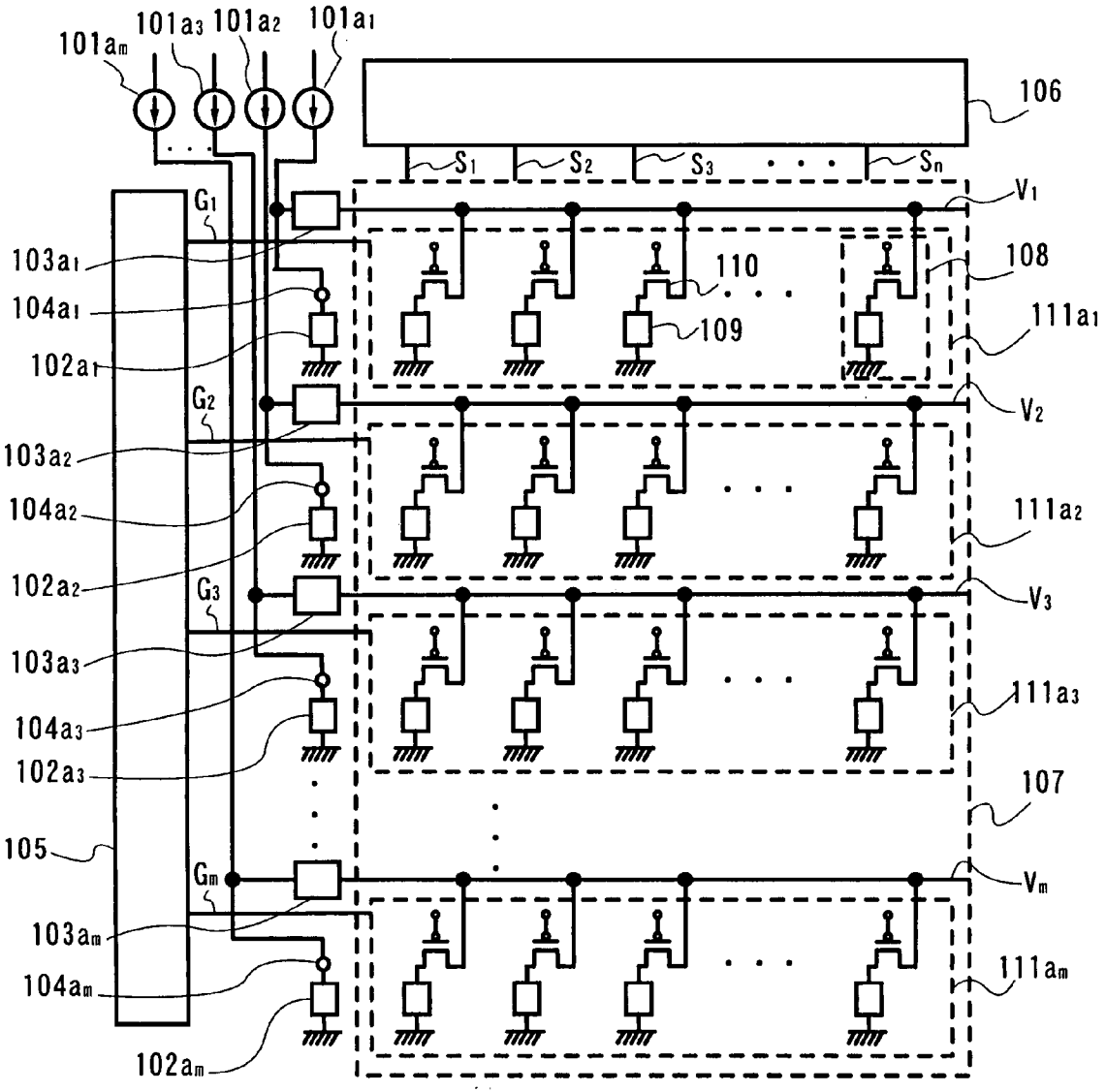
FIG. 1 is a diagram showing an active matrix display device of the invention.
Figure 11:
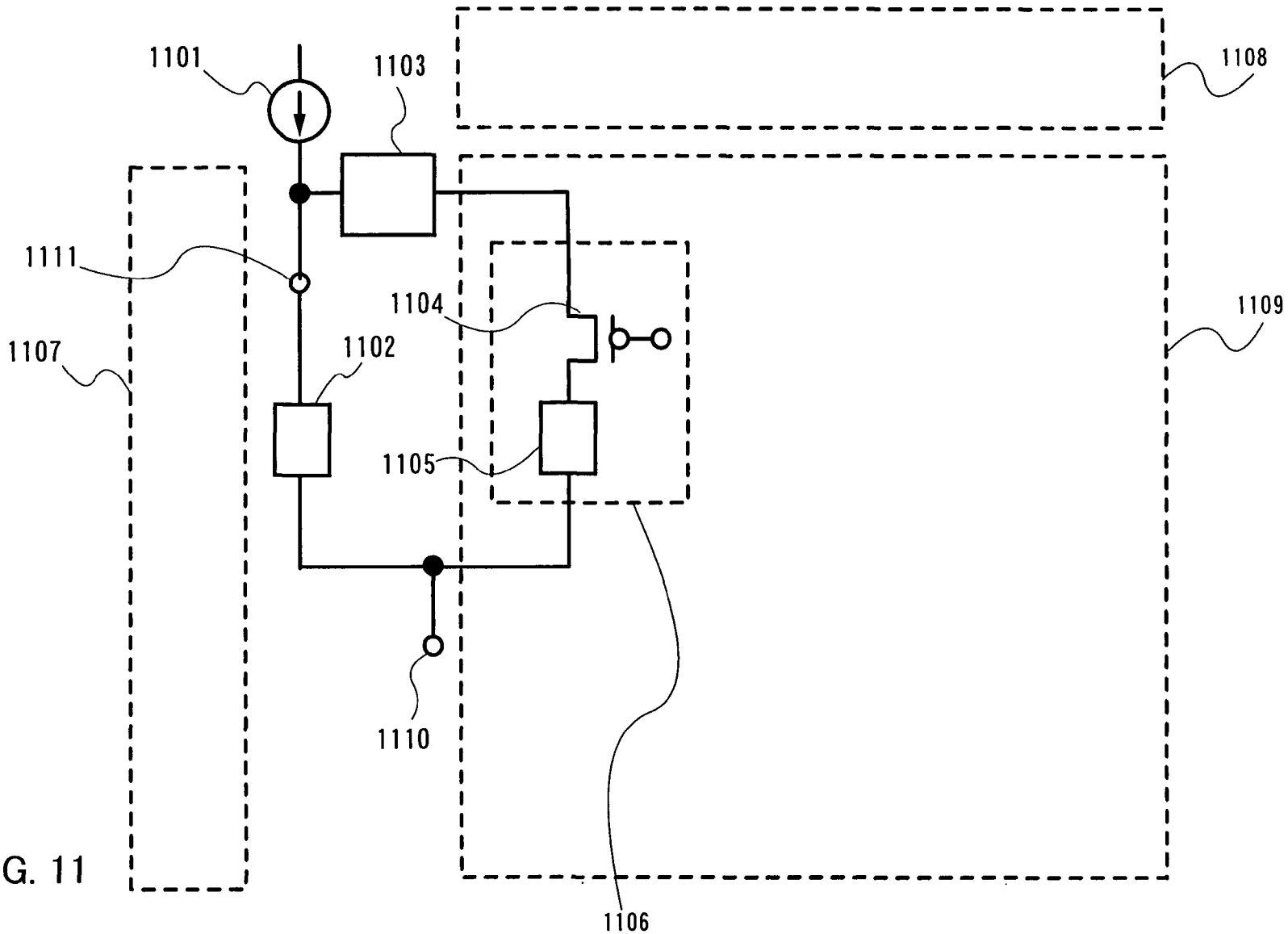
FIG. 11 is a diagram showing a compensation function of an active matrix display device of the invention.

FIG. 11 schematically shows an active display device. The display device includes a gate signal line driver circuit (also referred to as a gate driver) 1107, a source signal line driver circuit (also referred to as a source driver) 1108, and a pixel portion 1109. The pixel portion 1109 is formed of a plurality of pixels 1106 each of which includes a driving transistor 1104 and light emitting element 1105. Further, the display device includes a reference current source 1101, a monitor element 1102, and an amplifier 1103. The reference current source 1101 supplies a constant current to the monitor element 1102. That is, the monitor element 1102 is driven by a constant current. Accordingly, a current value supplied to the monitor element 1102 is always constant. When a peripheral temperature (hereinafter referred to as an environment temperature) changes in this state, resistance of the monitor element 1102 changes. When the resistance of the monitor element 1102 changes, a potential difference between opposite electrodes of the monitor element 1102 changes as a current value supplied to the monitor element 1102 is constant. By detecting the potential difference between the opposite electrodes of the monitor element 1102, a temperature change is detected. More specifically, a potential at an electrode of the monitor element 1102, of which potential is maintained constant, namely a potential of a cathode 1110 in FIG. 1 does not change, thus a potential change of an electrode connected to the current source 1101, namely an anode 1111 in FIG. 1 is detected.

Figure 13:
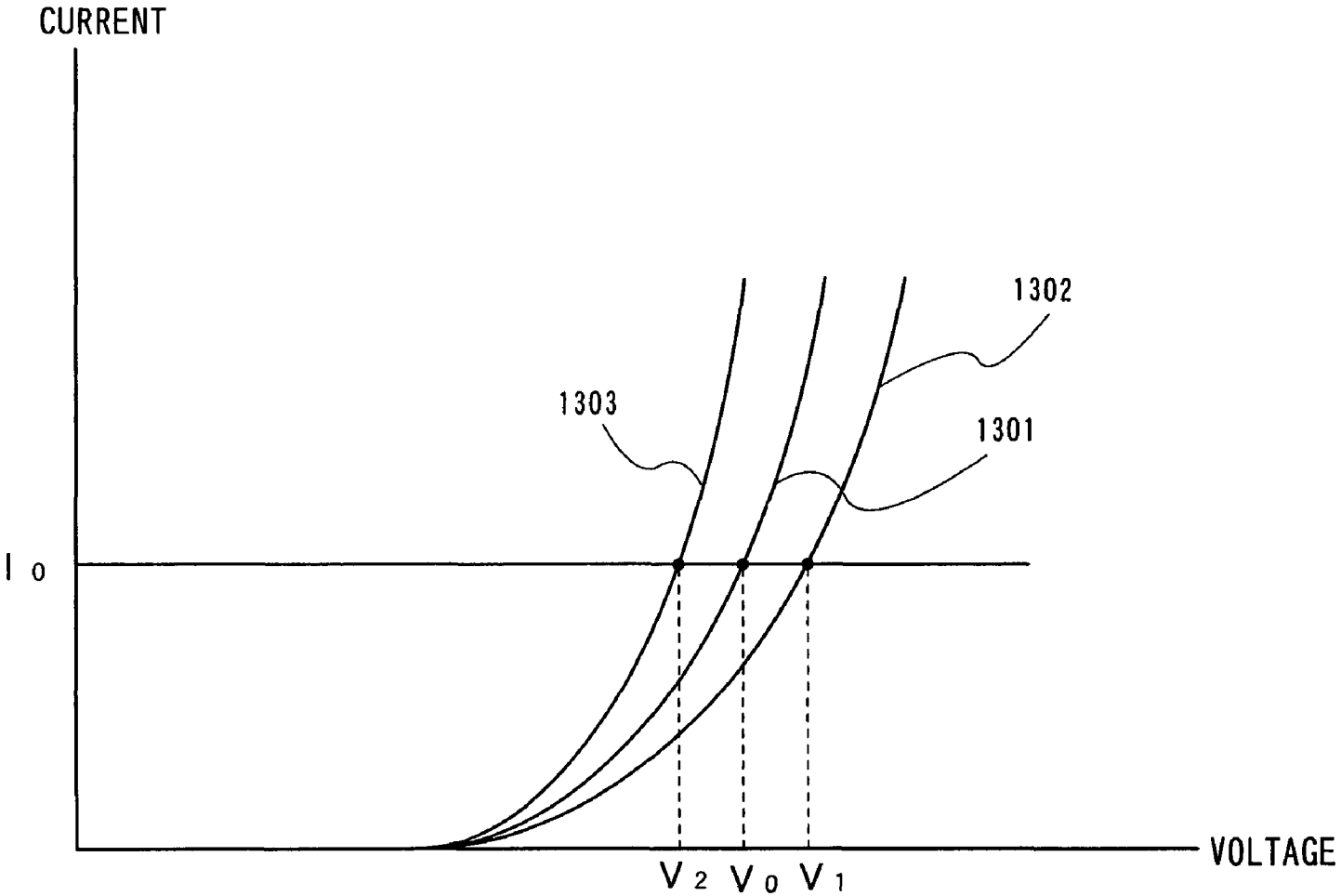
FIG. 13 is a diagram showing a temperature dependency of V-I characteristics of a light emitting element.

Here, an environment temperature dependency of V-I characteristics of the monitor element 1102 is described with reference to FIG. 13. The V-I characteristics of the monitor element 1102 at a room temperature (for example, 25° C.), a low temperature (for example, −20° C.), and a high temperature (for example, 70° C.) are shown by lines 1301, 1302, and 1303 respectively. When a current value supplied from the reference current source 1101 to the monitor element 1102 is $I_0$, a voltage $V_0$ is generated at the monitor element at a normal temperature. At a low temperature, a voltage of $V_1$ is generated while a voltage of $V_2$ is generated at a high temperature. That is, a voltage drop at the monitor element 1102 becomes $V_0$ when a current of the current value $I_0$ is supplied to the monitor element 1102 at a normal temperature, while a voltage drop at the monitor element of a low temperature becomes $V_1$ and a voltage drop at the monitor element of a high temperature becomes $V_2$. Accordingly, temperature compensation can be performed by applying a voltage $V_1$ to the light emitting element 1105 when the temperature is low while applying a voltage $V_2$ thereto when the temperature is high.

Figure 14:
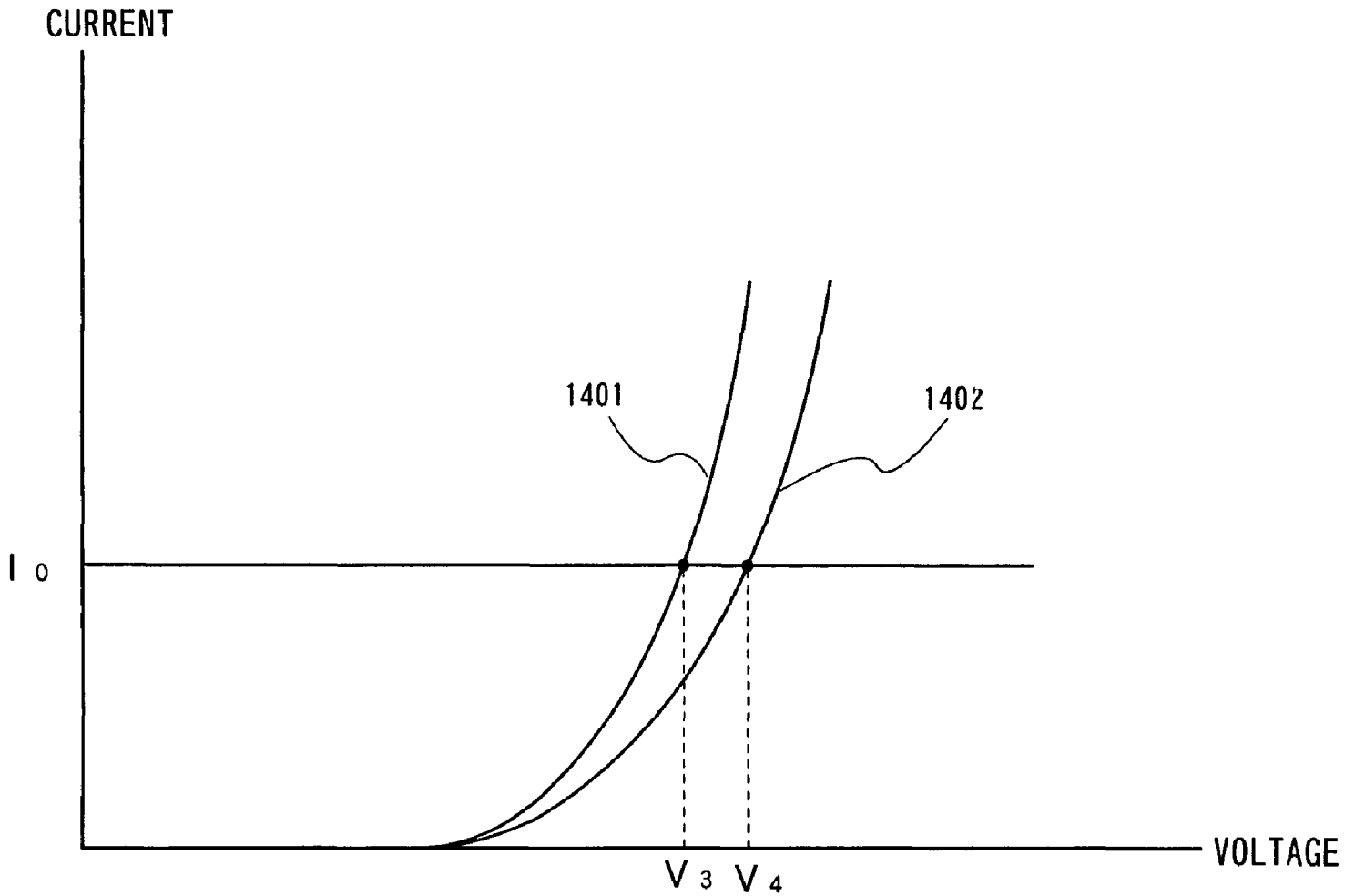
FIG. 14 is a diagram showing a change of V-I characteristics of a light emitting element with time.

FIG. 14 is a diagram showing a change of V-I characteristics of the monitor element 1102 with time. A line 1401 shows initial characteristics of the monitor element 1102 while a line 1402 shows characteristics after deterioration. It is to be noted that the initial characteristics and the characteristics after the deterioration are measured with the same temperature condition (normal temperature). When a current $I_0$ is supplied to the monitor element 1102 in the state of initial characteristics, a voltage of $V_0$ generates at the monitor element 1102 while a voltage of $V_3$ generates at the monitor element 1102 after deterioration. That is, in the case of applying a constant voltage to a light emitting element, a current value decreases with time. In other words, resistance of a light emitting element to which a current continues to be supplied becomes high as compared to the initial state that a current started to be supplied to the light emitting element. Accordingly, a current value supplied to the light emitting element decreases with time even though a constant voltage is applied thereto. Therefore, by applying a voltage $V_3$ to the light emitting element 1102 which is deteriorated similarly, an apparent deterioration of the light emitting element 1105 can be reduced.

Accordingly, a voltage set in consideration of data of these temperature change and change with time is applied to the light emitting element 1105. That is, a voltage value is set according to a change in resistance of the light emitting element 1105 caused by the temperature change and change with time. In this manner, luminance variations of the light emitting element 1105 due to the temperature change and change with time are suppressed.

Here, the temperature of each light emitting element 1105 also differs depending on a place where the pixel 1106 is arranged in the pixel portion 1109. For example, the source signal line driver circuit 1108 which operates at a high frequency is brought to a high temperature by generating heat. Accordingly, the light emitting element 1105 in the pixel 1106 arranged on the source signal line driver circuit 1108 side is brought to a high temperature as well. Therefore, a temperature gradient occurs in the pixel portion 1109 from the light emitting element 1105 arranged near the source signal line driver circuit 1108 to the light emitting element 1105 arranged far from it. When a common voltage is applied to the light emitting elements 1105 of all the pixels 1106 which form the pixel portion 1109, luminance variations occur. That is, a luminance of the light emitting element 1105 nearer to the source signal line driver circuit 1108 becomes higher while that of the light emitting element 1105 further from the source signal line driver circuit 1108 becomes lower.

In view of the aforementioned, according to the invention, a voltage suitable for the arrangement of the pixels in the pixel portion is applied to the light emitting elements for reducing luminance variations due to the temperature change of the light emitting element caused by the arrangement of the pixels. More preferably, in a display device including a plurality of pixels arranged in matrix corresponding to a plurality of source signal lines provided in a column direction and a plurality of gate signal lines provided in a row direction, a voltage to be applied is set for each row of light emitting elements in the pixel. The voltage is set by compensating an environment temperature and changes with time of each row of pixels.

A description is made with reference to FIG. 1 on a configuration example of an active display device in which a voltage which compensated the environment temperature and change with time of each row of pixels is set.

A display device includes a gate signal line driver circuit 105 which outputs a signal to gate signal lines $G_1$ to $G_m$ provided in a row direction, a source signal line driver circuit 106 which outputs a signal to source signal lines $S_1$ to $S_n$ provided in a column direction, and a pixel portion 107 in which a plurality of pixels 108 are arranged in matrix corresponding to the row direction and column direction. The pixel 108 includes a driving transistor 110 and a light emitting element 109 of which cathode is connected to GND. The driving transistor 110 is controlled to be turned on/off by a signal inputted from the source signal lines $S_1$ to $S_n$ in a gate selection period. The light emitting element 109 emits light in the pixel 108 of which driving transistor 110 is on. It is to be noted that a row of pixels selected by the gate signal line $G_1$ is shown as a pixel group 111$a_1$, a row of pixels selected by the gate signal line $G_2$ is shown as a pixel group 111$a_2$, and a row of pixels selected by the gate signal line $G_m$ is shown as a pixel group 111$a_m$.

Further, a display device includes reference current sources 101$a_1$ to 101$a_m$, monitor elements 102$a_1$ to 102$a_m$, and amplifiers 103$a_1$ to 103$a_m$. Each of the monitor elements 102$a_1$ to 102$a_m$ has a cathode connected to GND similarly to the cathode of the light emitting element 109. The reference current source 101$a_1$ supplies a constant current to the monitor element 102$a_1$, thereby a voltage generates at the monitor element 102$a_1$. That is, a potential difference generates between opposite electrodes of the monitor element 102$a_1$. A potential of an anode 104$a_1$ of the monitor element 102$a_1$ is detected by the amplifier 103$a_1$ and then approximately the same voltage is outputted to a power source line $V_1$. In this manner, the potential outputted from the amplifier 103$a_1$ is inputted to an anode of the light emitting element 109 in the pixel 108 of which driving transistor 110 is on in the pixel group 111$a_1$ which includes switching transistors of which gate electrodes are connected to the gate signal line $G_1$. Accordingly, a current is supplied to the light emitting element 109 and it emits light. Similarly, the reference current sources 101$a_2$ to 101$a_m$ supplies a constant current to the monitor elements 102$a_2$ to 102$a_m$ respectively, the amplifiers 103$a_2$ to 103$a_m$ detects a potential of the anodes 104$a_2$ to 104$a_m$ of the monitor elements 102$a_2$ to 102$a_m$ and outputs approximately the same potential as the detected potential to the power source lines $V_2$ to $V_m$ respectively. In this manner, a voltage can be set for each row of pixels such as the pixel groups 111$a_1$, 111$a_2$, 111$a_3$, . . . , and 111$a_m$, to be supplied to the light emitting elements 109 therein. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

It is to be noted that a voltage follower circuit using an operational amplifier can be applied to the amplifiers 103$a_1$ to 103$a_m$. A non-inverting input terminal of the voltage follower circuit is high in input impedance while an output terminal thereof is low in output impedance. Therefore, the output terminal of the voltage follower circuit can supply a current with a non-inverting input terminal thereof being supplied almost no current from the reference current sources 101$a_2$ to 101$a_m$. Then, the output terminal of the voltage follower circuit can output the same potential as a potential inputted to the non-inverting input terminal. That is, an impedance conversion can be carried out. Therefore, it is needless to say that any circuit which has such a function can be used as well as a voltage follower circuit. Further, an impedance conversion is not necessarily carried out when using an amplifier which outputs from an output terminal approximately the same voltage as a potential inputted to an input terminal. Accordingly, a voltage feedback amplifier and a current feedback amplifier can be appropriately used for the amplifiers 103$a_1$ to 103$a_m$.

Further, a cathode of the light emitting element 109 of each of the pixel 108 and the monitor elements 102$a_1$ to 102$a_m$ is connected to GND, however, the invention is not limited to this. For example, a cathode of each of the light emitting element 109 and the monitor elements 102$a_1$ to 102$a_m$ may be connected to another wiring having a specific potential. Further, cathodes of the monitor elements 102$a_1$ to 102$a_m$ and each light emitting element 109 may be connected to different wirings, or each cathode of the monitor elements 102$a_1$ to 102$a_m$ may be connected to different wirings or the same wiring. However, it is preferable that the cathodes of the monitor elements 102$a_1$ to 102$a_m$ and the light emitting element 109 of each pixel 108 be connected to a wiring of the same potential.

The monitor element 102$a_1$ is provided beside the light emitting element 109 of the pixel group 111$a_1$ in the periphery of the pixel portion while the monitor elements 102$a_2$ to 102$a_m$ are provided beside the light emitting elements 109 of the pixel groups 111$a_2$ to 111$a_m$ respectively in the periphery of the pixel portion. Accordingly, a voltage generated at a monitor element of which distance from the source signal line driver circuit 106 is approximately equal, that is a monitor element of which resistance change by the temperature change is approximately equal is applied to the light emitting element 109. Accordingly, luminance variations caused by a temperature gradient in the pixel portion 107 due to heat generation of the source signal line driver circuit 106 can be reduced. It is to be noted that luminance variations caused by the environment temperature change and change with time can be reduced as well.

It is preferable to form the monitor element and the light emitting element using the same material over the same substrate at the same time. Accordingly, variations in V-I characteristics of the monitor element and the light emitting element can be reduced.

It is to be noted that one monitor element is provided for each row of the pixel portion in the configuration of FIG. 1, however, a plurality of monitor elements may be provided as well. By providing a plurality of monitor elements for each row in parallel, variations in characteristics of the monitor element can be averaged.

Embodiment Mode 2

In this embodiment mode, a specific configuration example of an active display device described with reference to FIG. 1 is described with reference to FIG. 2.

A display device includes a gate signal line driver circuit 205 which outputs a signal to the gate signal lines $G_1$ to $G_m$ provided in a row direction, a source signal line driver circuit 206 which outputs a signal to the source signal lines $S_1$ to $S_n$ in a column direction, and a pixel portion 207 in which a plurality of pixels 208 are arranged in matrix corresponding to the gate signal lines $G_1$ to $G_m$ and the source signal lines $S_1$ to $S_n$. The pixel 208 includes a switching transistor 204, a driving transistor 210, a capacitor 211, and a light emitting element 209.

Here, a DATA signal is inputted to the source signal line driver circuit 206 in serial. A SCK signal, a SCKB signal, and a SSP signal are inputted to a pulse output circuit 212 and signals are sequentially outputted to each column of a first latch circuit 213. In accordance with the signals outputted from the pulse output circuit 212, a DATA signal is stored in parallel in the first latch circuit 213. When a SLAT signal is inputted to a second latch circuit 214, the DATA signal stored in the first latch circuit 213 is transferred to the second latch circuit 214. The DATA signal stored in the second latch circuit 214 is outputted from the source signal line driver circuit 206. Further, a GCK signal, a GCKB signal, and a GSP signal are inputted to the gate signal line driver circuit 205, which sequentially selects the gate signal lines $G_1$ to $G_m$. The switching transistor 204 is turned on, of which gate electrode is connected to the selected gate signal line In a gate selection period. Then, the signal outputted from the source signal line driver circuit 206 is written to the capacitor 211 of the pixel 208 of the selected row through the source signal lines $S_1$ to $S_n$. In this manner, a charge of the signal from the source signal lines $S_1$ to $S_n$ is accumulated in the capacitor 211. The driving transistor 210 is controlled to be turned on/off by the accumulated charge. Then, the light emitting element 209 emits light in the pixel 208 of which driving transistor 210 is on.

Further, a display device includes reference current sources $201a_1$ to $201a_m$, monitor elements $202a_1$ to $202a_m$, and voltage follower circuits $203a_1$ to $203a_m$. Each of the monitor elements $202a_1$ to $202a_m$ and the light emitting element 209 has a cathode connected to GND. The reference current source $201a_1$ supplies a constant current to the monitor element $202a_1$, thereby a voltage generates at the monitor element $202a_1$. That is, a potential difference generates between opposite electrodes of the monitor element $202a_1$. A potential of an anode of the monitor element $202a_1$ is detected by the voltage follower circuit $203a_1$ and approximately the same potential is outputted to the power source line $V_1$. In this manner, a signal is inputted from the source signal lines $S_1$ to $S_n$ to a row of pixels which include switching transistors of which gate electrodes are connected to the gate signal line $G_1$ when the gate signal line $G_1$ is selected. Then, a potential outputted from the voltage follower circuit $203a_1$ is inputted to the light emitting element 209 of the pixel 208 of which driving transistor 210 is on. Accordingly, a current is supplied to the light emitting element 209 and it emits light. Similarly, the reference current sources $201a_2$ to $201a_m$ supplies a constant current to the monitor elements $202a_2$ to $202a_m$ respectively, the voltage follower circuits $203a_2$ to $203a_m$ detects a potential of the anodes of the monitor elements $202a_2$ to $202a_m$ and outputs approximately the same potential as the detected potential to the power source lines $V_2$ to $V_m$ respectively. In this manner, a voltage can be set for each row of pixels, to be supplied to the light emitting elements 209 therein. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

Further, the monitor element $202a_1$ is provided in the periphery of the pixel portion beside the light emitting element 209 of the pixel 208 including a switching transistor 204, of which gate electrode is connected to the gate signal line $G_1$. Similarly, the monitor elements $202a_2$ to $202a_m$ are provided in the periphery of the pixel portion beside the light emitting element 209 of the pixel 208 including a switching transistor 204 of which gate electrode is connected to the gate signal lines $G_2$ to $G_m$ respectively. Accordingly, approximately the same voltage as a voltage generated at a monitor element of which distance from the source signal line driver circuit 206 is approximately equal to the light emitting element, that is a monitor element of which resistance change by the temperature change is approximately equal is applied to the light emitting element 209. Accordingly, luminance variations caused by a temperature gradient in the pixel portion 207 due to heat generation of the source signal line driver circuit 206 can be reduced. It is to be noted that luminance variations caused by the environment temperature change and change with time can be reduced as well.

Figure 2:
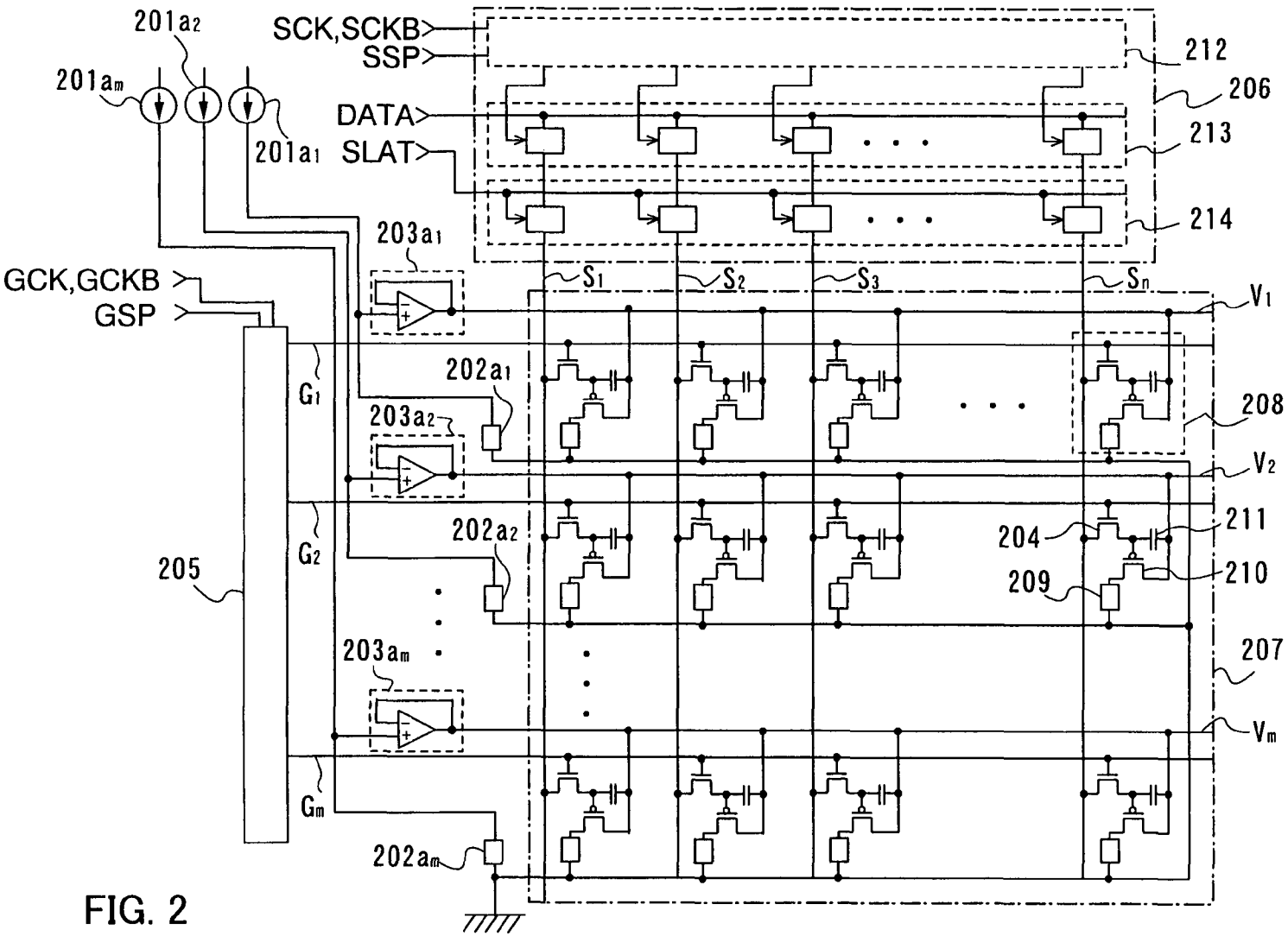
FIG. 2 is a diagram showing a specific configuration example of an active matrix display device of the invention.

Although the voltage follower circuits $203a_1$ to $203a_m$ are used in the configuration of FIG. 2, any circuit which has a function to output from an output terminal approximately the same potential as a potential inputted to an input terminal can be used as well as a voltage follower circuit. Accordingly, a voltage feedback amplifier and a current feedback amplifier can be appropriately used.

Although the cathodes of the monitor elements $202a_1$ to $202a_m$ and the light emitting element 209 of the each pixel 208 are connected to GND, the invention is not limited to this. For example, a cathode of each of the light emitting element 209 and the monitor elements $202a_1$ to $202a_m$ may be connected to another wiring having a specific potential. Further, cathodes of the monitor elements $202a_1$ to $202a_m$ and each light emitting element 209 may be connected to different wirings, or each cathode of the monitor elements $202a_1$ to $202a_m$ may be connected to different wirings or the same wiring. However, it is preferable that the cathodes of the monitor elements $202a_1$ to $202a_m$ and the light emitting element 209 of each pixel 208 be connected to a wiring of the same potential.

Further, the invention is not limited to this configuration, and can be applied to a pixel configuration in which polarity of a transistor in the pixel is changed, a connection is changed, or a new transistor is additionally provided.

Further, a monitor element may be provided on the opposite side to the gate signal line driver circuit with the pixel portion interposed therebetween. The arrangement of the monitor element can be appropriately selected for achieving an effective function of temperature compensation.

Figure 3:
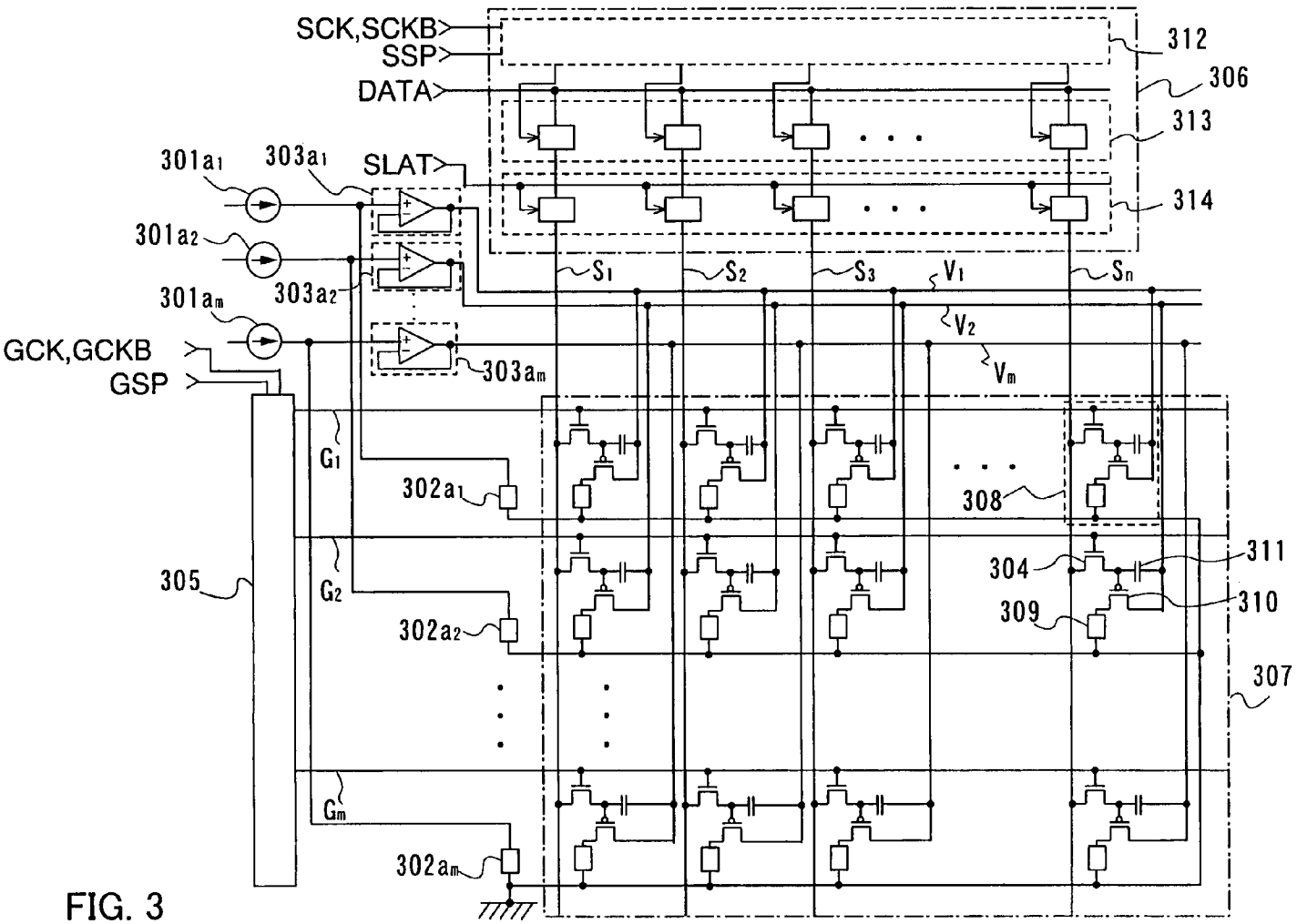
FIG. 3 is a diagram showing a specific configuration example of an active matrix display device of the invention.

FIG. 3 shows a different configuration than that of the display device of FIG. 2. In the configuration of FIG. 3, the power source lines $V_1$ to $V_m$ can be provided outside the pixel portion.

A display device shown in FIG. 3 includes a gate signal line driver circuit 305 which outputs a signal to the gate signal lines $G_1$ to $G_m$ provided in a row direction, a source signal line driver circuit 306 which outputs a signal to the source signal lines $S_1$ to $S_n$ provided in a column direction, and a pixel portion 307 in which a plurality of pixels 308 are arranged in matrix corresponding to the row direction and the column direction. The pixel 308 includes a switching transistor 304, a driving transistor 310, a capacitor 311, and a light emitting element 309. Further, the display device shown in FIG. 3 includes reference current sources $301a_1$ to $301a_m$, monitor elements 302$a_1$ to 302$a_m$, and voltage follower circuits 303$a_1$ to 303$a_m$. Here, in the display device shown in FIG. 3, the reference current sources 301$a_1$ to 301$a_m$, the monitor elements 302$a_1$ to 302$a_m$, the voltage follower circuits 303$a_1$ to 303$a_m$, the gate signal line driver circuit 305, the source signal line driver circuit 306, and the pixel portion 307 correspond to the reference current sources 201$a_1$ to 201$a_m$, the monitor elements 202$a_1$ to 202$a_m$, the voltage follower circuits 203$a_1$ to 203$a_m$, the gate signal line driver circuit 205, the source signal line driver circuit 206, and the pixel portion 207 in the display device shown in FIG. 2. The operation threrof is similar to that of FIG. 2, therefore, the description thereof is omitted here.

It is to be noted that a potential is outputted from the voltage follower circuits 303$a_1$ to 303$a_m$, therefore, when a voltage drop occurs due to wiring resistance of a wiring between output terminals of the voltage follower circuits 303*a*1 to 303*am* and each pixel 308, a voltage value applied to the light emitting element 309 in each pixel 308 varies. Then, luminance of a pixel varies. In view of this, it is preferable to lower wiring resistance of wirings between output terminals of the voltage follower circuits 303$a_1$ to 303$a_m$ to each pixel 308. Accordingly, luminance variations of each pixel 308 can be reduced by providing the power source lines $V_1$ to $V_m$ outside the pixel portion and forming the power source lines $V_1$ to $V_m$ using a low resistant material as in this configuration. However, when there are more pixel rows, lead wirings between the driving transistor 310 and the power source lines $V_1$ to $V_m$ are increased, which leads to lower the aperture ratio of the pixels. Therefore, it is preferable to use the configurations shown in FIGS. 2 and 3 appropriately. Further, for example, the configuration shown in FIG. 3 may be employed for upper rows and lower rows of the pixel portion 307 while the configuration shown in FIG. 2 is employed for the other part.

Although the voltage follower circuits 303$a_1$ to 303$a_m$ are used in the configuration of FIG. 3, it is needless to say that the invention is not limited to the voltage follower circuit as long as a function to output from an output terminal approximately the same potential as a potential inputted to an input terminal is provided. Accordingly, a voltage feedback amplifier and a current feedback amplifier can be appropriately used for the voltage follower circuits 303$a_1$ to 303$a_m$.

Although the cathodes of the monitor elements 302$a_1$ to 302$a_m$ and the light emitting element 309 of the each pixel 308 are connected to GND, the invention is not limited to this. For example, a cathode of each of the light emitting element 309 and the monitor elements 302$a_1$ to 302$a_m$ may be connected to another wiring having a specific potential. Further, cathodes of the monitor elements 302$a_1$ to 302$a_m$ and each light emitting element 309 may be connected to different wirings, or each cathode of the monitor elements 302$a_1$ to 302$a_m$ may be connected to different wirings or the same wiring. However, it is preferable that the cathodes of the monitor elements 302$a_1$ to 302$a_m$ and the light emitting element 309 be connected to a wiring of the same potential.

Further, the invention is not limited to this configuration, and can be applied to a pixel configuration in which polarity of a transistor in the pixel is changed, a connection is changed, or a new transistor is additionally provided.

Further, a monitor element may be provided on the opposite side to the gate signal line driver circuit with the pixel portion interposed therebetween. The arrangement of the monitor element can be appropriately selected for achieving an effective function of temperature compensation.

Embodiment Mode 3

In this embodiment mode, a configuration of a display device is described including a gate signal line driver circuit 405 which outputs a signal to the gate signal lines $G_1$ to $G_m$ provided in a row direction, a source signal line driver circuit 406 which outputs a signal to the source signal line driver circuits $S_1$ to $S_n$ provided in a column direction, and a pixel portion 407 in which a plurality of pixels 408 are arranged in matrix corresponding to the gate signal lines $G_1$ to $G_m$ and the source signal lines $S_1$ to $S_n$. In the display device, a voltage value applied to the light emitting element 409 is set per group of a plurality of rows of the pixels. That is, a voltage value is set per row of the pixels in the configuration of FIG. 1, however, a voltage value is set by two rows of pixels in the configuration of FIG. 4.

Figure 4:
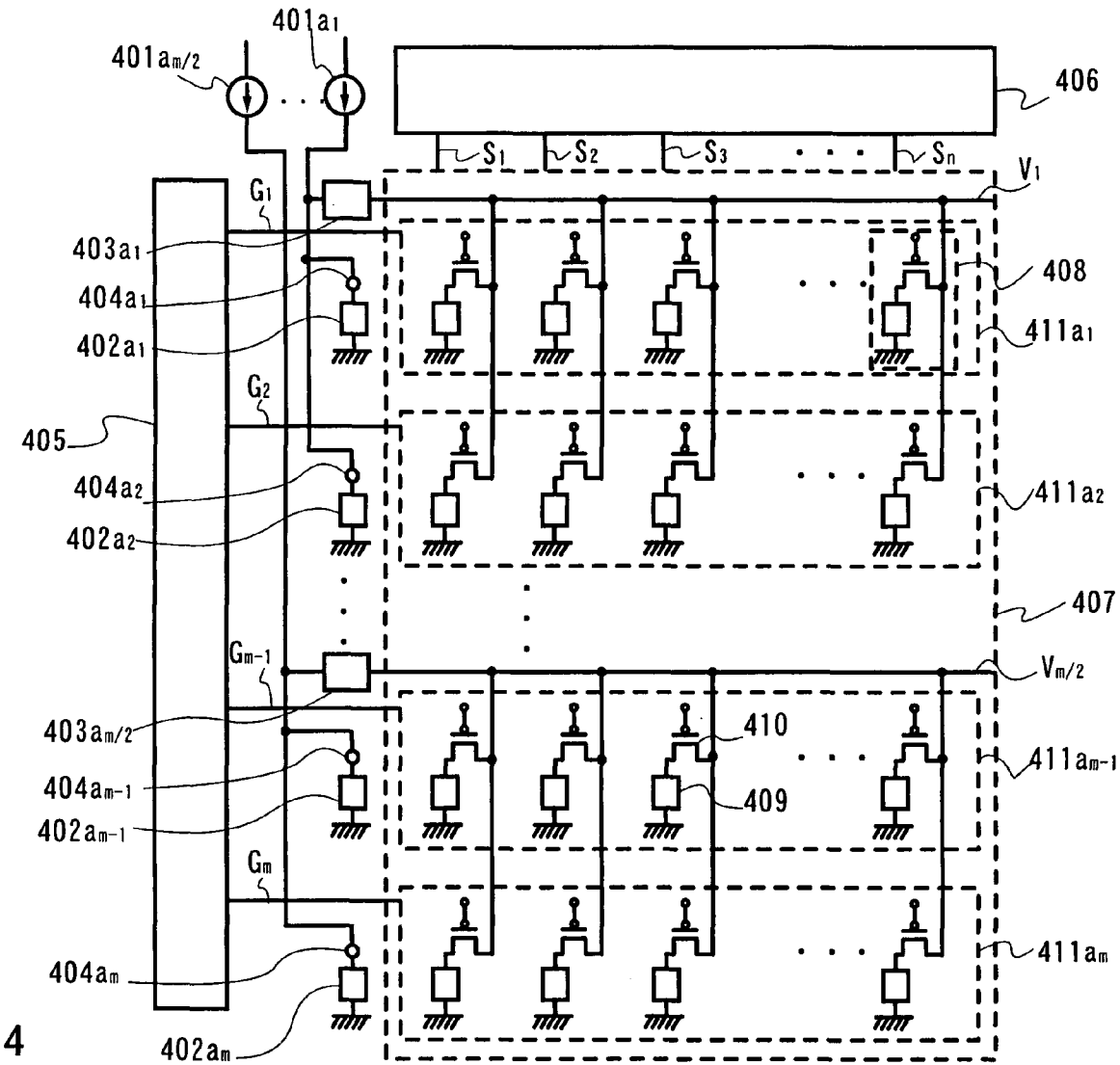
FIG. 4 is a diagram showing an active matrix display device of the invention.

A display device shown in FIG. 4 includes a gate signal line driver circuit 405 which outputs a signal to the gate signal lines $G_1$ to $G_m$ provided in a row direction, a source signal line driver circuit 406 which outputs a signal to the source signal lines $S_1$ to $S_n$ provided in a column direction, and a pixel portion 407 in which a plurality of pixels 408 are arranged in matrix corresponding to the row direction and the column direction. The pixel 408 includes a driving transistor 410 and a light emitting element 409 of which cathode is connected to GND. The driving transistor 410 is controlled to be turned on/off by a signal inputted from the source signal lines in a gate selection period. The light emitting element 409 emits light in the pixel 408 of which driving transistor 410 is on. It is to be noted that a row of pixels selected by the gate signal line $G_1$ is denoted as a pixel group 411$a_1$, a row of pixels selected by the gate signal line $G_2$ is denoted as a pixel group 411$a_2$, and a row of pixels selected by the signal line $G_m$ is denoted as a pixel group 411$a_m$.

The display device further includes reference current sources 401$a_1$ to 401$a_{m/2}$, monitor elements 402$a_1$ to 402$a_m$, and amplifiers 403$a_1$ to 403$a_{m/2}$. The cathodes of the monitor elements 402$a_1$ to 402$a_m$ are connected to GND similarly to the cathode of the light emitting element 409. The reference current source 401$a_1$ supplies a constant current to the monitor elements 402$a_1$ and 402$a_2$, thereby a voltage is generated at the monitor elements 402$a_1$ and 402$a_2$. That is, a potential difference generates between opposite electrodes of the monitor elements 402$a_1$ and 402$a_2$. Potentials at anodes 404$a_1$ and 404$a_2$ of the monitor elements 402$a_1$ and 402$a_2$ are detected by the amplifier 403$a_1$ and approximately the same potential is outputted to the power source line $V_1$. In this manner, a potential outputted from the amplifier 403$a_1$ is inputted to the light emitting element 409 in the pixel 408 of which driving transistor 410 is on among the pixel group 411$a_1$ having switching transistors of which gate electrodes are connected to the gate signal line $G_1$ or the pixel group 411$a_2$ having switching transistors of which gate electrodes are connected to the gate signal line $G_2$. Accordingly, a current is supplied to the light emitting element 409 and it emits light. Similarly, each of the reference current sources 401$a_2$ to 401$a_{m/2}$ supplies a constant current to the monitor elements 402$a_3$, 402$a_4$ to 402$a_{m-1}$ and 402$a_m$, each of the amplifiers 403$a_2$ to 403$a_{m/2}$ detects a potential of anodes 404$a_3$, 404$a_4$ to 404$a_{m-1}$, and 404$a_m$ of the monitor elements 402$a_3$, 402$a_4$ to 402$a_{m-1}$ and 402$a_m$ respectively, and approximately the same potentials are outputted to the power source lines $V_2$ to $V_{m/2}$. In this manner, a voltage applied to the light emitting element 409 can be set by two rows of pixel groups, such as the pixel groups 411$a_1$ and 411$a_2$, 411$a_3$ and 411$a_4$, . . . , 411$a_{m-1}$ and 411$a_m$. That is, a voltage value corresponding to an averaged value of resistances of two monitor elements is detected and applied to the light emitting element. Further, as a power source line is shared for two rows of pixels, the number of power source lines and lead wirings of the driving transistor 410 can be reduced. Accordingly, variations in characteristics of the monitor element can be averaged and the aperture ratio of a pixel can be improved. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

In the configuration of FIG. 4, a power source line is shared for two rows of pixels, however, the invention is not limited to this. The power source line can be appropriately controlled so as to reduce the luminance variations due to a temperature gradient of the pixel portion. For example, two power source lines may be provided by dividing the pixel portion into the upper portion and the lower portion at a half of the pixel rows. A power source line may be additionally provided for a pixel row which is particularly easily affected by heat generation of the source signal line driver circuit 406, that is a few rows of pixels near the source signal line driver circuit 406.

It is to be noted that a voltage follower circuit using an operational amplifier can be applied to the amplifiers 403$a_1$ to 403$a_{m/2}$. A non-inverting input terminal of the voltage follower circuit is high in input impedance while an output terminal thereof is low in output impedance. Therefore, the output terminal of the voltage follower circuit can supply a current with a non-inverting input terminal thereof being supplied almost no current from the reference current sources 401$a_2$ to 401$a_{m/2}$. Then, the output terminal of the voltage follower circuit can output the same potential as a potential inputted to the non-inverting input terminal. That is, an impedance conversion can be carried out. Therefore, it is needless to say that any circuit which has such a function can be used as well as a voltage follower circuit. Further, an impedance conversion is not necessarily carried out when using an amplifier which outputs from an output terminal approximately the same voltage as a potential inputted to an input terminal. Accordingly, a voltage feedback amplifier and a current feedback amplifier can be appropriately used for the amplifiers 403$a_1$ to 403$a_{m/2}$.

Further, a cathode of the light emitting element 409 of each of the pixel 408 and the monitor elements 402$a_1$ to 402$a_m$ is connected to GND, however, the invention is not limited to this. For example, a cathode of each of the light emitting element 409 and the monitor elements 402$a_1$ to 402$a_m$ may be connected to another wiring having a specific potential. Further, cathodes of the monitor elements 402$a_1$ to 402$a_m$ and each light emitting element 409 may be connected to different wirings, or each cathode of the monitor elements 402$a_1$ to 402$a_m$ may be connected to different wirings or the same wiring. However, it is preferable that the cathodes of the monitor elements 402$a_1$ to 402$a_m$ and the light emitting element 409 of each pixel 408 be connected to a wiring of the same potential.

Figure 5:
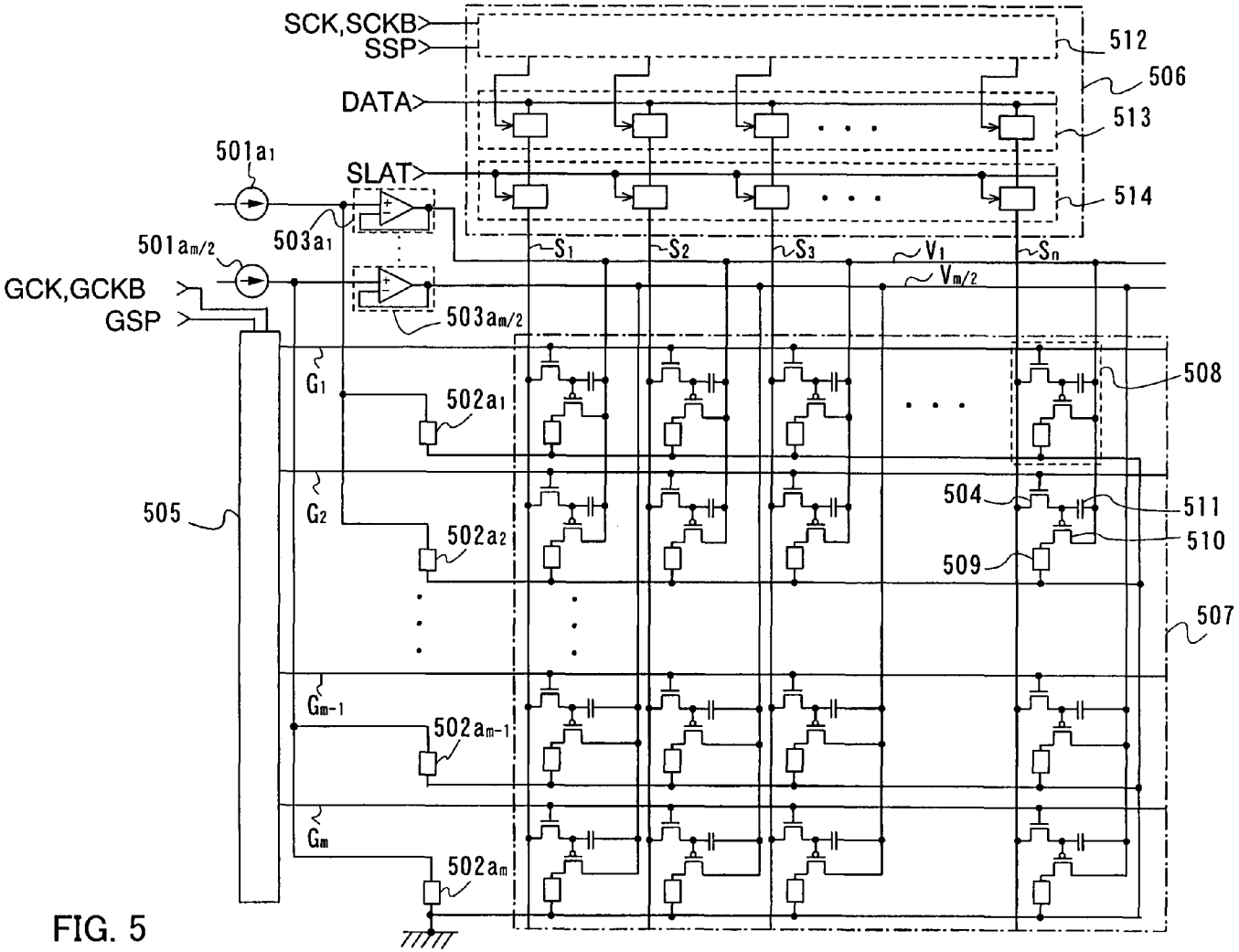
FIG. 5 is a diagram showing a specific configuration example of an active matrix display device of the invention.

In the configuration of FIG. 4, a power source wiring is shared for a plurality of rows of pixels of the display device having a configuration shown in FIG. 1, however, the invention can be applied to a configuration in which a power source line is provided outside the pixel portion as shown in the configuration of FIG. 3. A specific example of a configuration of such a display device is shown in FIG. 5.

A display device includes a gate signal line driver circuit 505 which outputs a signal to the gate signal lines $G_1$ to $G_m$ provided in a row direction, a source signal line driver circuit 506 which outputs a signal to the source signal lines $S_1$ to $S_n$ provided in a column direction, and a pixel portion 507 in which a plurality of pixels 508 are arranged in matrix corresponding to the gate signal lines $G_1$ to $G_m$ and the source signal lines $S_1$ to $S_n$. The pixel 508 includes a driving transistor 510 and a light emitting element 509 of which cathode is connected to GND. Further, the source signal line driver circuit 505 includes a pulse output circuit 512, a first latch circuit 513, and a second latch circuit 514. The driving transistor 510 is controlled to be turned on/off by a signal inputted from the source signal line in a gate selection period. The light emitting element 509 emits light in the pixel 508 of which driving transistor 510 is on.

Further, the display device includes reference current sources 501$a_1$ to 501$a_{m/2}$, monitor elements 502$a_1$ to 502$a_m$, and amplifiers 503$a_1$ to 503$a_{m/2}$. The cathodes of the monitor elements 502$a_1$ to 502$a_m$ are connected to GND similarly to the cathode of the light emitting element 509. In this configuration, the reference current source 501$a_1$ supplies a current to the monitor elements 502$a_1$ and 502$a_2$. The amplifier 503$a_1$ detects potentials of anodes of these monitor elements, thereby a potential is set at the power source line $V_1$.

In this configuration, the power source lines $V_1$ to $V_{m/2}$ are provided outside the display portion 507, and the number of lead wirings of source electrodes of the driving transistors 510 can be reduced, which can improve the aperture ratio of a pixel.

Although the voltage follower circuits 503$a_1$ to 503$a_{m/2}$ are used in the configuration of FIG. 5, it is needless to say that the invention is not limited to the voltage follower circuit as long as a function to output from an output terminal approximately the same potential as a potential inputted to an input terminal is provided. Accordingly, a voltage feedback amplifier and a current feedback amplifier can be appropriately used for the voltage follower circuits 503$a_1$ to 503$a_{m/2}$.

Although the cathodes of the monitor elements 502$a_1$ to 502$a_m$ and the light emitting element 509 of the each pixel 508 are connected to GND, the invention is not limited to this. For example, a cathode of each of the light emitting element 509 and the monitor elements 502$a_1$ to 502$a_m$ may be connected to another wiring having a specific potential. Further, cathodes of the monitor elements 502$a_1$ to 502$a_m$ and each light emitting element 509 may be connected to different wirings, or each cathode of the monitor elements 502$a_1$ to 502$a_m$ may be connected to different wirings or the same wiring. However, it is preferable that the cathodes of the monitor elements 502$a_1$ to 502$a_m$ and the light emitting element 509 be connected to a wiring of the same potential.

Further, the invention is not limited to this configuration, and can be applied to a pixel configuration in which polarity of a transistor in the pixel is changed, a connection is changed, or a new transistor is additionally provided.

Further, a monitor element may be provided on the opposite side to the gate signal line driver circuit with the pixel portion interposed therebetween. The arrangement of the monitor element can be appropriately selected for achieving an effective function of temperature compensation.

Embodiment Mode 4

Figure 6:
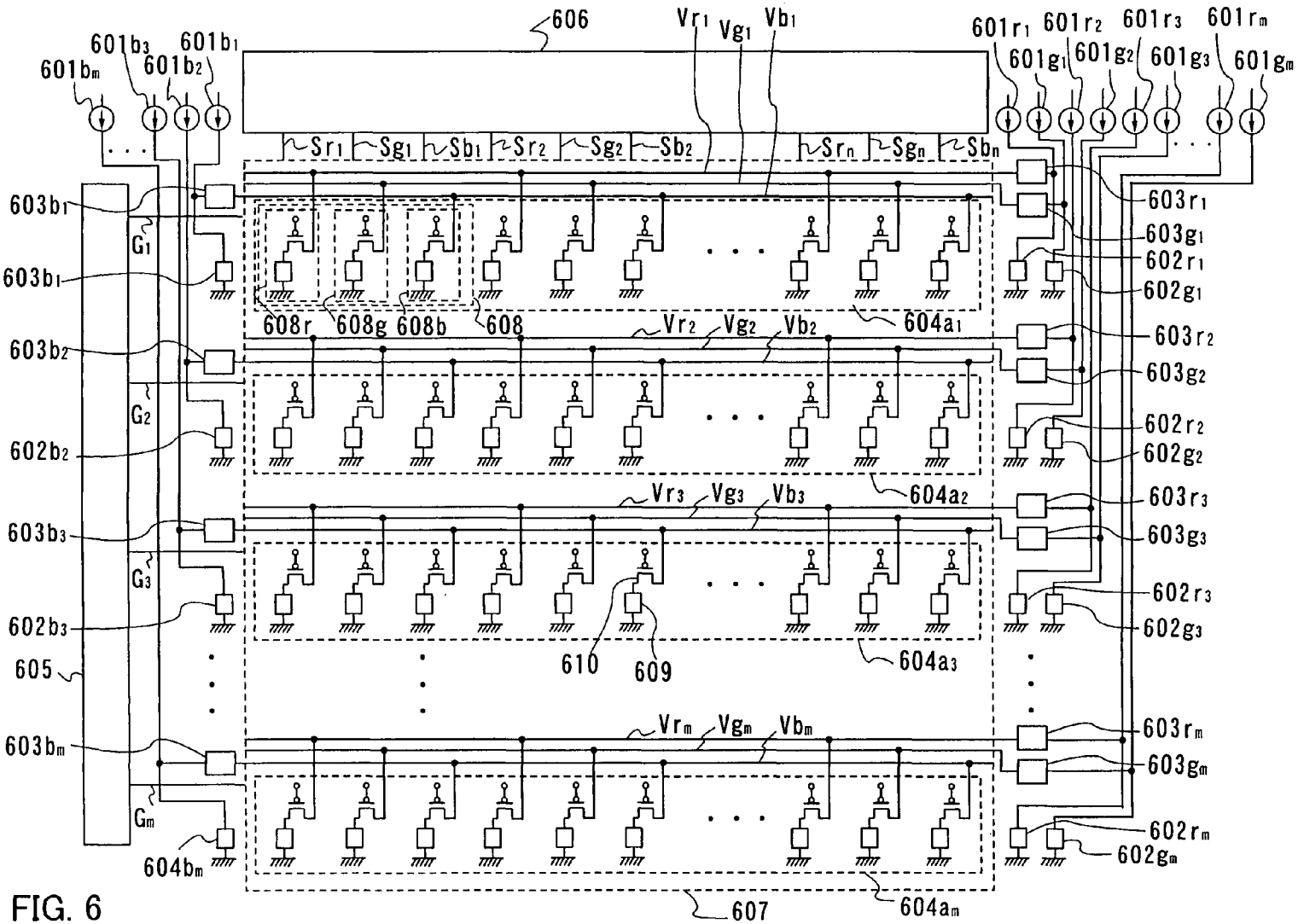
FIG. 6 is a diagram showing an active matrix display device of the invention.

In this embodiment mode, a display device which includes a plurality of color components and has a compensation function for each pixel of the color component is described. For example, a display device which has a compensation function for each pixel of RGB is described with reference to FIG. 6. It is to be noted that color components of R (red), G (green), and B (blue) which form one pixel are referred to as a pixel of R, a pixel of G, and a pixel of B respectively.

The display device includes a gate signal line driver circuit 605 which outputs a signal to the gate signal lines $G_1$ to $G_m$ provided in a row direction, a source signal line driver circuit 606 which outputs a signal to source signal lines $Sr_1$, $Sg_1$, $Sb_1$ to $Sr_n$, $Sg_n$, and $Sb_n$ provided in a column direction, and a pixel portion 607 in which a plurality of pixels 608 formed of a pixel of R 608*r*, a pixel of G 608*g*, and a pixel of B 608*b* are arranged in matrix corresponding to the gate signal lines $G_1$ to $G_m$ and the source signal lines $S_1$ to $S_n$. Each of the pixel of R 608*r*, the pixel of G 608*g*, and the pixel of B 608*b* includes a driving transistor 610 and a light emitting element 609 of which cathode is connected to GND. The driving transistor 610 is controlled to be turned on/off by a signal inputted from the source signal lines $Sr_1$, $Sg_1$, $Sb_1$ to $Sr_n$, $Sg_n$, and $Sb_n$ in a gate selection period. The light emitting element 609 emits light in the pixel 608 of which driving transistor 610 is turned on. It is to be noted that a row of pixels selected by the gate signal line $G_1$ is denoted as a pixel group 604$a_1$, a row of pixels selected by the gate signal line $G_2$ is denoted as a pixel group 604$a_2$, a row of pixels selected by the signal line $G_3$ is denoted as a pixel group 604$a_3$, and a row of pixels selected by the signal line $G_m$ is denoted as a pixel group 604$a_m$.

The display device further includes reference current sources 601$r_1$ to 601$r_m$, reference current sources 601$g_1$ to 601$g_m$, reference current sources 601$b_1$ to 601$b_m$, monitor elements 602$r_1$ to 602$r_m$, monitor elements 602$g_1$ to 602$g_m$, monitor elements 602$b_1$ to 602$b_m$, amplifiers 603$r_1$ to 603$r_m$, amplifiers 603$g_1$ to 603$g_m$, and amplifiers 603$b_1$ to 603$b_m$. The cathodes of the monitor elements 602$r_1$ to 602$r_m$, 602$g_1$ to 602$g_m$, and 602$b_1$ to 602$b_1$ are connected to GND similarly to the cathode of the light emitting element 609. The reference current source 601$r_1$ supplies a constant current to the monitor element 602$r_1$, thereby a voltage generates at the monitor element 602$r_1$. That is, a potential difference generates between opposite electrodes of the monitor element 602$r_1$. A potential of an anode of the monitor element 602$r_1$ at this time is detected by the amplifier 603$r_1$ and approximately the same potential is outputted to a power source line $Vr_1$. Similarly, the reference current sources 601$r_2$ to 601$r_m$, the reference current sources 601$g_2$ to 601$g_m$, and the reference current sources 601$b_2$ to 601$b_m$ supply a constant current to the monitor elements 602$r_2$ to 602$r_m$, 602$g_2$ to 602$g_m$, and 602$b_2$ to 602$b_m$ respectively. The amplifiers 603$r_2$ to 603$r_m$ detect potentials of anodes of the monitor elements 602$r_2$ to 602$r_m$, the amplifiers 603$g_2$ to 603$g_m$ detect potentials of anodes of the monitor elements 602$g_2$ to 602$g_m$, and the amplifiers 603$b_2$ to 603$b_m$ detect potentials of anodes of the monitor elements 602$b_2$ to 602$b_m$ respectively, thereby approximately the same potentials are outputted to power source lines $Vr_2$ to $Vr_m$, $Vg_2$ to $Vg_m$, and $Vb_2$ to $Vb_m$ respectively. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

In the pixel group 604$a_1$, the power source line $Vr_1$ supplies a voltage to a light emitting element in the pixel of R, the power source line $Vg_1$ supplies a voltage to a light emitting element in the pixel of G, and the power source line $Vb_1$ supplies a voltage to a light emitting element in the pixel of B. Similarly, in the pixel groups 604$a_2$ to 604$a_m$, the power source lines $Vr_2$ to $Vr_m$ supply a voltage to the light emitting element in the pixel of R, the power source lines $Vg_2$ to $Vg_m$ supply a voltage to the light emitting element in the pixel of G, and the power source lines $Vb_2$ to $Vb_m$ supply a voltage to the light emitting element in the pixel of B, respectively.

In this manner, a voltage generated at a monitor element arranged for each row of pixels is detected and applied to a light emitting element in the row of pixels, thereby luminance variations due to a temperature gradient in the pixel portion caused by heat generation of the source signal line driver circuit 606 can be reduced.

As a temperature change and a change with time are compensated by providing a monitor element for each pixel of RGB in a row of pixels, a voltage value can be set for a light emitting element according to the characteristics of each of RGB. That is, luminance variations among pixels of RGB can be compensated.

It is to be noted that the invention can be applied to a display device in which pixels of RGB are provided in a delta configuration. With a pixel in delta configuration, a high quality display device can be provided.

A voltage follower circuit using an operational amplifier can be applied to amplifiers 603$r_1$ to 604$r_m$, 603$g_1$ to 603$g_m$, and 603$b_1$ to 603$b_m$. A non-inverting input terminal of the voltage follower circuit is high in input impedance while an output terminal thereof is low in output impedance. Therefore, the output terminal of the voltage follower circuit can supply a current with a non-inverting input terminal thereof being supplied almost no current from the reference current sources 601$a_2$ to 601$a_m$. Then, the output terminal of the voltage follower circuit can output the same potential as a potential inputted to the non-inverting input terminal. That is, an impedance conversion can be carried out. Therefore, it is needless to say that any circuit which has such a function can be used as well as a voltage follower circuit. Further, an impedance conversion is not necessarily carried out when using an amplifier which outputs from an output terminal approximately the same voltage as a potential inputted to an input terminal. Accordingly, a voltage feedback amplifier and a current feedback amplifier can be appropriately used for the amplifiers 603$r_1$ to 603$r_m$, 603$g_1$ to 603$g_m$, and 603$b_1$ to 603$b_m$.

Further, a cathode of the light emitting element 609 of each of the pixel 608 and the monitor elements 602$r_1$ to 602$r_m$, 602$g_1$ to 602$g_m$, and 602$b_1$ to 602$b_m$ is connected to GND, however, the invention is not limited to this. For example, a cathode of each of the light emitting element 609 and the monitor elements 602$r_1$ to 602$r_m$, 602$g_1$ to 602$g_m$, and 602$b_1$ to 602$b_m$ may be connected to another wiring having a specific potential. Further, cathodes of the monitor elements 602$a_1$ to 602$a_m$ and each light emitting element 609 may be connected to different wirings, or each cathode of the monitor elements 602$r_1$ to 602$r_m$, 602$g_1$ to 602$g_m$, and 602$b_1$ to 602$b_m$ may be connected to different wirings or the same wiring. However, it is preferable that the cathodes of the monitor elements 602$r_1$ to 602$r_m$, 602$g_1$ to 602$g_m$, and 602$b_1$ to 602$b_m$ and the light emitting element 609 of each pixel 608 be connected to a wiring of the same potential.

Embodiment Mode 5

Figure 7:
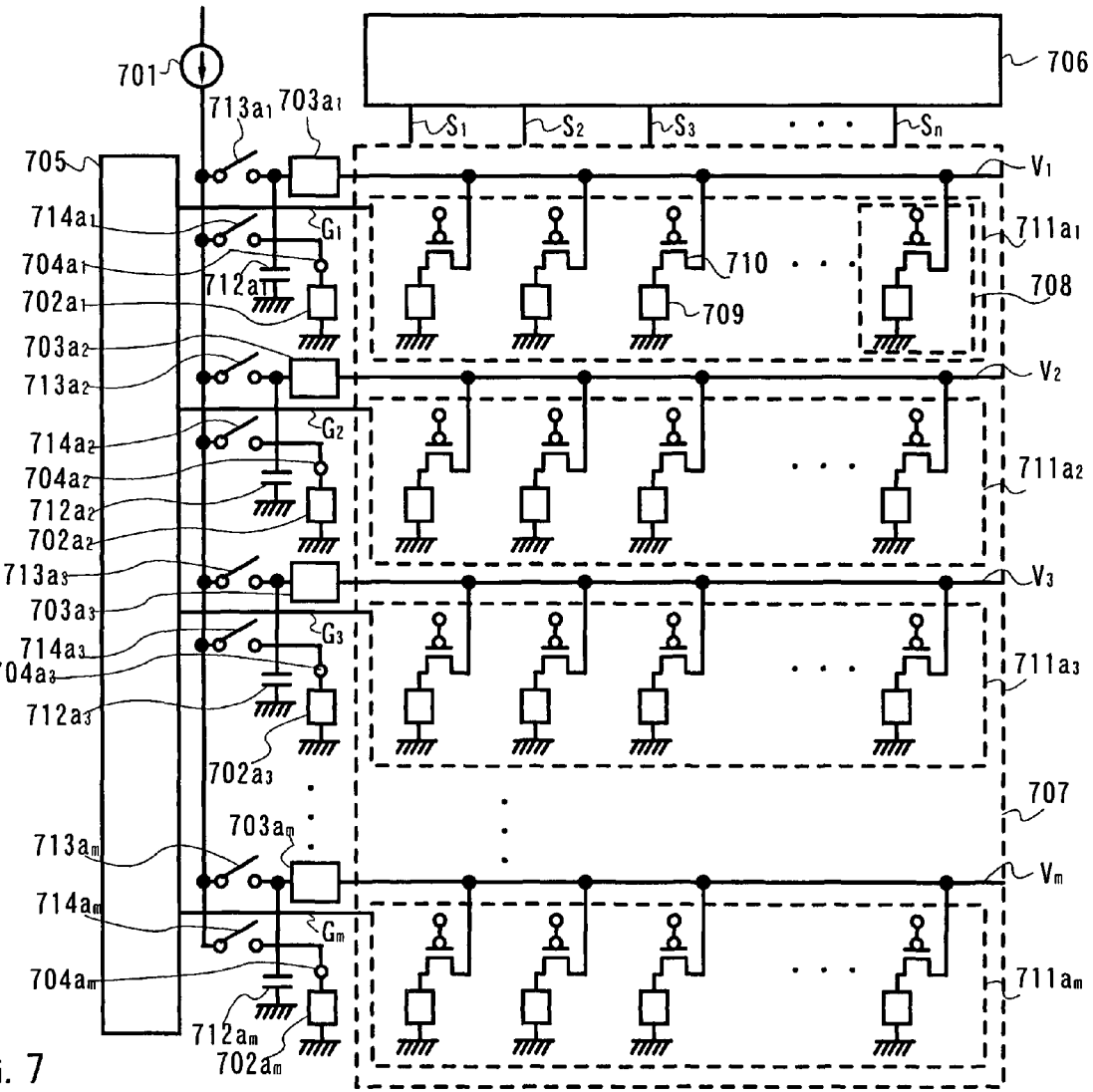
FIG. 7 is a diagram showing an active matrix display device of the invention.

In this embodiment mode, description is made on a configuration of FIG. 7 in which the number of reference current sources which supply a current to a monitor element in the configuration of FIG. 1 is reduced.

A display device includes a gate signal line driver circuit 705 which outputs a signal to the gate signal lines $G_1$ to $G_m$ provided in a row direction, a source signal line driver circuit 706 which outputs a signal to the source signal lines $S_1$ to $S_n$ provided in a column direction, and a pixel portion 707 in which a plurality of pixels 708 are arranged in matrix corresponding to the gate signal lines $G_1$ to $G_m$ and the source signal lines $S_1$ to $S_n$. The pixel 708 includes a driving transistor 710 and a light emitting element 709 of which cathode is connected to GND. The driving transistor 710 is controlled to be turned on/off by a signal inputted from the source signal lines in a gate selection period. The light emitting element 709 emits light in the pixel 708 of which driving transistor 710 is on. It is to be noted that a row of pixels selected by the gate signal line $G_1$ is denoted as a pixel group 711$a_1$, a row of pixels selected by the gate signal line $G_2$ is denoted as a pixel group 711$a_2$, and a row of pixels selected by the signal line $G_m$ is denoted as a pixel group 711$a_m$.

The display device further includes a reference current source 701, monitor elements 702$a_1$ to 702$a_m$, and amplifiers 703$a_1$ to 703$a_m$. The cathodes of the monitor elements 702$a_1$ to 702$a_m$ are connected to GND similarly to the cathode of the light emitting element 709. That is, an amplifier which supplies a voltage to the power source lines $V_1$ to $V_m$ for each row of pixels connected to the gate signal lines $G_1$ to $G_m$ is provided. Each of the amplifiers detects a potential of an anode 704$a_1$ of the monitor element arranged for each row of pixels, thereby approximately the same potential is set at a power source line. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

Here, a principle is described that one reference current source 701 is used for supplying the same value of current to each of the monitor elements 702$a_1$ to 702$a_m$ provided in each of the pixel groups 711$a_1$ to 711$a_m$ and a voltage generated at each monitor element is detected by the amplifiers 703$a_1$ to 703$a_m$ provided for each row of pixels.

First, switches 713$a_1$ and 714$a_1$ are turned on for setting a potential at the power source line $V_1$ of the pixel group 711$a_1$ selected by the gate signal line $G_1$. Then, a current from the reference current source 701 flows to a capacitor 712$a_1$ and the monitor element 702$a_1$. A charge corresponding to a voltage generated at the monitor element 702$a_1$ is accumulated in the capacitor 712$a_1$, thus a current stops flowing to the capacitor 712$a_1$. Then, a potential of an anode of the capacitor 712$a_1$ is detected by the amplifier 703$a_1$. Here, a potential of the anode of the capacitor 712$a_1$ is set at the same potential as that of the cathode of the monitor element, therefore, a voltage generated at the monitor element 702$a_1$ can be detected by detecting a potential of an anode of the capacitor 712$a_1$ having the same potential as that of an anode 714$a_1$ of the monitor element 702$a_1$.

Note that when the switches 713$a_1$ and 714$a_1$ are turned on, the switches 713$a_2$ to 713$a_m$ and 714$a_2$ to 714$a_m$ are turned off. When the switches 713$a_2$ and 714$a_2$ are turned on, the switches 713$a_1$, 713$a_3$ to 713$a_m$, 714$a_1$, and 714$a_3$ to 714$a_m$ are turned off. Accordingly, a current can be sequentially supplied from the reference current source 701 to the monitor elements 702$a_1$ to 702$a_m$ provided beside each row 711$a_1$ to 711$a_m$ of pixels. Further, in the case where a current is not supplied to the corresponding monitor element, a capacitor which accumulates a charge corresponding to a voltage of each monitor element can hold a voltage generated when a current is supplied thereto.

A voltage follower circuit using an operational amplifier can be applied to amplifiers 703$a_1$ to 703$a_m$. A non-inverting input terminal of the voltage follower circuit is high in input impedance while an output terminal thereof is low in output impedance. Therefore, the output terminal of the voltage follower circuit can supply a current with a non-inverting input terminal thereof being supplied almost no current from the reference current sources 701$a_2$ to 701$a_m$. Then, the output terminal of the voltage follower circuit can output the same potential as a potential inputted to the non-inverting input terminal. That is, an impedance conversion can be carried out. Therefore, it is needless to say that any circuit which has such a function can be used as well as a voltage follower circuit. Further, an impedance conversion is not necessarily carried out when using an amplifier which outputs from an output terminal approximately the same voltage as a potential inputted to an input terminal. Accordingly, a voltage feedback amplifier and a current feedback amplifier can be appropriately used for the amplifiers 703$a_1$ to 703$a_m$.

Further, a cathode of the light emitting element 709 of each of the pixel 708 and the monitor elements 702$a_1$ to 702$a_m$, and one electrode of each of the capacitors 712$a_1$ to 712$a_m$ is connected to GND, however, the invention is not limited to this. For example, a cathode of each of the light emitting element 709 and the monitor elements 702$a_1$ to 702$a_m$ and one electrode of each of the capacitors 712$a_1$ to 712$a_m$ may be connected to another wiring having a specific potential. Further, cathodes of the monitor elements 702$a_1$ to 702$a_m$ and each light emitting element 709 and one electrode of each of the capacitors 712$a_1$ to 712$a_m$ may be connected to different wirings, or each cathode of the monitor elements 702$a_1$ to 702$a_m$ may be connected to different wirings or the same wiring. However, it is preferable that the cathodes of the monitor elements 702$a_1$ to 702$a_m$ and the light emitting element 709 of each pixel 708 and the one electrode of each of the capacitors 712$a_1$ to 712$a_m$ be connected to a wiring of the same potential.

Next, a specific configuration example of the display device shown in FIG. 7 is described with reference to FIG. 8.

A display device includes a gate signal line driver circuit 805 which outputs a signal to gate signal lines $G_1$ to $G_m$ provided in a row direction, a source signal line driver circuit 806 which outputs a signal to source signal lines $S_1$ to $S_n$ provided in a column direction, and a pixel portion 807 in which a plurality of pixels 808 are arranged in matrix corresponding to the gate signal lines $G_1$ to $G_m$ and the source signal lines $S_1$ to $S_n$. The pixel 808 includes a switching transistor 804, a capacitor 811, a driving transistor 810, and a light emitting element 809 of which cathode is connected to GND.

The display device further includes a reference current source 801, a monitor element 802 corresponding to each row of pixels, a voltage follower circuit 803, a capacitor 812, a first transistor 813 and a second transistor 814. The gate electrodes of the first transistor 813 and the second transistor 814 are connected to a gate signal line. Therefore, at a timing that the switching transistor 804 of which gate electrode is connected to a gate signal line selected by the gate signal line driver circuit 805 is turned on, the first and second transistors 813 and 814 provided corresponding to a row of pixels including the switching transistor are turned on. That is, the first and second transistors 813 and 814 provided corresponding to a row of pixels in a state (in a gate selection period) where a signal from the source signal lines $S_1$ to $S_m$ can be written to the driving transistor 810. Accordingly, the first and second transistors 813 and 814 corresponding to each row of pixels are sequentially turned on according to a signal from the gate signal lines $G_1$ to $G_m$.

When the first and second transistors 813 and 814 are turned on, a current from the reference current source 801 flows to the capacitor 812 and the monitor element 802. A charge corresponding to a voltage generated at the monitor element 802 is accumulated in the capacitor 812, thus a current stops flowing to the capacitor 812 and only flows to the monitor element 802. At this time, a potential of an anode of the monitor element 802 is inputted to a non-inverting input terminal of the voltage follower circuit 803 and an output terminal thereof outputs approximately the same potential to a power source line of a corresponding row of pixels. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

When a gate selection period of a certain row of pixels is terminated and a gate selection period of a next row of pixels starts, the first transistor 813 and the second transistor 814 are turned off which correspond to the row of pixels of which gate selection period is terminated, and then a voltage generated at the monitor element 802 at that time is held in the capacitor 812. By each capacitor 812 sequentially holding a voltage generated at the monitor element 802 corresponding to each row of pixels, a potential of an anode of the corresponding monitor element 802 can be inputted to a non-inverting input terminal of the voltage follower circuit 803 corresponding to each row of pixels. Accordingly, approximately the same potential as a potential of an anode of each monitor element 802 for each row of pixels is set at each power source line. When a gate selection period starts again in each row, the capacitor 812 accumulates a charge corresponding to a voltage generated by a change in resistance of the monitor element 802 caused by an environment temperature change and a change with time, and holds a voltage of the monitor element 802 at a moment when the gate selection period is terminated.

Figure 8:
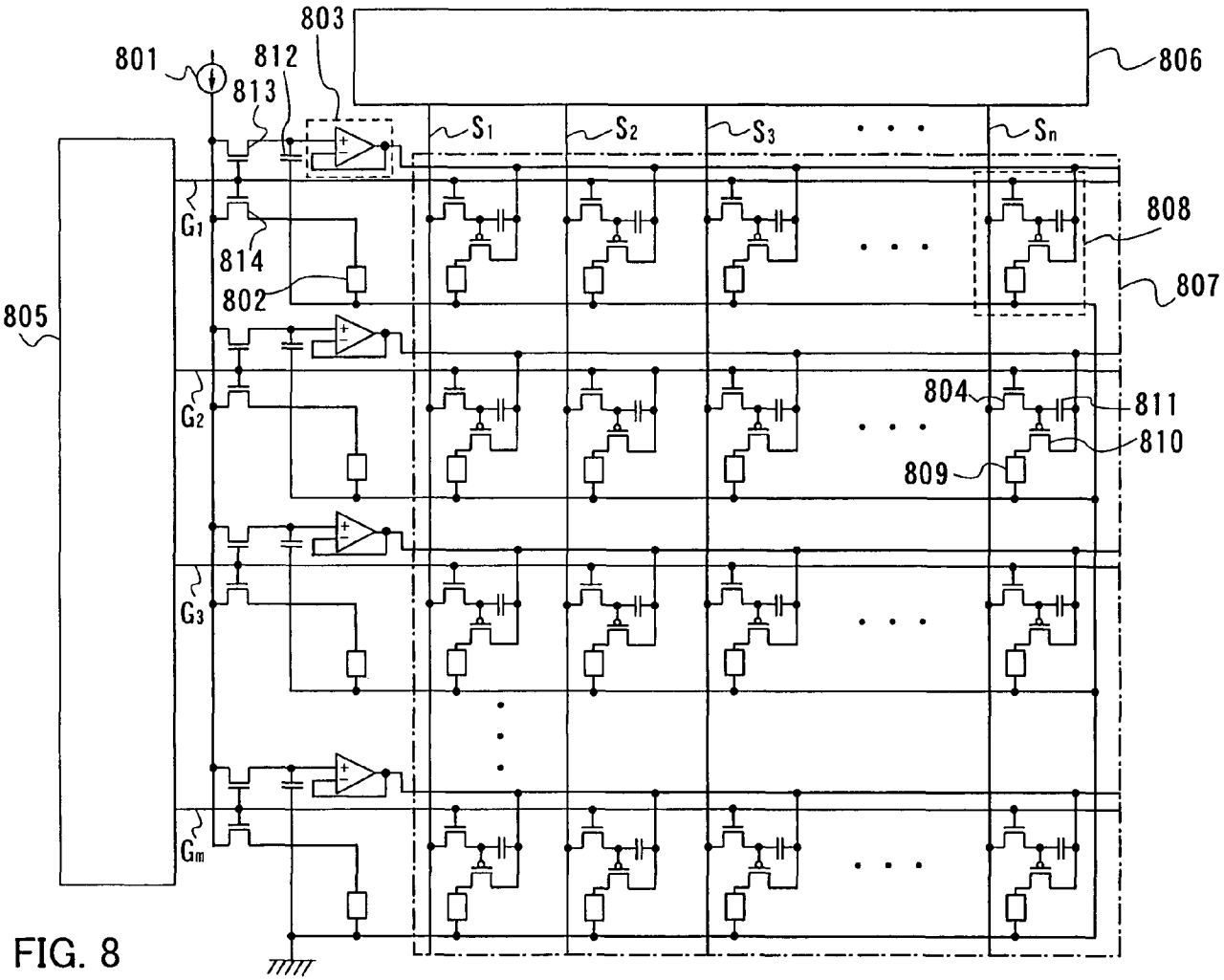
FIG. 8 is a diagram showing a specific configuration example of an active matrix display device of the invention.

In this manner, in the display device having the configuration of FIG. 8, luminance variations of a light emitting element caused by a temperature change and a change with time can be compensated according to a gate selection period.

Further, luminance variations of the light emitting element 809 caused by a temperature gradient due to heat generation of the source signal line driver circuit 806 can be compensated by setting a potential of a power source line for each row of pixels.

Moreover, only one current source is required to be provided because of a simple configuration. Thus, a circuit configuration can be simplified and cost reduction can be realized.

Although the voltage follower circuit 803 is used in the configuration of FIG. 8, it is needless to say that the invention is not limited to the voltage follower circuit as long as a function to output from an output terminal approximately the same potential as a potential inputted to an input terminal is provided. Accordingly, a voltage feedback amplifier and a current feedback amplifier can be appropriately used for the voltage follower circuit.

Although the cathodes of the monitor element 802 and the light emitting element 809 of each pixel 808 are connected to GND, the invention is not limited to this. For example, a cathode of each of the light emitting element 809 and the monitor elements 802 may be connected to another wiring having a specific potential. Further, cathodes of the monitor elements 802 and each light emitting element 809 may be connected to different wirings, or each cathode of the monitor elements 802 may be connected to different wirings or the same wiring. However, it is preferable that the cathodes of the monitor elements 802 and the light emitting elements 809 be connected to a wiring of the same potential.

Further, the invention is not limited to this configuration, and can be applied to a pixel configuration in which polarity of a transistor in the pixel is changed, a connection is changed, or a new transistor is additionally provided.

Further, a monitor element may be provided on the opposite side to the gate signal line driver circuit with the pixel portion interposed therebetween. The arrangement of the monitor element can be appropriately selected for achieving an effective function of temperature compensation.

Embodiment Mode 6

An active matrix display device (also referred to as an active display device) is described in Embodiment Modes 1 to 5, however, the invention can be applied to a passive matrix display device (also referred to as a passive display device) as well. In this embodiment mode, the case of applying a compensation circuit of the invention to a passive matrix display device is described.

A basic principle of a temperature and deterioration compensation circuit (hereinafter simply referred to as a compensation circuit) included in a passive display device and a driving method of the display device are briefly described with reference to FIG. 12.

Figure 12:
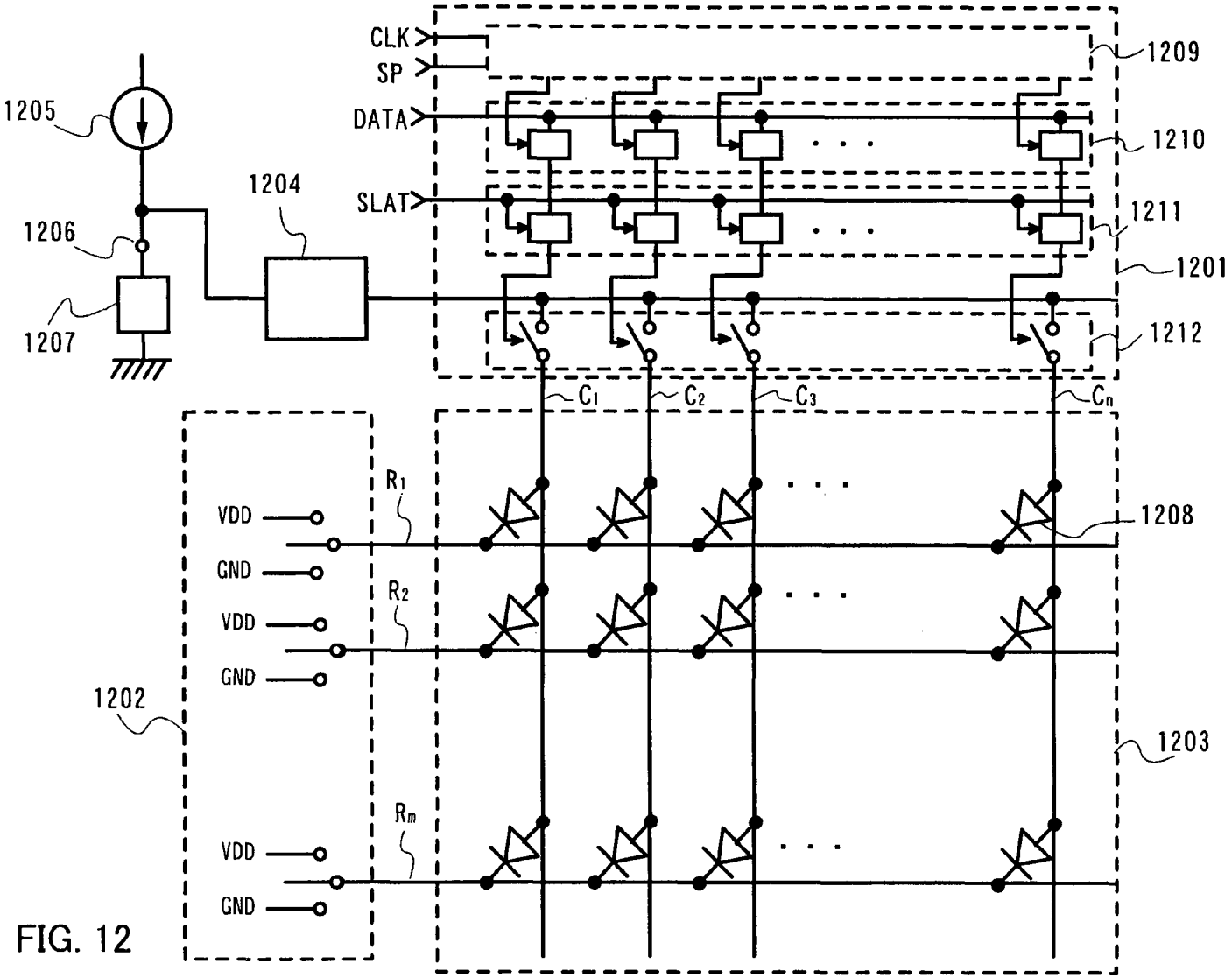
FIG. 12 is a diagram showing a compensation function of a passive matrix display device of the invention.

A display device shown in FIG. 12 includes a row signal line driver circuit 1202 which outputs a signal to row signal lines $R_1$ to $R_m$ provided in a row direction, a column signal line driver circuit 1201 which outputs a signal to column signal lines $C_1$ to $C_n$ provided in a column direction, and a pixel portion 1203 in which light emitting elements 1208 are arranged in matrix corresponding to the row signal lines $R_1$ to $R_m$ and the column signal lines $C_1$ to $C_n$. The row signal line driver circuit 1202 selects one row signal line among the row signal lines $R_1$ to $R_m$ (here, a row signal line is connected to GND). That is, one row signal line is selected so that a current is supplied to the light emitting element 1208 by a potential difference between a potential set at the column signal lines $C_1$ to $C_n$. Thus, a potential difference between a potential at the selected row signal line and a potential set at the column signal line is applied to the light emitting element 1208 sandwiched by the row signal line and the column signal line. Then, a current flows and the light emitting element 1208 emits light. At this time, a potential at the column signal lines $C_1$ to $C_n$ is set similarly at each column signal line, however, a period in which a potential is set differs. In this manner, a time gray scale display can be performed.

The display device further includes a reference current source 1205, a monitor element 1207, and an amplifier 1204. The reference current source 1205 supplies a constant current to the monitor element 1207. That is, the monitor element 1207 performs a constant current drive. The amplifier 1204 detects a potential on an anode 1206 side of the monitor element 1207, thereby a potential outputted to the column signal lines $C_1$ to $C_n$ is set. It is to be noted that a voltage follower circuit, for example, can be used as the amplifier 1204.

The column signal line driver circuit 1201 includes a pulse output circuit 1209, a first latch circuit 1210, a second latch circuit 1211, and a switch group 1212. A pulse is outputted from the pulse output circuit 1209, based on which a DATA signal is sequentially stored in the first latch circuit 1210. The data stored in the first latch circuit 1210 is transferred to the second latch circuit 1211 at a timing of a SLAT signal. Then, the data stored in the second latch circuit 1211 controls a period in which each switch in the switch group 1212 is turned on, thereby a period in which a potential is supplied to the column signal lines $C_1$ to $C_n$ is set. That is, a period in which a potential is applied to the light emitting element is determined. In this manner, a time gray scale display can be performed.

It is to be noted in actuality that, in the case of a 3-it gray scale display, for example, each of the first latch circuit 1210 and the second latch circuit 1211 includes three latch circuits per switch which controls a power supply of each column signal line. The 3-bit data per each column signal line outputted from the second latch circuit 1211 is converted to have a pulse width for displaying an 8-level gray scale so that each switch of the switch group 1212 is turned on in a period corresponding to the pulse width. In this manner, the 8-level gray scale can be displayed.

Here, the display device of the invention includes a monitor element arranged in the periphery of the pixel portion beside the light emitting element provided in a row direction. A unit for supplying a constant current to each monitor element, detecting a voltage generated at the monitor element, and applying the voltage to the light emitting element provided in the row direction is provided. An example of such a passive display device is described with reference to FIG. 9.

Figure 9:
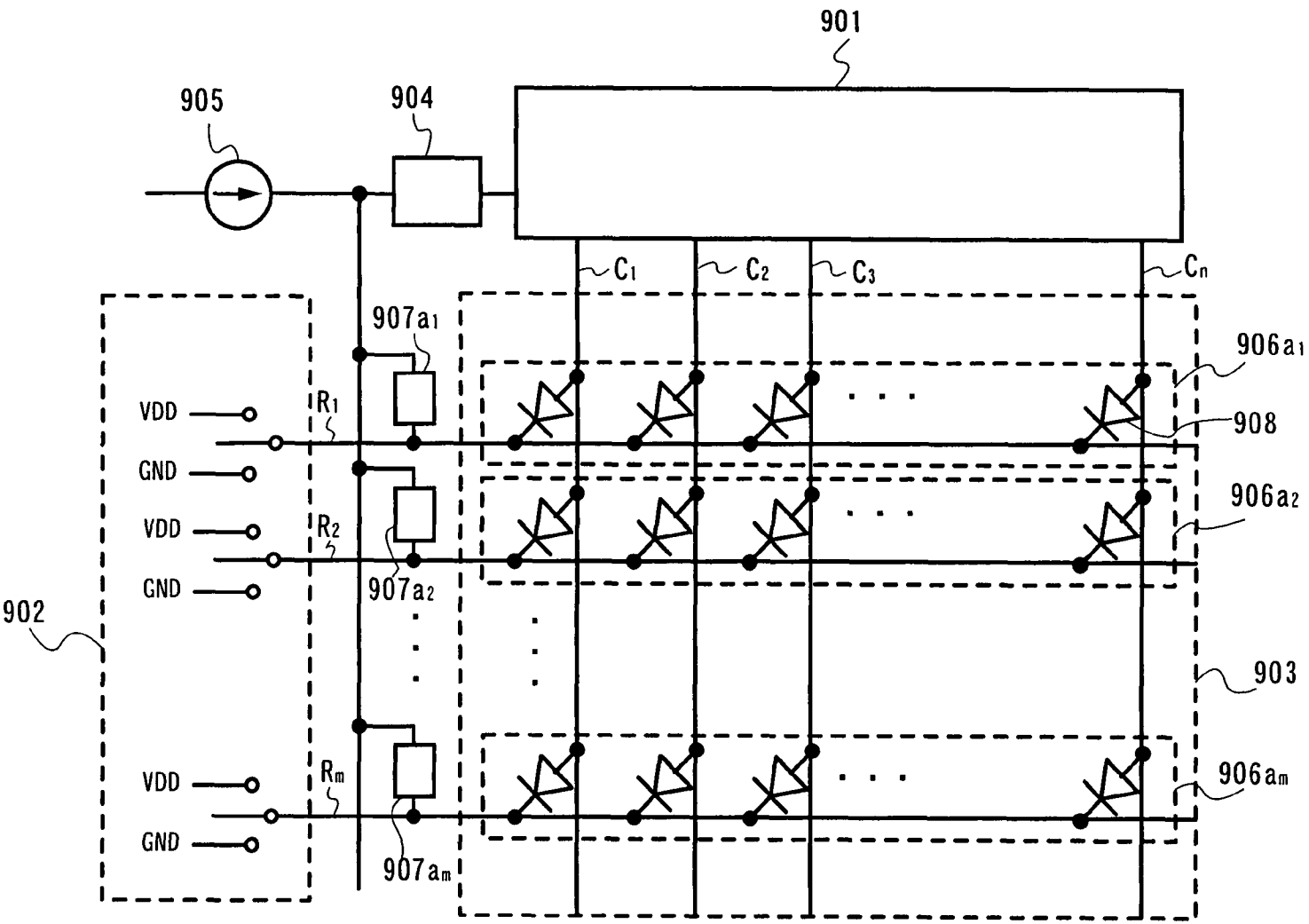
FIG. 9 is a diagram showing a passive matrix display device of the invention.

A display device shown in FIG. 9 includes a row signal line driver circuit 902 which outputs a signal to the row signal lines (also referred to as scan lines) $R_1$ to $R_m$ provided in a row direction, a column signal line driver circuit 901 which outputs a signal to the column signal lines $C_1$ to $C_n$ provided in a column direction, and a pixel portion 903 in which light emitting elements 908 are arranged in matrix corresponding to the row signal lines $R_1$ to $R_m$ and the column signal lines $C_1$ to $C_n$. It is to be noted that a row of light emitting elements of which cathodes are connected to the row signal line $R_1$ is denoted as a light emitting element group 906$a_1$, a row of light emitting elements of which cathodes are connected to the row signal line $R_2$ is denoted as a light emitting element group 906$a_2$, and a row of light emitting elements of which cathodes are connected to the row signal line $R_m$ is denoted as a light emitting element group 906$a_m$.

The display device shown in FIG. 9 includes a reference current source 905, an amplifier 904, and monitor elements 907$a_1$ to 907$a_m$. The reference current source 905 supplies a constant current to any of the monitor elements 907$a_1$ to 907$a_m$. In this configuration, a cathode of each monitor element corresponding to a light emitting group provided in a row direction is connected to a row signal line similarly to a cathode of the light emitting element 908, therefore, a current only flows to a monitor element corresponding to a light emitting element group in a scan line selection period. That is, a current flows to the light emitting element 908 and the monitor element in a row of which row signal line is connected to GND.

A voltage generated at a monitor element to which a current is supplied is detected by the amplifier 904, thus the voltage is inputted to the column signal line driver circuit 901. Then, the column signal line driver circuit 901 sets a period in which a voltage inputted from the amplifier 904 is supplied to each of the column signal lines $C_1$ to $C_n$ is set. That is, a period in which a voltage is supplied is set for each column of a certain row of light emitting element group. Then, a voltage applied to each column of light emitting elements is the same voltage as a voltage supplied by the amplifier 904.

In this manner, a constant current is supplied to a monitor element provided for each row of light emitting elements, and a generated voltage is applied to the light emitting element 908 of the same row. That is, a constant current is supplied from the reference current source 905 to the monitor element 907$a_1$, a generated voltage is applied to the light emitting element group 906$a_1$, a constant current is supplied from the reference current source 905 to the monitor element 907$a_2$, a generated voltage is applied to the light emitting element group 906$a_2$, a constant current is supplied from the reference current source 905 to the monitor element 907$a_m$, and a generated voltage is applied to the light emitting element group 906$a_m$.

In this manner, a voltage generated at a monitor element provided beside each row of light emitting elements is detected, and the detected voltage is applied to the light emitting element of that row, thereby luminance variations due to a temperature gradient in the pixel portion caused by heat generation of the column signal line driver circuit 901 can be reduced.

A voltage can be set in accordance with a resistance of the light emitting element 908 which changes due to an environment temperature change and a change with time. Therefore, the environment temperature change and change with time can be compensated as well.

It is to be noted that a voltage follower circuit using an operational amplifier can be applied to the amplifier 904. A non-inverting input terminal of the voltage follower circuit is high in input impedance while an output terminal thereof is low in output impedance. Therefore, the output terminal of the voltage follower circuit can supply a current with a non-inverting input terminal thereof being supplied almost no current from the reference current source 905. Then, the output terminal of the voltage follower circuit can output the same potential as a potential inputted to the non-inverting input terminal. That is, an impedance conversion can be carried out. Therefore, it is needless to say that any circuit which has such a function can be used as well as a voltage follower circuit. Further, an impedance conversion is not necessarily carried out when using an amplifier which outputs from an output terminal approximately the same voltage as a potential inputted to an input terminal. Accordingly, a voltage feedback amplifier and a current feedback amplifier can be appropriately used for the amplifier 904.

Further, a potential at a row signal line when selected is GND, however, the invention is not limited to this. Therefore, the wiring may have a specific potential other than GND.

Next, a specific configuration example in which a monitor element is provided for each light emitting element of RGB for setting a voltage for each light emitting element of RGB is described with reference to FIG. 10.

Figure 10:
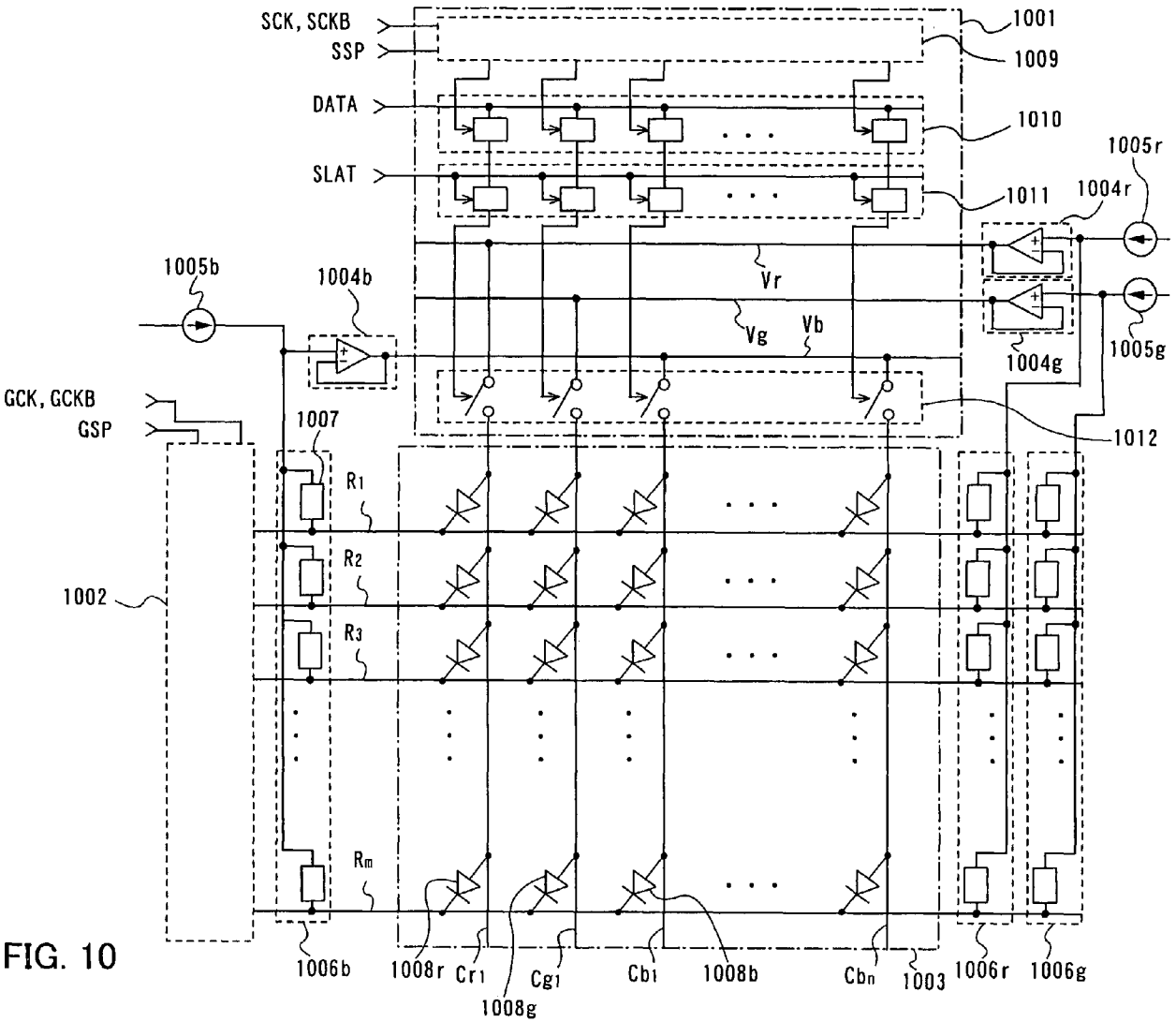
FIG. 10 is a diagram showing a specific configuration example of a passive matrix display device of the invention.

A display device shown in FIG. 10 includes a row signal line driver circuit 1002 which outputs a signal to row signal lines (also referred to as scan lines) $R_1$ to $R_m$ provided in a row direction, a column signal line driver circuit 1001 which outputs a signal to the column signal lines $C_1$ to $C_n$ provided in a column direction, and a pixel portion 1003 in which light emitting elements are arranged in matrix corresponding to the row signal lines $R_1$ to $R_m$ and the column signal lines $C_1$ to $C_n$.

A light emitting element 1008*r* of an R component, a light emitting element 1008*g* of a G component, and a light emitting element 1008*b* of a B component are arranged in the order of RGB in a column direction corresponding to column signal lines. In the periphery of the pixel portion 1003, a monitor element group 1006*r* of an R component, a monitor element group 1006*g* of a G component, and a monitor element group 1006*b* of a B component are provided beside the column of light emitting elements of RGB. The monitor elements which form these monitor element groups are provided beside the light emitting elements provided in a row direction corresponding to the row signal lines $R_1$ to $R_m$.

The display device further includes a reference current source 1005*r* which supplies a current to monitor elements which form the monitor element group 1006*r*, a reference current source 1005*g* which supplies a current to a monitor element which forms the monitor element group 1006*g*, a reference current source 1005*b* which supplies a current to monitor elements which form the monitor element group 1006*b*, an amplifier 1004*r* which detects a potential of an anode of monitor elements which form the monitor element group 1006*r* and sets at a power source line Vr approximately the same potential as the detected potential, an amplifier 1004*g* which detects a potential of an anode of a monitor element which forms the monitor element group 1006*g* and sets at a power source line Vg approximately the same potential as the detected potential, and an amplifier 1004*b* which detects a potential of an anode of the monitor elements which form the monitor element group 1006*b* and sets at a power source line Vb approximately the same potential as the detected potential. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

Further, the column signal line driver circuit includes a pulse output circuit 1009, a first latch circuit 1010, and a second latch circuit 1011. It is to be noted that an operation of the column signal line driver circuit 1001 is omitted here as it is similar to that described with reference to FIG. 12.

In this configuration, for example, when the row signal line R1 is selected, the reference current source 1005*r* supplies a current to the monitor element 1008*r* of which cathode is connected to a row signal line among monitor elements which form the monitor element group 1006*r*. Then, a current flows through the monitor element 1008*r*, a potential of an anode of the monitor element 1008*r* at which a voltage is generated is detected by the amplifier 1004*r*, and approximately the same potential as the detected potential is set at the power source line Vr. The potential set at the power source line Vr is supplied as a voltage through column signal lines $Cr_1$ to $Cr_n$ to the light emitting element 1008*r* of which cathode is connected to the selected signal line $R_1$. Similarly, the reference current source 1005*g* supplies a current to the monitor element 1008*g* of which cathode is connected to a row signal line among monitor elements which form the monitor element group 1006*g*. Then, a current flows through the monitor element 1008*g*, a potential of an anode of the monitor element 1008*g* at which a voltage is generated is detected by the amplifier 1004*g*, and approximately the same potential as the detected potential is set at the power source line Vg. The potential set at the power source line Vg is supplied as a voltage through column signal lines $Cg_1$ to $Cg_n$ to the light emitting element 1008*g* of which cathode is connected to the selected signal line $R_1$. The reference current source 1005*b* supplies a current to the monitor element 1008*b* of which cathode is connected to a row signal line among monitor elements which form the monitor element group 1006*b*. Then, a current flows through the monitor element 1008*b*, a potential of an anode of the monitor element 1008*b* at which a voltage is generated is detected by the amplifier 1004*b*, and approximately the same potential as the detected potential is set at the power source line Vb. The potential set at the power source line Vb is supplied as a voltage through column signal lines $Cb_1$ to $Cb_n$ to the light emitting element 1008*b* of which cathode is connected to the selected signal line $R_1$. It is to be noted that approximately the same potential here may have a margin of error to the extent that luminance variations of the monitor element and the light emitting element cannot be recognized when a potential of the monitor element detected in each row is outputted to each power source line and applied to the light emitting elements of each row, with the monitor element and the light emitting element having the same V-I characteristics. Accordingly, approximately the same potential has a certain degree of margin.

In this manner, a voltage can be independently applied to each light emitting element of RGB provided in a row direction corresponding to the row signal line $R_1$.

Next, when the row signal lines $R_2, R_3, \ldots, R_m$ are selected, a constant current is supplied to each monitor element of RGB corresponding to the selected row, a voltage generated at the monitor element of RGB in each row is detected by an amplifier corresponding to each RGB, and the voltage is supplied to each light emitting element of RGB of the corresponding row.

In this manner, a voltage generated at a monitor element provided beside each row of pixels is detected and applied to light emitting elements of the row of pixels, thereby luminance variations caused by a temperature gradient in a pixel portion due to heat generation of the source signal line driver circuit 606 can be reduced.

As an environment temperature change and a change with time are compensated by providing a monitor element for each pixel of RGB in a row of pixels, a voltage value can be set for a light emitting element according to the characteristics of each of RGB. That is, luminance variations among pixels of RGB can be compensated.

Although the voltage follower circuits 1004*r*, 1004*g*, and 1004*b* are used in the configuration of FIG. 8, it is needless to say that the invention is not limited to the voltage follower circuit as long as a function to output from an output terminal approximately the same potential as a potential inputted to an input terminal is provided. Accordingly, a voltage feedback amplifier and a current feedback amplifier can be appropriately used for the voltage follower circuits 1004*r*, 1004*g*, and 1004*b*.

Embodiment Mode 7

In this embodiment mode, description is made on a panel configuration of a display device in which a temperature gradient in a pixel portion caused by heat generation of a signal line driver circuit is reduced.

In this embodiment mode, a heat dissipation layer for reducing a temperature gradient in a pixel portion of a display device is provided.

That is, a display device includes a display portion having a light emitting element of which luminance changes by a temperature change and a driver circuit provided in the periphery of the display portion over a first substrate with a first heat dissipation layer interposed therebetween. The display portion is sandwiched by the first substrate and a second substrate.

Figure 15A:
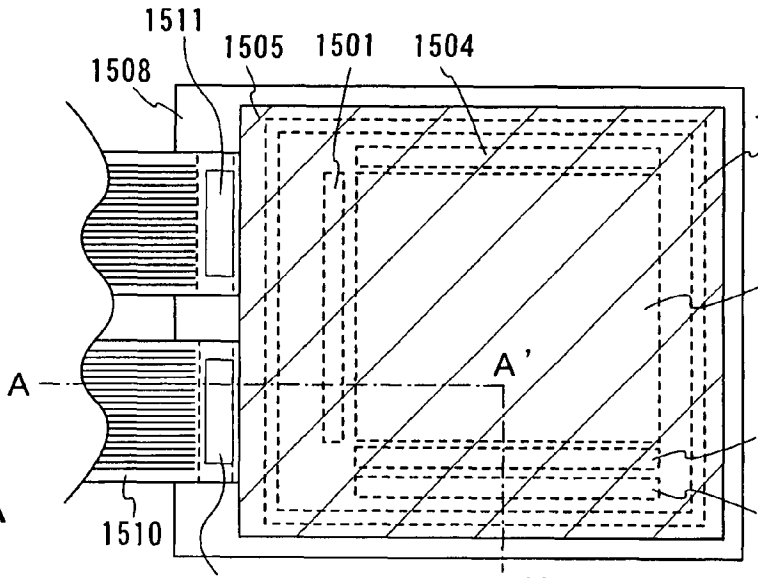
FIGS. 15A and 15B are diagrams showing panel configurations of an active matrix display device of the invention.
Figure 15B:
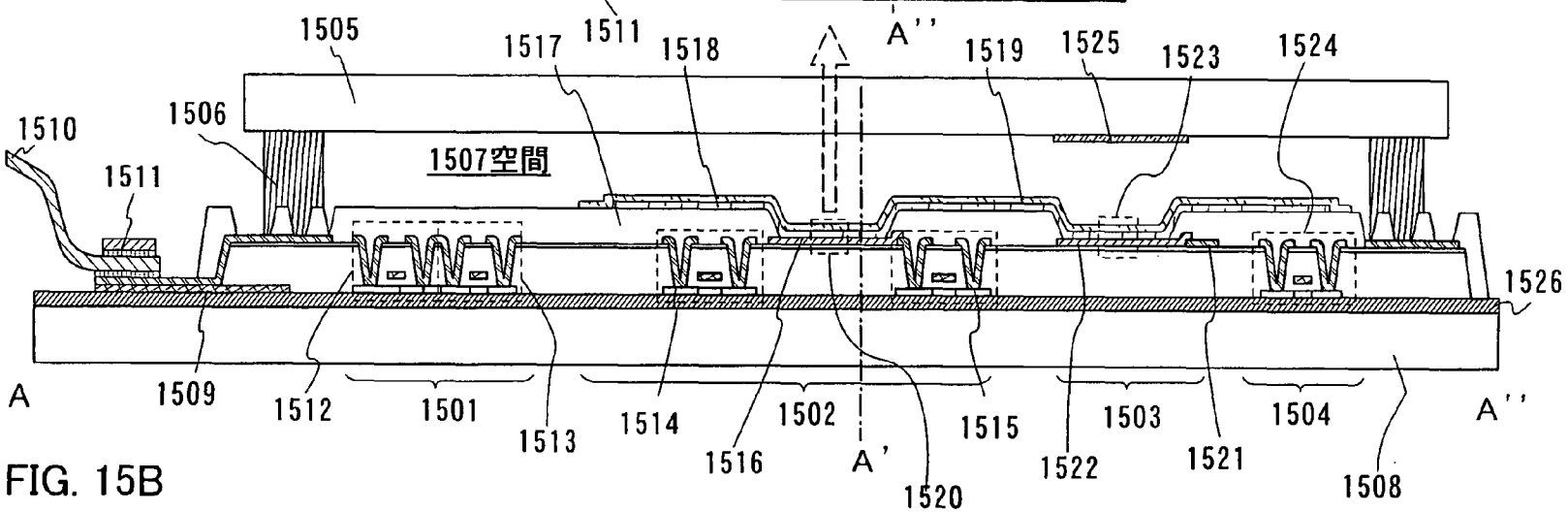

First, description is made with reference to FIGS. 15A and 15B on an example of a panel configuration in which a layer having a heat dissipation function is provided as a base film over a substrate surface on which a pixel portion is formed. It is to be noted that FIG. 15A is a top plan view of a display device and FIG. 15B is a cross-sectional view taken along A-A'-A" in FIG. 15A. As shown by dotted lines, the display device includes a driver circuit portion (source signal line driver circuit) 1501, a pixel portion 1502, a monitor element portion 1503, and a driver circuit portion (gate signal line driver circuit) 1504. Further, there is a space 1507 surrounded by a sealing substrate (opposite substrate) 1505 and a sealing material 1506.

It is to be noted that a wiring 1509 is a wiring for transferring a signal to be inputted to the source signal line driver circuit 1501 and the gate signal line driver circuit 1504, and receives a video signal, a clock signal, a start signal, a reset signal and the like from an FPC (Flexible Printed Circuit) 1510 as an external input terminal. An IC chip (semiconductor integrated circuit) 1511 is connected on the FPC by COG (Chip On Glass). It is to be noted that the IC chip may be connected by using TAB (Tape Auto Bonding) or a printed substrate.

The cross-sectional structure is described with reference to FIG. 15B. A base film 1526 having a heat dissipation effect is formed as a heat dissipation layer over the substrate 1508. It is preferable that the base film 1526 having a heat dissipation effect have a heat conductivity of 10 to 300 W/mK, and more preferably 50 to 300 W/mK. Further, the base film can be formed of alumina ($Al_2O_3$), cubic boron nitride (c-BN), aluminum nitride (AlN), BeO (beryllia), diamond and the like which are high in heat conductivity. In particular, aluminum nitride (AlN) is superior in heat conductivity, insulation performance, and high frequency characteristics, and is favorable as a heat dissipation layer since a thermal expansion coefficient close to that of silicon is obtained. For example, a single layer of AlN (aluminum nitride), stacked layers of AlN, SiNO (silicon nitride oxide), SiON (silicon oxynitride) and the like are preferably used. It is to be noted that aluminum nitride (AlN) may contain 0.1 to 30 atomic % of oxygen (O). That is, aluminum nitride oxide ($AlN_xO_y$) may be used as well.

The source signal line driver circuit 1501, the pixel portion 1502, the monitor element portion 1503, and the gate signal line driver circuit 1504 are formed over the base film 1526.

It is to be noted that the source signal line driver circuit 1501 is formed of a CMOS circuit in which an n-channel TFT 1512 and a p-channel TFT 1513 are used in combination. A TFT 1524 corresponds to a TFT which forms the gate signal line driver circuit. Further, a TFT which forms a driver circuit may be formed of a known CMOS circuit, PMOS circuit, or NMOS circuit. In this embodiment mode, a driver-integrated type is shown in which a driver circuit is formed over a substrate, however, the invention is not limited to this and the driver circuit can be formed outside the substrate as well.

The pixel portion 1502 is formed of a plurality of pixels each of which includes a switching TFT 1514 a current controlling TFT 1515 and a first electrode 1516 electrically connected to a drain of the current controlling TFT 1515. It is to be noted that an insulator 1517 is formed so as to cover an edge portion of the first electrode 1516. Here, the insulator is formed using a positive type, photosensitive acrylic resin film.

In order to obtain a favorable coverage, the insulator 1517 is formed so as to have a curved surface with a curvature at a top portion or a bottom portion thereof. In the case of using a positive type, photosensitive acryl as a material for the insulator 1517, for example, it is preferable that a top portion only has a curved surface with a curvature radius (0.2 to 3 μm). As the insulator 1517, either of a negative type acryl which becomes insoluble to etchant by photosensitive light or a positive type acryl which becomes soluble to etchant by light can be used.

An electroluminescent layer 1518 and a second electrode 1519 are formed over the first electrode 1516. Here, it is preferable to use a material having a high work function for a material of the first electrode 1516 which functions as an anode. For example, a single layer structure of a titanium film, a chromium film, a tungsten film, a Zn film, a Pt film and the like, a stacked-layer structure of titanium nitride and a film containing aluminum as a main component, and a three-layer structure of a titanium nitride film, a film containing aluminum as a main component, and a titanium nitride film can be used. It is to be noted that a stacked-layer structure is low in resistance as a wiring, thus a favorable ohmic contact can be obtained and a function as an anode can be obtained as well.

Further, the electroluminescent layer 1518 is formed by a deposition method using a deposition mask or a ink-jet method. A metal complex which belongs to a group 4 of periodic table of elements is used for a part of the electroluminescent layer 1518. Besides, a low molecular weight material or a high molecular weight material can be used in combination. As a material used for the electroluminescent layer, an organic compound is often used in a single layer or stacked layers, however, an inorganic compound may be used for a part of a film formed of an organic compound in this embodiment mode. Moreover, a known triplet material may be used as well.

As a material of the second electrode 1519 formed over the electroluminescent layer 1518, a material having a low work function (Al, Ag, Li, Ca, or an alloy of these such as MgAg, MgIn, AlLi, $CaF_2$, or CaN) may be used. It is to be noted that a top emission type is employed here, therefore, it is preferable to employ an aluminum film with a thickness of 1 to 10 nm, an aluminum film containing a slight amount of Li, or stacked layers of a thin metal film of which thickness is thinned, and a light-transmissive conductive film (ITO (indium oxide tin oxide alloy), indium oxide zinc oxide alloy ($In_2O_3$—ZnO), zinc oxide (ZnO) and the like).

In the pixel portion 1502, a wiring 1521 formed of the same material as the current controlling TFT 1515 and the first electrode 1516 electrically connected to a drain thereof, and a monitor element 1523 with a structure that the electroluminescent layer 1518 is sandwiched by a second electrode 1519 and an anode 1522 connected to the wiring 1521 are formed. It is to be noted that a light shielding film 1524 is formed over the monitor element portion 1503 for shielding light emission of the monitor element.

Further, by attaching the sealing substrate 1505 to the element substrate 1508 with the sealing material 1506, an electroluminescence element 1520 and the monitor element 1523 are provided in the space 1507 surrounded by the element substrate 1508, the sealing substrate 1505, and the sealing material 1506. It is to be noted that the space 1507 may be filled with the sealing material 1506 as well as an inert gas (nitrogen, argon and the like).

It is preferable that the sealing material 1506 be an epoxy based resin. Moreover, it is preferable that this material does not transmit moisture and oxygen as much as possible. As a material for the sealing substrate 1505, a glass substrate, a quartz substrate, and a plastic substrate formed of FRP (Fiberglass-Reinforced Plastics), PVF (Polyvinyl Fluoride), myler, polyester, acryl and the like can be used.

In this manner, an active matrix display device in which a temperature gradient in a pixel portion is reduced can be obtained.

Further, as another configuration for reducing a temperature gradient in the display portion, in a display device including a display portion provided with a light emitting element of which luminance changes by a temperature change and a driver circuit provided in the periphery of the display portion formed over a first substrate, in which the display portion is sandwiched by the first substrate and the second substrate, a layer having a heat dissipation effect may be provided over an outer surface of the second substrate.

Here, a configuration of a panel in the case of providing a layer having a heat dissipation effect over a counter substrate is described with reference to FIGS. 16A and 16B. It is to be noted that common portions between FIGS. 15 and 16 are denoted by common reference numerals and a description thereon is omitted here.

In this configuration, a film 1601 having a heat dissipation effect is formed over the sealing substrate 1505 to be a counter substrate. For example, a metal film which is superior in heat conductivity is preferably provided. As the metal film, for example, copper formed over a film by spin coating can be used. It is to be noted that a single layer of a layer having a heat dissipation effect or stacked layers of this film and silicon nitride oxide or silicon oxynitride may be used, however, stacked layers of only silicon nitride oxide and silicon oxynitride may be used in the configuration of FIGS. 16A and 16B. However, it is preferable for effectively dissipating heat to employ stacked layers of aluminum nitride (AlN) or diamond having a heat transmissivity, silicon nitride oxide, and silicon oxynitride. It is to be noted that aluminum nitride (AlN) may contain 0.1 to 30 atomic % of oxygen (O). That is, aluminum nitride oxide ($AlN_xO_y$) may be formed as well.

Figure 16A:
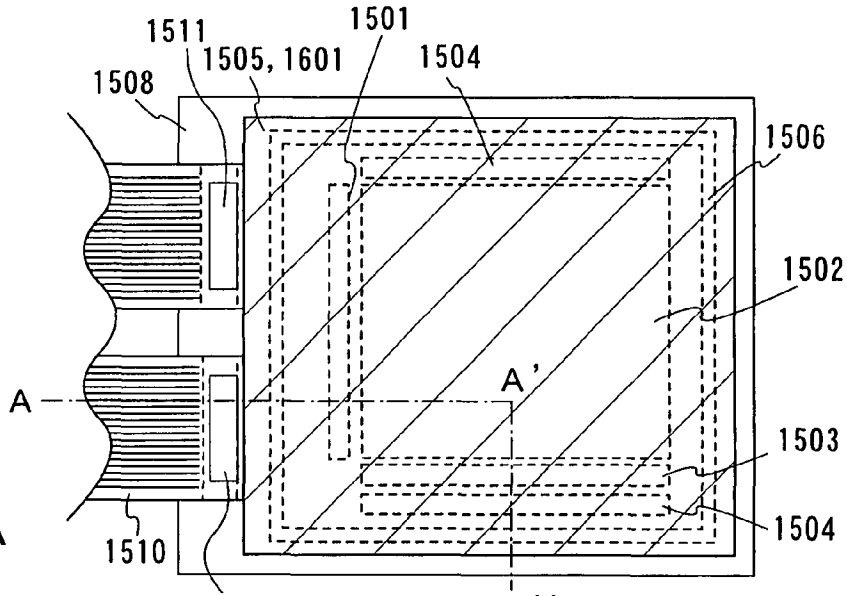
FIGS. 16A and 16B are diagrams showing panel configurations of an active matrix display device of the invention.
Figure 16B:
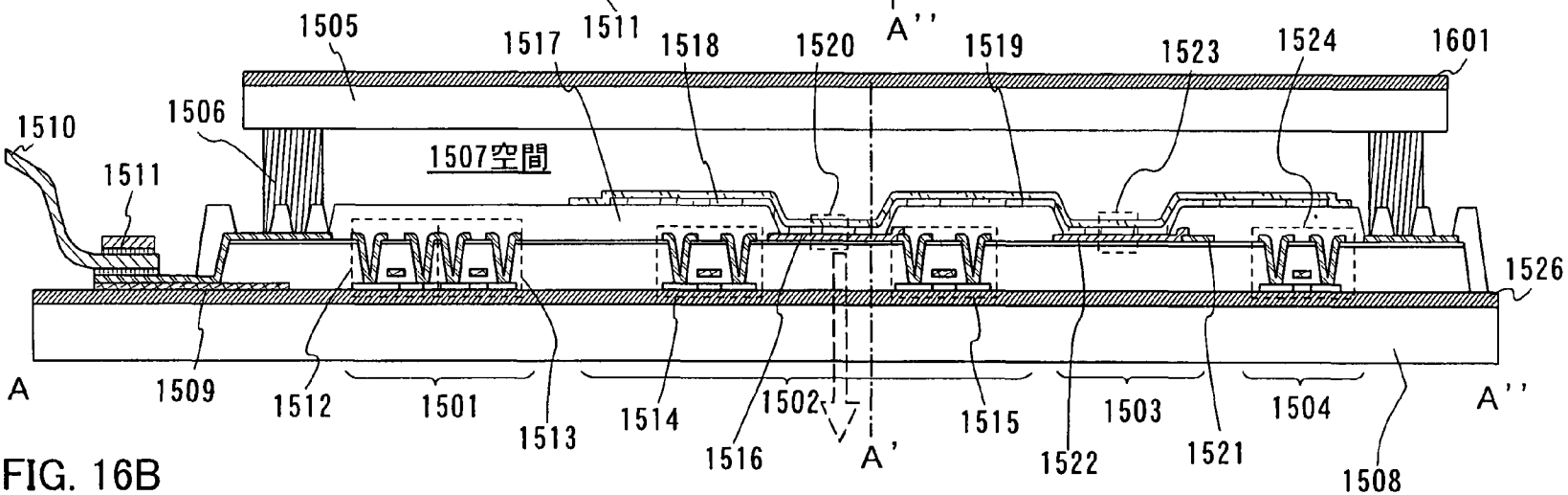

In the configuration of the panel shown in FIGS. 16A and 16B, it is preferable to employ a material having a high work function for a material of the first electrode 1516 which functions as an anode. For example, a light transmissive film such as an ITO (indium tin oxide) film and an indium zinc oxide (IZO) film can be used. By using a light transmissive film having a light transmissivity, an anode which can transmit light can be formed.

Further, for a material used for the second electrode 1519 which functions as a cathode, a metal film formed of a material having a low work function (Al, Ag, Li, Ca, or an alloy of these such as MgAg, MgIn, AlLi, $CaF_2$, or CaN) can be used. In this manner, by using a metal film which reflects light, a cathode which does not transmit light can be formed.

In this manner, light emitted from the light emitting element can be obtained downwards as shown by an arrow in FIG. 16B.

It is to be noted that a substrate having a light transmissivity is used for the substrate 1508 in the case of using a light emitting element with a bottom emission structure to a display device.

In the case of providing an optical film, it may be provided over the substrate 1508.

It is to be noted that a panel of a display device with a top emission structure is shown in FIG. 15 and a bottom emission structure is shown in FIGS. 16A and 16B, however, it is needless to say that a dual emission structure may also be employed.

A light emitting element with a dual emission structure which can be applied to a display device of the invention is described with reference to FIG. 19.

A base film 1905 is formed over a substrate 1900, and then a current controlling TFT 1901 is formed thereover. Over the aforementioned, a first electrode 1902 is formed in contact with a drain electrode of the current controlling TFT 1901, then a layer 1903 containing an organic compound and a second electrode 1904 are formed in this order. It is to be noted that a single layer of a layer having a heat dissipation effect or stacked layers of silicon nitride oxide and silicon oxynitride may be used for the base film 1905. As the film having a heat dissipation effect, aluminum nitride, diamond and the like each having a light transmissivity can be used. It is to be noted that aluminum nitride (AlN) may contain 0.1 to 30 atomic % of oxygen (O). That is, aluminum nitride oxide ($AlN_xO_y$) may be formed as well.

The first electrode 1902 is an anode of the light emitting element while the second electrode 1904 is a cathode thereof. That is, a portion where the layer 1903 containing an organic compound is sandwiched by the first and second electrodes 1902 and 1904 corresponds to a light emitting element.

Here, it is preferable to use a material having a high work function for a material used for the first electrode 1902 which functions as an anode. For example, a light transmissive conductive film such as an ITO (indium tin oxide) film and an indium zinc oxide (IZO) film can be used. By using a light transmissive conductive film having a light transmissivity, an anode which can transmit light can be formed.

As a material used for the second electrode 1904 which functions as a cathode, it is preferable to use stacked layers of a thin metal film formed of a material having a low work function (Al, Ag, Li, Ca, or an alloy of these such as MgAg, MgIn, AlLi, $CaF_2$, or CaN), and a light transmissive conductive film (an ITO (indium tin oxide) film, an indium oxide zinc oxide ($In_2O_3$—ZnO), zinc oxide (ZnO) and the like). In this manner, a cathode which can transmit light can be formed by using a thin metal film and a light transmissive conductive film having a light transmissivity.

Figure 19:
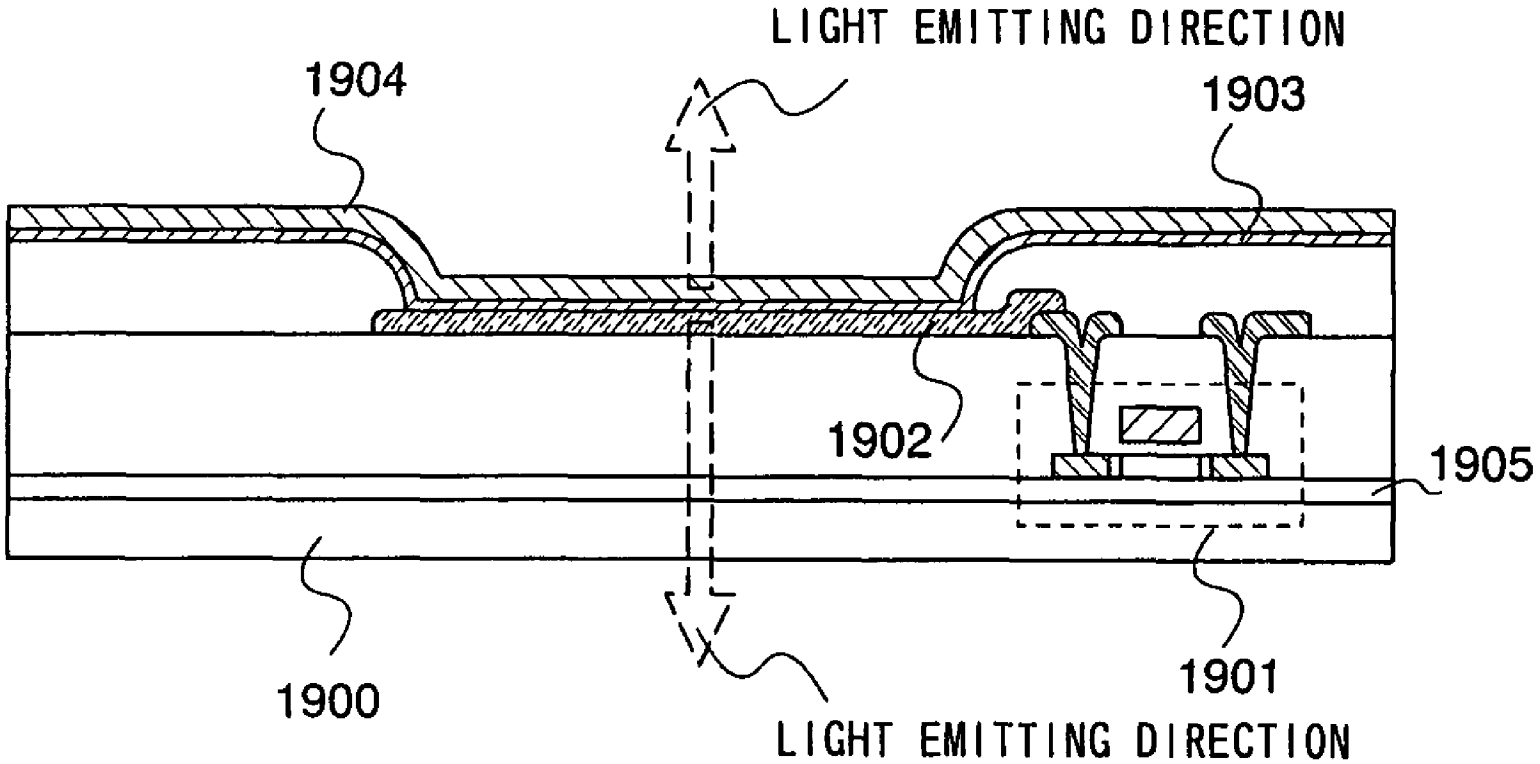
FIG. 19 is a diagram showing a configuration of a light emitting element which can be applied to an active matrix display device of the invention.

In this manner, light from a light emitting element can be extracted from both surfaces as shown by arrows in FIG. 19. That is, in the case of applying the invention to the panel of the display device shown in FIG. 15, light is emitted to the substrate 1508 side and the sealing substrate 1505 side. Therefore, in the case of using a dual emission structure light emitting element to a display device, a substrate having a light transmissivity is used for the substrate 1508 and the sealing substrate 1505. Further, in the case of providing an optical film, the optical film may be provided for both the substrate 1508 and the sealing substrate 1505.

The invention can also be applied to a display device which performs a full color display by using a light emitting element which emits white light and a color filter.

Figure 20:
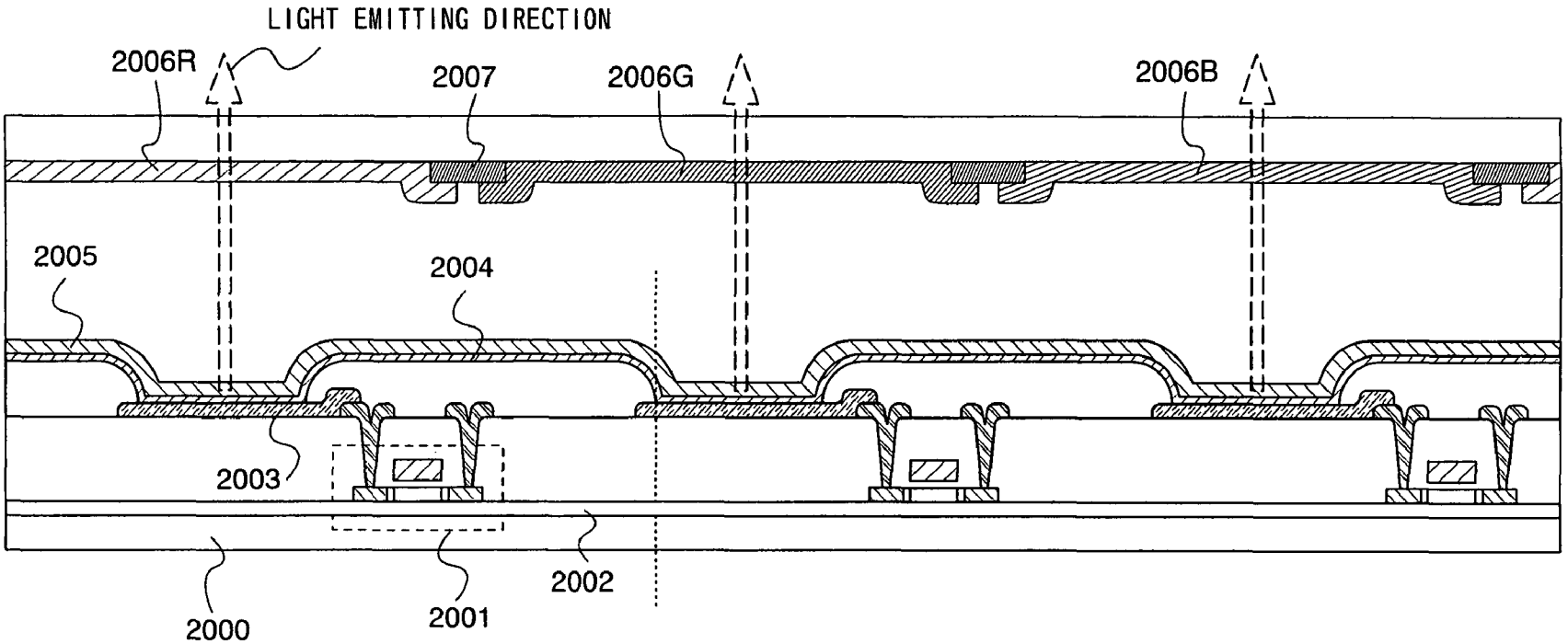
FIG. 20 is a diagram showing a configuration of a light emitting element which can be applied to an active matrix display device of the invention.

As shown in FIG. 20, a base film 2002 is formed over a substrate 2000 and then a current controlling TFT 2001 is formed thereover. Over the aforementioned, a first electrode 2003 is formed in contact with a drain electrode of the current controlling TFT 2001, and a layer 2004 containing an organic compound and a second electrode 2005 are formed in this order. It is to be noted that the base film 2002 may be formed of a material such as alumina ($Al_2O_3$), cubic boron nitride (c-BN), aluminum nitride (AlN), BeO (beryllia), diamond and the like which are high in heat conductivity. A single layer of the aforementioned or stacked layers with a silicon nitride oxide film and a silicon oxynitride film can be used. It is to be noted that aluminum nitride (AlN) may contain 0.1 to 30 atomic % of oxygen (O). That is, aluminum nitride oxide ($AlN_xO_y$) may be formed as well.

The first electrode 2003 is an anode of the light emitting element while the second electrode 2005 is a cathode thereof. That is, a portion where a layer 2004 containing an organic compound is sandwiched by the first and second electrodes 2003 and 2005 corresponds to a light emitting element. In the configuration of FIG. 20, the light emitting element emits white light. A red color filter 2006, a green color filter 2006G, and a blue color filter 2006B are provided over the light emitting element, thereby a full color display can be performed. Further, a black matrix (also referred to as a BM) 2007 is provided for separating the color filters.

As only a light emitting element which emits white light is provided in the pixel portion in the configuration of FIG. 20, a compensation function can be performed more accurately by forming a monitor element using a similar material to that of the light emitting element to obtain similar element characteristics.

Figure 17A:
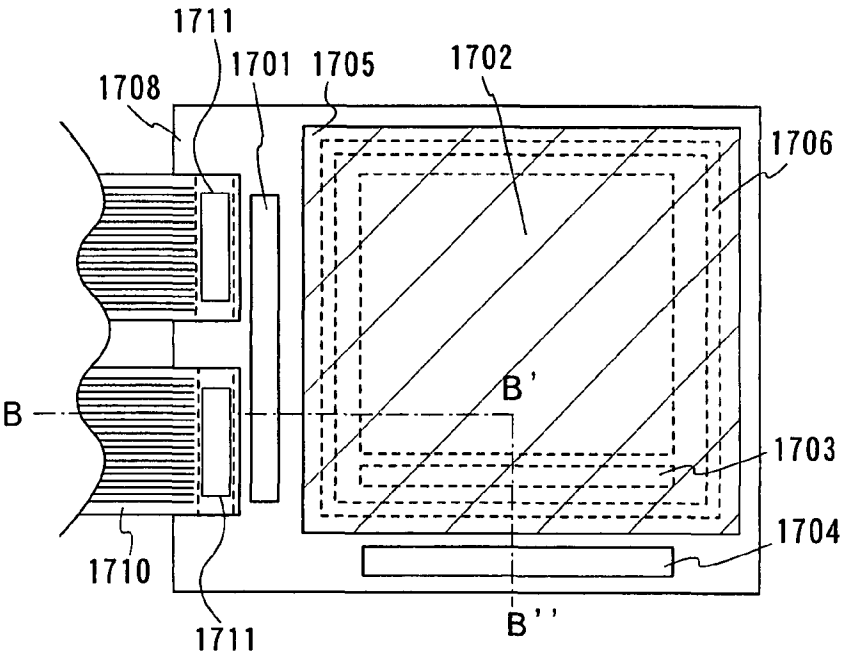
FIGS. 17A and 17B are diagrams showing panel configurations of a passive matrix display device of the invention.
Figure 17B:
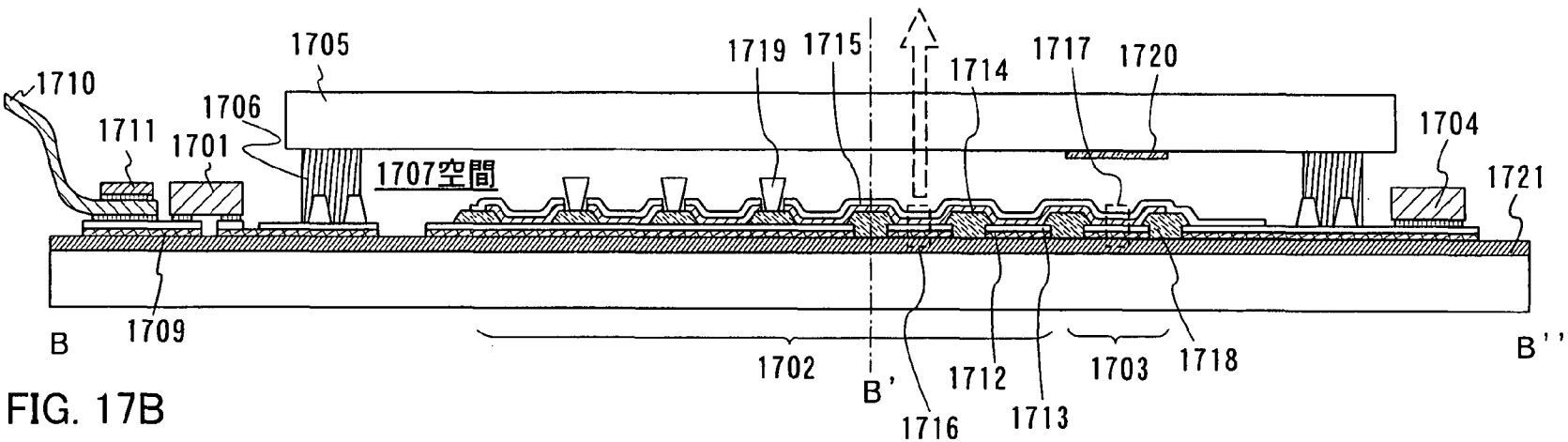

Next, an example of a panel configuration of a passive display device is described with reference to FIGS. 17A and 17B. FIG. 17A shows a top plan view of a display device while FIG. 17B shows a cross-sectional view taken along B-B'-B" in FIG. 17A. As shown by dotted lines, the display device includes a driver circuit portion (source signal line driver circuit) 1701, a pixel portion 1702, a monitor element portion 1703, and a driver circuit portion (row signal line driver circuit) 1704. Further, there is a space 1707 surrounded by a sealing substrate 1705 and a sealing material 1706.

It is to be noted that a wiring 1709 is a wiring for transferring a signal inputted to the column signal line driver circuit 1701 and the row signal line driver circuit 1704 and receives a video signal, a clock signal, a start signal and the like from an FPC (Flexible Printed Circuit) 1710 to be an external input terminal. Further, an IC chip (semiconductor integrated circuit) 1711 is connected by COG (Chip On Glass) on the FPC. It is to be noted that the IC chip may be connected by TAB (Tape Auto Bonding) and by using a printed substrate.

The cross-sectional structure is described with reference to FIG. 17B. A base film 1721 having a heat dissipation effect is formed. The base film can be formed of, for example, a single layer of AlN (aluminum nitride), or stacked layers of AlN, SiNO (silicon nitride oxide), SiON (silicon oxynitride) and the like are preferably used. AlN has a high heat conductivity, superior soaking characteristics of a temperature of the display and heat dissipation characteristics.

The pixel portion 1702 and the monitor element portion 1703 are formed over the base film 1721. Then, the column signal line driver circuit portion 1701 and the row signal line driver circuit portion 1704 are formed in an IC chip which is connected to the substrate 1708 by COG (Chip On Glass).

The base film 1721 is formed over the substrate 1708 and then a column signal line formed of stacked layers is formed thereover. A bottom layer 1712 is a metal film having a reflecting property while a top layer 1713 is a light transmissive conductive oxide film. The top layer 1713 is preferably formed by using a conductive film having a high work function, such as a film formed of a light transmissive conductive material such as indium tin oxide (ITO), IZO (indium zinc oxide) obtained by mixing indium tin oxide containing a Si element (ITSO) and indium oxide with 2 to 20% of zinc oxide (ZnO), or a film containing a compound including these materials in combination. Among the aforementioned, ITSO remains in an amorphous state without being crystallized even when baked while ITO does not. Therefore, ITSO is suitable for being used as an anode of a light emitting element for it has a higher planarity than ITO and does not have a short-circuit with a cathode even when the layer containing an organic compound is thin.

For the bottom layer 1712, Ag, Al, or an Al (C+Ni) alloy film is used. In particular, an Al (C+Ni) film (an aluminum alloy film containing carbon and nickel (1 to 20 wt %)) is a preferable material as contact resistance with ITO and ITSO does not vary much even after current application or heat treatment.

A partition 1718 for insulating adjacent column signal lines is formed of a black resin, which functions as a black matrix (BM) which overlaps a boundary or a gap between different colored layers (provided on a sealing substrate side). A region surrounded by a black partition has the same area as a light emitting region.

The layer 1714 containing an organic compound has an HIL (hole injecting layer), an HTL (hole transporting layer), an EML (light emitting layer), an ETL (electron transporting layer), and an EIL (electron injecting layer) stacked in this order from the column signal line (anode) side. It is to be noted that a single layer structure or a mixed-layer structure can be employed as well as a stacked-layer structure for the layer containing an organic compound.

The row signal line (cathode) 1715 is formed so as to cross the column signal line (anode). In this manner, a light emitting element 1716 and a monitor element 1717 are formed in a region where the layer 1715 containing an organic compound is sandwiched by the column signal line and the row signal line. The row signal line (cathode) 1715 is formed of a light transmissive conductive film such as ITO, indium tin oxide containing a Si element (ITSO), and IZO obtained by mixing zinc oxide (ZnO) into indium oxide by 2 to 20%. In the configuration of this embodiment mode employing a top emission type display device in which light emission passes through the sealing substrate 1705 as shown by an arrow, it is important that the row signal line 1715 transmits light. It is to be noted that a partition 1719 for insulating adjacent row signal lines is formed by controlling the level of exposure and development time according to a photolithography method using a positive photosensitive resin with an unexposed portion as a pattern, so that a portion under the pattern is more etched.

Further, in order to protect a light emitting element from a damage from moisture and degasification, a light transmissive protect film covering the row signal line 1715 may be provided. As the light transmissive protect film, a dense inorganic insulating film (SiN, SiNO film and the like) formed by a PCVD method, a dense inorganic insulating film (SiN, SiNO film and the like) formed by a sputtering method, a thin film containing carbon as a main component (a DLC film, a CN film, and an amorphous carbon film), a metal oxide film ($WO_2$, $CaF_2$, $Al_2O_3$, and the like) and the like are preferably used. To be light transmissive means to have 80 to 100% of transmissivity of visible light.

A light shielding film 1720 is provided over the monitor element portion 1703 so that light emitted from the monitor element portion 1703 does not leak outside.

The pixel portion 1702 including a light emitting element is sealed by a sealing material 1706 and a sealing substrate 1705, thereby a space 1707 which is surrounded is sealed and closed.

As the sealing material 1706, an ultraviolet curable resin, a thermal curable resin, a silicone resin, an epoxy resin, an acrylic resin, a polyimide resin, a phenol resin, a PVC (polyvinyl chloride), PVB (polyvinyl butyral) or EVA (ethylene vinyl acetate) can be used. The sealing material may be added a filler (a stick shape or fiber type spacer) or a spherical spacer.

Further, a glass substrate or a plastic substrate is used for the sealing substrate 1705. As the plastic substrate, polyimide, polyamide, an acrylic resin, an epoxy resin, PES (Polyether Sulfone), PC (polycarbonate), PET (polyethylene terephthalate), or PEN (polyethylene naphthalate) can be used in a board or a film.

On the other hand, a terminal electrode is formed at an edge portion of the substrate 1708, to which the FPC (Flexible Printed Circuit) 1710 connected to an external circuit is attached. The terminal electrode is formed of stacked layers of the metal film 1713 having reflecting property and the light transmissive conductive oxide film 1714, however, the invention is not limited to this.

In the periphery of the pixel portion, IC chips 1701, 1704, and 1711 in which a driver circuit which transfers each signal to the pixel portion or the like is formed are electrically connected by an anisotropic conductive material 1721. Further, in order to form the pixel portion corresponding to a color display, 3072 column signal lines and 768 row signal line are required in an XGA display. The column signal lines and row signal lines formed in these numbers are divided at an edge portion of the pixel portion and provided with leading out wirings, thereby the leading out wirings are gathered according to a pitch of output terminals of the IC chips.

The display device described above is a top emission type display device of which black partitions 1718 and 1719 contribute to improve the contrast.

Figure 18A:
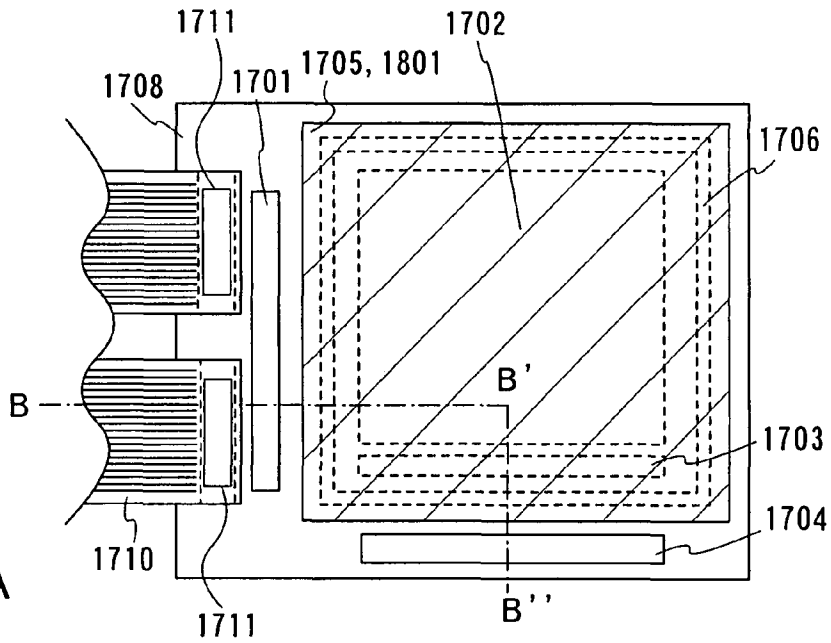
FIGS. 18A and 18B are diagrams showing panel configurations of a passive matrix display device of the invention.

A configuration of a panel in the case of providing a layer having a heat dissipation effect for a counter substrate is described with reference to FIGS. 18A and 18B. It is to be noted that common portions between FIGS. 17 and 18 are denoted by common reference numerals and a description thereon is omitted here.

In this configuration, a film 1801 having a heat dissipation effect is provided over the sealing substrate 1705 as a counter substrate. For example, a metal film superior in heat conductivity is preferably used. As the metal film, for example, a copper film formed by spin coating can be used. It is to be noted that a single layer of a layer having a heat dissipation effect or stacked layers of this film, silicon nitride oxide and silicon oxynitride may be used. As the layer having a heat dissipation effect here, aluminum nitride, diamond and the like having a light transmissivity can be used. It is to be noted that aluminum nitride (AlN) may contain 0.1 to 30 atomic % of oxygen (O). That is, aluminum nitride oxide ($AlN_xO_y$) may be formed as well.

The light emitting element with a bottom emission structure is formed of the column signal line (anode) 1713 formed of a light transmissive conductive oxide film, the layer 1714 containing an organic compound, and the row signal line 1715 formed of a conductive film having a reflecting property. Further, the partition 1718 is formed of a material having a light transmissivity.

Figure 18B:
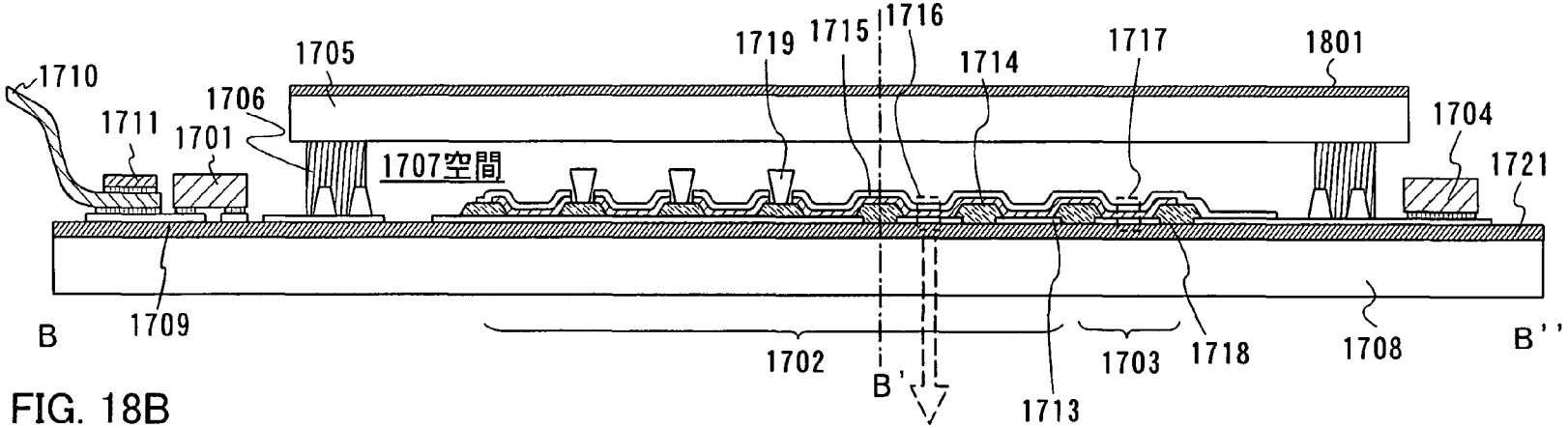

The light emitted from the light emitting element is extracted in a direction shown by an arrow in FIG. 18B, that is a direction to pass through the substrate 1708. Therefore, the sealing substrate 1705 is not particularly required to have a light transmissivity, but a metal board may be used as well. This structure is preferable because the efficiency of light extraction is not decreased even when a thick protective film is formed for improving reliability of the light emitting element.

In the case of providing an optical film, it may be provided on the first substrate 1708 side.

It is to be noted that a panel of a display device with a top emission structure is shown in FIG. 17 and a bottom emission structure is shown in FIG. 18, however, a dual emission structure may also be employed, needless to say.

A light emitting element with a dual emission structure is described with reference to FIG. 21.

The light emitting element with a dual emission structure is formed of a column signal line (anode) 2102 formed of a light transmissive conductive oxide film, a layer 2104 containing an organic compound, and a row signal line 2105 formed of a light transmissive conductive oxide film. A partition 2103 is formed of a material which shields light. The light emitting element is formed over a first substrate 2101 with a base film 2107 interposed therebetween. It is to be noted that the base film 2107 may be formed of a single layer of a layer having a heat dissipation effect or stacked layers of this film and silicon nitride oxide and silicon oxynitride, as described in the panel configuration of FIG. 17. The layer having a heat dissipation effect may be formed of aluminum nitride (AlN) having a light transmissivity and diamond. It is to be noted that aluminum nitride (AlN) may contain 0.1 to 30 atomic % of oxygen (O). That is, aluminum nitride oxide ($AlN_xO_y$) may be formed as well.

Figure 21:
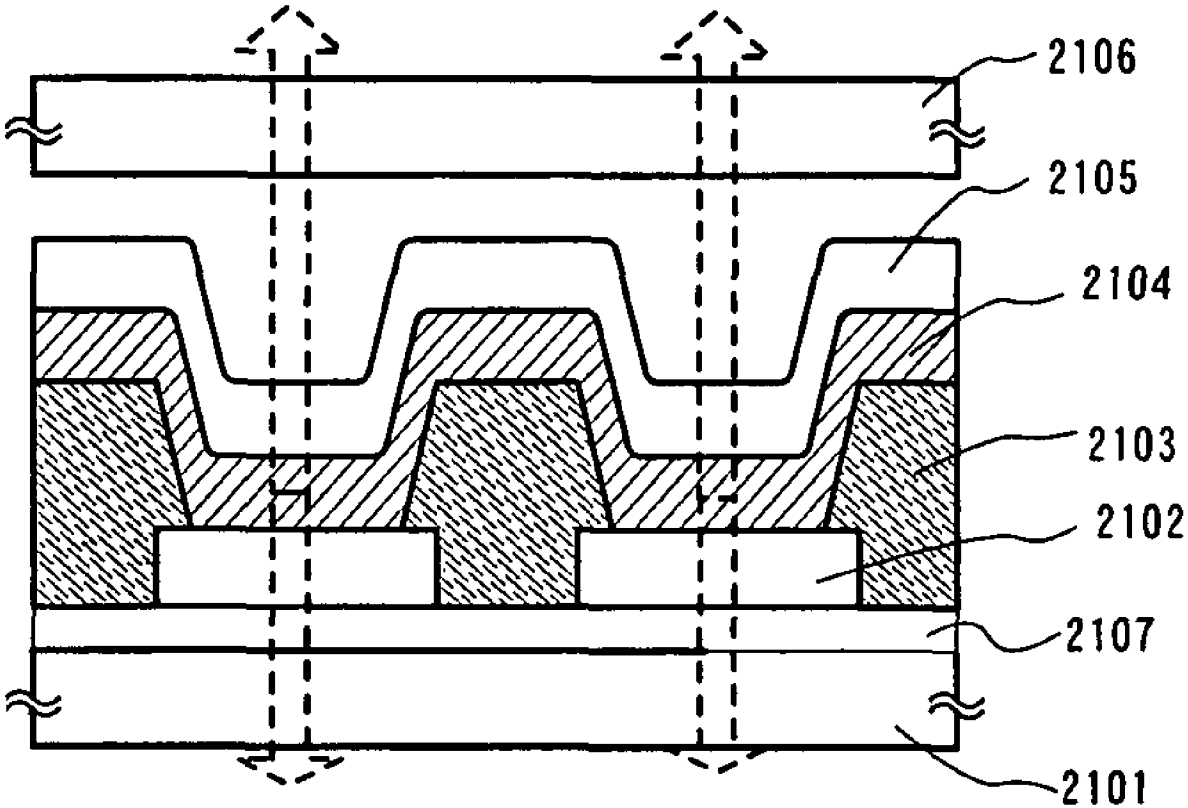
FIG. 21 is a diagram showing a configuration of a light emitting element which can be applied to a passive matrix display device of the invention.

The light emitted from the light emitting element is extracted in a direction shown by arrows in FIG. 21, that is a direction to pass through the first substrate 2101 and a direction to pass through a second substrate 2106. Therefore, the first substrate 2101 and the second substrate 2106 are both formed of a substrate having a light transmissivity.

In the case of providing an optical film, the optical film may be provided for both the first substrate 2101 and the second substrate 2106.

An example where the partition is not in a reverse tapered shape, but in a forward tapered shape is described with reference to FIG. 22. It is to be noted that a light emitting element which emits white light and a color filter are used for performing a full color display.

A base film 2210 is formed over a first substrate 2201, over which a first electrode 2202 in a stripe shape is formed. In this configuration, a partition 2203 having an aperture is provided on the first electrode 2202, over which a partition is formed of a spacer 2206 and an overhang portion 2207 of which width is wide on the spacer 2206. It is to be noted that the base film 2210 can be formed of alumina ($Al_2O_3$), cubic boron nitride (c-BN), aluminum nitride (AlN), BeO (beryllia), diamond and the like which are high in heat conductivity. The base film 2210 can be formed of a single layer of the aforementioned substance or stacked layers of the aforementioned substance and a silicon nitride oxide film and a silicon oxynitride film. It is to be noted that aluminum nitride (AlN) may contain 0.1 to 30 atomic % of oxygen (O). That is, aluminum nitride oxide ($AlN_xO_y$) may be formed as well.

The spacer 2206 is formed of an organic resin film such as polyimide while the overhang portion 2207 is formed of a photosensitive resin film such as a resist. An organic resin film such as polyimide is formed and then a pattern of a photosensitive resin film such as a resist is left between electrodes to be separated. Then, an exposed organic resin film is etched. At this time, an etching condition is controlled so as to form an undercut beneath the pattern of the photosensitive resin. Through these steps, an element separation structure including an overhang structure, that is a partition can be formed.

Figure 22:
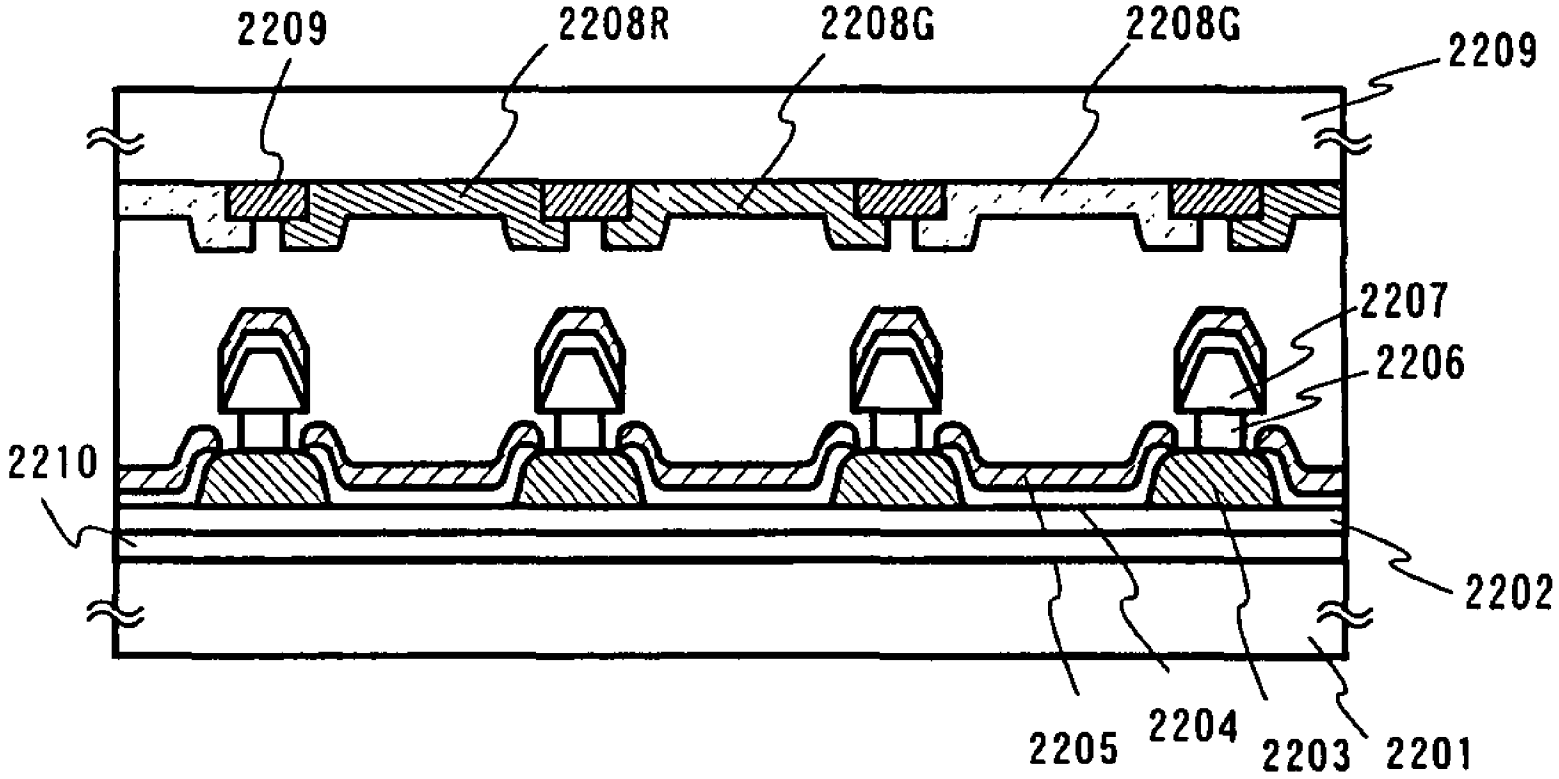
FIG. 22 is a diagram showing a configuration of a light emitting element which can be applied to a passive matrix display device of the invention.

In FIG. 22, the partition 2203 having an aperture, the spacer 2206, or the overhang portion 2207 is formed of a material which shields light so as to improve the contrast.

By forming a layer containing an organic compound and a light transmissive conductive film after forming the partition, a layer 2204 containing an organic compound and a second electrode 2205 can be formed.

In FIG. 22, the layer 2204 containing an organic compound is formed of stacked layers of a green light emission layer in which coumarin 6 is doped to $Alq_3$ and a yellow light emission layer in which rubrene is doped to TPD, which forms a white light emitting element utilizing the light emission of two layers. In this configuration, a step of depositing materials for each light emission color can be omitted, therefore, the time required for manufacturing a passive matrix light emitting device can be reduced.

A color filter formed only of colored layers 2208R, 2208G, and 2208B is provided over a second substrate 2209 at a counter position of a pixel of the white light emitting element. Moreover, a black matrix (also referred to as a BM) which separates these color filters is provided.

As only a light emitting element which emits white light is provided in the pixel portion in the configuration of FIG. 22, a compensation function can be performed more accurately by forming a monitor element using a similar material to that of the light emitting element to obtain similar element characteristics.

Embodiment Mode 8

In this embodiment mode, a pixel configuration which can be applied to a pixel configuration of the active type display device of the invention is described.

The pixel configuration is not limited to those described in FIGS. 2, 3, 5, and 8, but another pixel configuration employing a voltage drive type pixel transistor can be used as well. That is, the invention can be applied to a display device having a pixel configuration employing a transistor which operates in a linear region as a driving transistor of a light emitting element.

First, an operation of a pixel configuration of the display device shown in FIGS. 2, 3, 5, or 8 is described with reference to FIG. 25A. The pixel configuration includes a switching transistor 2501, a capacitor 2502, a driving transistor 2503, a light emitting element 2504, a gate signal line 2505, a source signal line 2506, and a power source line 2507. A gate terminal of the switching transistor 2501 is connected to the gate signal line 2505. A source terminal of the switching transistor 2501 is connected to the source signal line 2506, a drain terminal thereof is connected to a gate terminal of the driving transistor 2503. One terminal of the capacitor 2502 is connected to the gate terminal of the driving transistor 2503 while the other terminal thereof is connected to the power source line 2507. A source terminal of the driving transistor 2503 is connected to the power source line 2507 and a drain terminal thereof is connected to an anode of the light emitting element 2504. When the switching transistor 2501 is turned on by a signal inputted from the gate signal line 2505, a digital video signal is inputted from the source signal line 2505 to the gate terminal of the driving transistor 2503. A voltage of the inputted digital video signal is held in the capacitor 2502. By the inputted digital video signal, the driving transistor 2503 is turned on/off, which controls to set a potential by the power source line 2507 at an anode of the light emitting element 2504. By setting a potential of the power source line 2507 according to the invention, a current value supplied to the light emitting element 2504, which varies due to a temperature change and a change with time can be corrected. Further, a steady voltage supply can be provided.

Figure 25B:
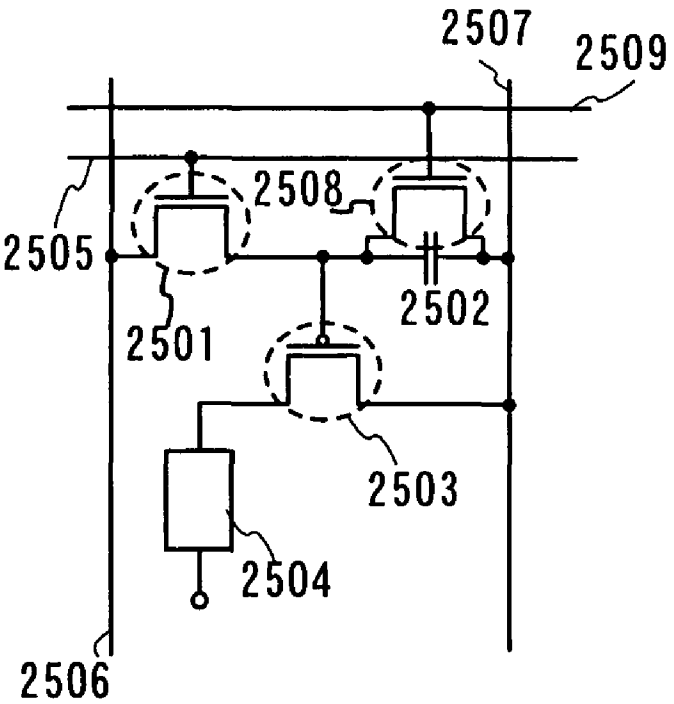
FIGS. 25A and 25B are examples of a pixel configuration which can be applied to an active matrix display device of the invention.
Figure 25A:
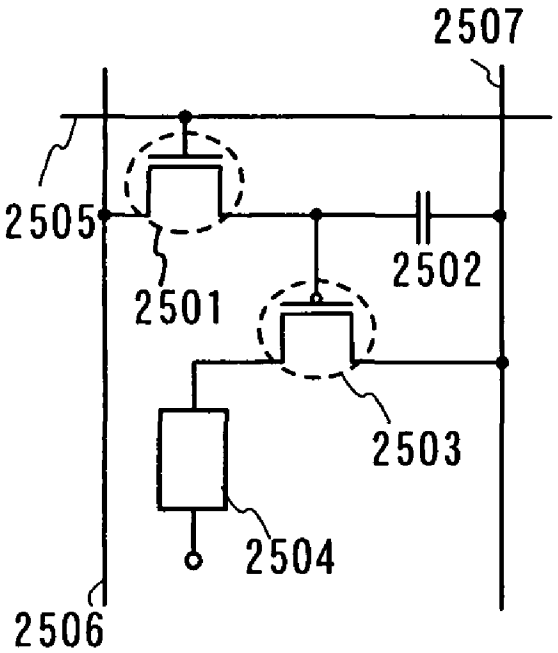

Further, the invention can be applied to a display device having a pixel configuration as shown in FIG. 25B. The configuration shown in FIG. 25B corresponds to the configuration of FIG. 25A in which an erasing transistor 2508 and an erasing signal line 2509 are additionally provided. Accordingly, common reference numerals are used for the common portions. In this configuration, when an erasing signal is inputted to the erasing signal line 2509 and the erasing transistor 2508 is turned on, a charge held in the capacitor 2502 is discharged and the driving transistor 2503 is turned off, which makes the light emitting element 2504 emit no light. In this configuration also, according to the invention, a current value supplied to the light emitting element 2504, which varies due to a temperature change and a change with time can be corrected by setting a potential of the power source line 2507. Further, a steady voltage supply can be provided.

The invention can be applied to a pixel configuration in which polarity of a transistor in the pixel is appropriately changed, a connection is changed, or a transistor is additionally provided, as well as to the aforementioned configuration.

Embodiment Mode 9

The invention can be applied to various electronic devices. In specific, the invention can be applied to a display portion of an electronic device. Such electronic devices include a video camera, a digital camera, a goggle type display (head mounted display), a navigation system, an audio reproducing device (car audio, audio component set and the like), a computer, a game machine, a portable information terminal (mobile computer, portable phone, portable game machine, electronic book, or the like), an image reproducing device provided with a recording medium (specifically, a device which reproduces a recording medium such as a DVD (Digital Versatile Disc) and has a display which can display the reproduced image), and the like.

Figure 26A:
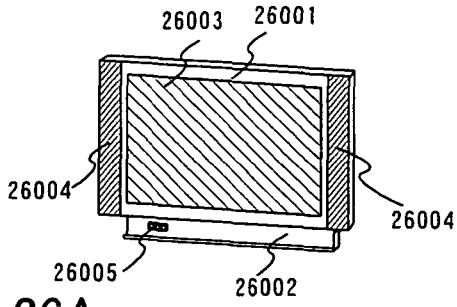
FIGS. 26A to 26H are views of electronic devices having display portions to which a display device of the invention can be applied.

FIG. 26A illustrates a display including a housing 26001, a support base 26002, a display portion 26003, speaker portions 26004, a video input terminal 26005 and the like. The display having the display portion 26003 to which the invention is applied can suppress luminance variations caused by a temperature change and reduce the apparent luminance deterioration. It is to be noted that a display includes all display devices for displaying information, such as ones for a personal computer, TV broadcast reception, and advertisement.

Figure 26B:
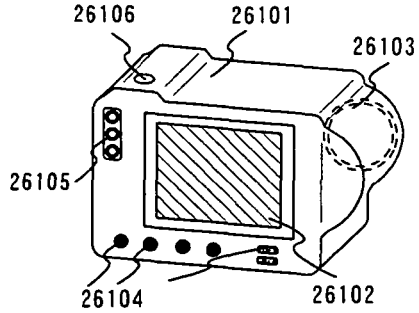
Figure 26C:
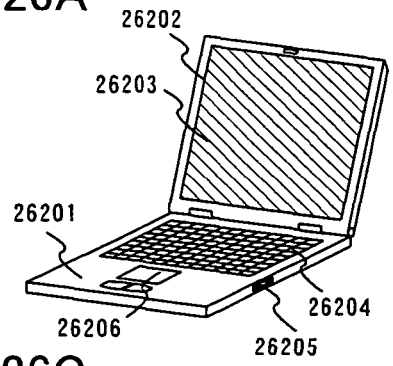

FIG. 26B illustrates a camera including a main body 26101, a display portion 26102, an image receiving portion 26103, operating keys 26104, an external connecting port 26105, a shutter 26106 and the like. The camera having the display portion 26102 to which the invention is applied can suppress luminance variations caused by a temperature change and reduce the apparent luminance deterioration.

FIG. 21C illustrates a computer including a main body 26201, a housing 26202, a display portion 26203, a keyboard 26204, an external connecting port 26205, a pointing mouse 26206 and the like. The computer having the display portion 26203 to which the invention is applied can suppress luminance variations caused by a temperature change and reduce the apparent luminance deterioration.

Figure 26D:
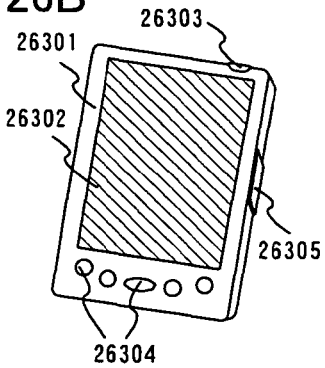

FIG. 26D illustrates a mobile computer including a main body 26301, a display portion 26302, a switch 26303, operating keys 26304, an infrared port 26305 and the like. The mobile computer having the display portion 26302 to which the invention is applied can suppress luminance variations caused by a temperature change and reduce the apparent luminance deterioration.

Figure 26E:
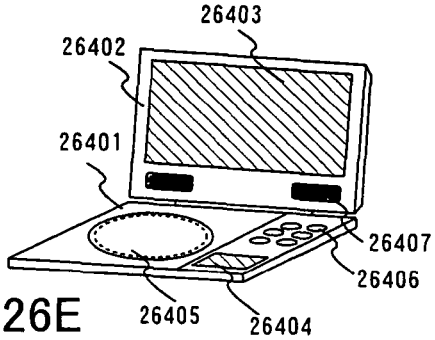

FIG. 26E illustrates a portable image reproducing device provided with a recording medium (specifically a DVD reproducing device), including a main body 26401, a housing 26402, a display portion A 26403, a display portion B 26404, a recording medium (such as a DVD) reading portion 26405, an operating key 26406, a speaker portion 26407, and the like. The display portion A 26403 mainly displays image data while the display portion B 26404 mainly displays text data. The image reproducing device having the display portion A 26403 and the display portion B 26404 to which the invention is applied can suppress luminance variations caused by a temperature change and reduce the apparent luminance deterioration.

Figure 26F:
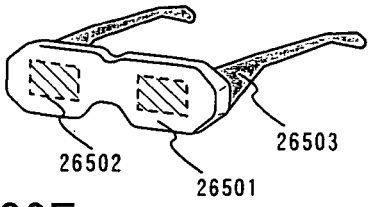

FIG. 26F illustrates a goggle type display including a main body 26501, a display portion 26502, and an arm portion 26503. The goggle type display having the display portion 26502 to which the invention is applied can suppress luminance variations caused by a temperature change and reduce the apparent luminance deterioration.

Figure 26G:
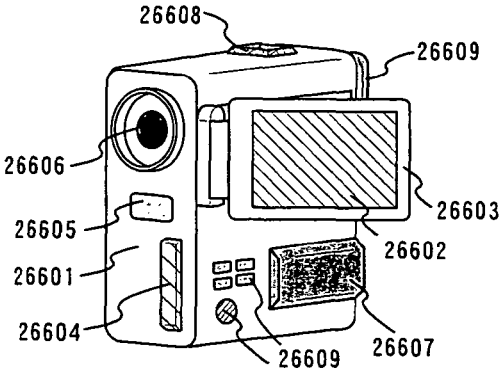

FIG. 26G illustrates a video camera including a main body 26601, a display portion 26602, a housing 26603, an external connecting port 26604, a remote control receiving portion 26605, an image receiving portion 26606, a battery 26607, an audio input portion 26608, operating keys 26609 and the like. The video camera having the display portion 26602 to which the invention is applied can suppress luminance variations caused by a temperature change and reduce the apparent luminance deterioration.

Figure 26H:
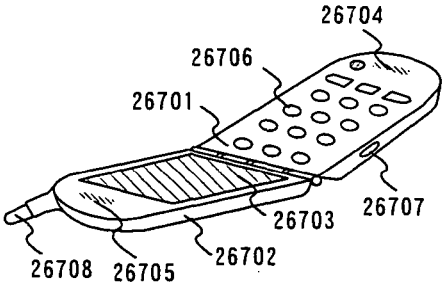

FIG. 26H illustrates a portable phone including a main body 26701, a housing 26702, a display portion 26703, an audio input portion 26704, an audio output portion 26705, an operating key 26706, an external connecting port 26707, an antenna 26708 and the like. The portable phone having the display portion 26703 to which the invention is applied can suppress luminance variations caused by a temperature change and reduce the apparent luminance deterioration.

In this manner, the invention can be applied to various electronic devices.

This application is based on Japanese Patent Application serial no. 2004-242820 filed in Japan Patent Office on 23rd, Aug. 2004, the entire contents of which are hereby incorporated by reference.

What is claimed is:

1. A display device comprising:

a first signal line driver circuit electrically connected to n first signal lines;

a second signal line driver circuit electrically connected to m second signal lines;

a pixel portion comprising (n×m) pixels arranged in matrix corresponding to the n first signal lines and the m second signal lines, wherein each of the (n×m) pixels includes a light emitting element; and a voltage source circuit comprising:

m monitor elements arranged between the second signal line driver circuit and the pixel portion along the second signal line driver circuit so that each of the m monitor elements corresponds to each of m rows of (n×m) pixels;

i current sources each of which supplies a current to corresponding j monitor elements of the m monitor elements;

m first switches, each of which controls supplying a current from a corresponding current source of the i current sources to a corresponding monitor element of the m monitor elements;

k amplifiers;

k capacitor elements, each of which is electrically connected to an input terminal of a corresponding amplifier of the k amplifiers; and k second switches, each of which controls an electrical connection between an input terminal of a corresponding amplifier of the k amplifiers and a corresponding current source of the i current sources, wherein each of the k amplifiers generates a first voltage according to a second voltage generated at each of corresponding (m/k) monitor elements, wherein each of the k amplifiers applies the first voltage to each of (n×m/k) light emitting elements included in corresponding (m/k) rows of the (n×m) pixels, wherein each of n and m is a natural number, and wherein each of i, j and k is a natural number less than or equal to m.

2. The display device according to claim 1, wherein the first signal line driver circuit is a source signal line driver circuit, and wherein the second signal line driver circuit is a gate signal line driver circuit.

3. The display device according to claim 1, wherein each of the (n×m) pixels further includes a thin film transistor.

4. The display device according to claim 1, wherein the light emitting element has a layer containing an organic compound sandwiched by a first electrode formed of a part of corresponding one of the n first signal lines and a second electrode formed of a part of corresponding one of the m second signal lines.

5. The display device according to claim 1, wherein each of the k amplifiers is a voltage follower circuit.

6. The display device according to claim 1, wherein the pixel portion is formed of pixels with a plurality of color components; and wherein the m monitor elements and the k amplifiers are provided for each of the plurality of color components.

7. The display device according to claim 1, wherein the m monitor element and the (n×m) light emitting elements are EL elements.

8. An electronic device having the display device according to claim 1 in a display portion.

9. A display device comprising:

a first signal line driver circuit electrically connected to n first signal lines;

a second signal line driver circuit electrically connected to m second signal lines;

a pixel portion comprising (n×m) pixels arranged in matrix corresponding to the n first signal lines and the m second signal lines, wherein each of the (n×m) pixels includes a light emitting element; and a voltage source circuit comprising:

m monitor elements arranged between the second signal line driver circuit and the pixel portion along the second signal line driver circuit so that each of the m monitor elements corresponds to each of m rows of (n×m) pixels;

i current sources each of which supplies a current to corresponding j monitor elements of the m monitor elements;

m first switches, each of which controls supplying a current from a corresponding current source of the i current sources to a corresponding monitor element of the m monitor elements;

k amplifiers;

k capacitor elements, each of which is electrically connected to an input terminal of a corresponding amplifier of the k amplifiers; and k second switches, each of which controls an electrical connection between an input terminal of a corresponding amplifier of the k amplifiers and a corresponding current source of the i current sources, wherein each of the k amplifiers generates a first potential according to a second potential generated at each of anodes of corresponding (m/k) monitor elements, wherein each of the k amplifiers applies the first potential to each of anodes of (n×m/k) light emitting elements included in corresponding (m/k) rows of the (n×m) pixels, wherein each of n and m is a natural number, and wherein each of i, j and k is a natural number less than or equal to m.

10. The display device according to claim 9, wherein the first signal line driver circuit is a source signal line driver circuit, and wherein the second signal line driver circuit is a gate signal line driver circuit.

11. The display device according to claim 9, wherein each of the (n×m) pixels further includes a thin film transistor.

12. The display device according to claim 9, wherein the light emitting element has a layer containing an organic compound sandwiched by a first electrode formed of a part of corresponding one of the n first signal lines and a second electrode formed of a part of corresponding one of the m second signal lines.

13. The display device according to claim 9, wherein each of the k amplifiers is a voltage follower circuit.

14. The display device according to claim 9, wherein the pixel portion is formed of pixels with a plurality of color components; and wherein the m monitor elements and the k amplifiers are provided for each of the plurality of color components.

15. The display device according to claim 9, wherein the m monitor element and the (n×m) light emitting elements are EL elements.

16. An electronic device having the display device according to claim 9 in a display portion.

17. A display device comprising:

a first signal line driver circuit electrically connected to n first signal lines;

a second signal line driver circuit electrically connected to m second signal lines;

a pixel portion comprising (n×m) pixels arranged in matrix corresponding to the n first signal lines and the m second signal lines, wherein each of the (n×m) pixels includes a light emitting element; and a voltage source circuit comprising:

m monitor elements arranged between the second signal line driver circuit and the pixel portion along the second signal line driver circuit so that each of the m monitor elements corresponds to each of m rows of (n×m) pixels;

i current sources each of which supplies a current to corresponding j monitor elements of the m monitor elements;

m first switches, each of which controls supplying a current from a corresponding current source of the i current sources to a corresponding monitor element of the m monitor elements;

k amplifiers;

k capacitor elements, each of which is electrically connected to an input terminal of a corresponding amplifier of the k amplifiers; and k second switches, each of which controls an electrical connection between an input terminal of a corresponding amplifier of the k amplifiers and a corresponding current source of the i current sources, wherein each of the k amplifiers generates a first potential according to a second potential generated at each of anodes of corresponding (m/k) monitor elements, wherein each of the k amplifiers applies the first potential to each of anodes of (n×m/k) light emitting elements included in corresponding (m/k) rows of the (n×m) pixels, wherein each of the m monitor elements is connected in parallel to each of n light emitting element included in a corresponding row of (n×m) pixels, wherein each of n and m is a natural number, and wherein each of i, j and k is a natural number less than or equal to m.

18. The display device according to claim 17, wherein the first signal line driver circuit is a source signal line driver circuit, and wherein the second signal line driver circuit is a gate signal line driver circuit.

19. The display device according to claim 17, wherein each of the (n×m) pixels further includes a thin film transistor.

20. The display device according to claim 17, wherein the light emitting element has a layer containing an organic compound sandwiched by a first electrode formed of a part of corresponding one of the n first signal lines and a second electrode formed of a part of corresponding one of the m second signal lines.

21. The display device according to claim 17, wherein each of the k amplifiers is a voltage follower circuit.

22. The display device according to claim 17, wherein the pixel portion is formed of pixels with a plurality of color components; and wherein the m monitor elements and the k amplifiers are provided for each of the plurality of color components.

23. The display device according to claim 17, wherein the m monitor element and the (n×m) light emitting elements are EL elements.

24. An electronic device having the display device according to claim 17 in a display portion.

25. A display device comprising:

a first signal line driver circuit electrically connected to n first signal lines;

a second signal line driver circuit electrically connected to m second signal lines;

a pixel portion comprising (n×m) pixels arranged in matrix corresponding to the n first signal lines and the m second signal lines, wherein each of the (n×m) pixels includes a light emitting element; and a voltage source circuit comprising:

m monitor elements arranged between the second signal line driver circuit and the pixel portion along the second signal line driver circuit so that each of the m monitor elements corresponds to each of m rows of (n×m) pixels;

m current sources each of which supplies a current to corresponding one of the m monitor elements;

m first switches, each of which controls supplying a current from a corresponding current source of the m current sources to a corresponding monitor element of the m monitor elements;

m amplifiers;

m capacitor elements, each of which is electrically connected to an input terminal of a corresponding amplifier of the m amplifiers; and m second switches, each of which controls an electrical connection between an input terminal of a corresponding amplifier of the m amplifiers and a corresponding current source of the m current sources, wherein each of the m amplifiers generates a first voltage according to a second voltage generated at corresponding one of the m monitor elements, wherein each of the m amplifiers applies the first voltage to each of n light emitting elements included in a corresponding row of the (n×m) pixels, and wherein each of n and m is a natural number.

26. The display device according to claim 25, wherein the first signal line driver circuit is a source signal line driver circuit, and wherein the second signal line driver circuit is a gate signal line driver circuit.

27. The display device according to claim 25, wherein each of the (n×m) pixels further includes a thin film transistor.

28. The display device according to claim 25, wherein the light emitting element has a layer containing an organic compound sandwiched by a first electrode formed of a part of corresponding one of the n first signal lines and a second electrode formed of a part of corresponding one of the m second signal lines.

29. The display device according to claim 25, wherein each of the m amplifiers is a voltage follower circuit.

30. The display device according to claim 25, wherein the pixel portion is formed of pixels with a plurality of color components; and wherein the m monitor elements and the m amplifiers are provided for each of the plurality of color components.

31. The display device according to claim 25, wherein the m monitor element and the (n×m) light emitting elements are EL elements.

32. An electronic device having the display device according to claim 25 in a display portion.

33. A display device comprising:

a first signal line driver circuit electrically connected to n first signal lines;

a second signal line driver circuit electrically connected to m second signal lines;

a pixel portion comprising (n×m) pixels arranged in matrix corresponding to the n first signal lines and the m second signal lines, wherein each of the (n×m) pixels includes a light emitting element; and a voltage source circuit comprising:

m monitor elements arranged between the second signal line driver circuit and the pixel portion along the second signal line driver circuit so that each of the m monitor elements corresponds to each of m rows of (n×m) pixels;

m current sources each of which supplies a current to corresponding one of the m monitor elements;

m first switches, each of which controls supplying a current from a corresponding current source of the m current sources to a corresponding monitor element of the m monitor elements;

m amplifiers;

m capacitor elements, each of which is electrically connected to an input terminal of a corresponding amplifier of the m amplifiers; and m second switches, each of which controls an electrical connection between an input terminal of a corresponding amplifier of the m amplifiers and a corresponding current source of the m current sources, wherein each of the m amplifiers generates a first potential according to a second potential generated at an anode of corresponding one of the m monitor elements, wherein each of the m amplifiers applies the first potential to each of anodes of n light emitting elements included in a corresponding row of the (n×m) pixels, and wherein each of n and m is a natural number.

34. The display device according to claim 33, wherein the first signal line driver circuit is a source signal line driver circuit, and wherein the second signal line driver circuit is a gate signal line driver circuit.

35. The display device according to claim 33, wherein each of the (n×m) pixels further includes a thin film transistor.

36. The display device according to claim 33, wherein the light emitting element has a layer containing an organic compound sandwiched by a first electrode formed of a part of corresponding one of the n first signal lines and a second electrode formed of a part of corresponding one of the m second signal lines.

37. The display device according to claim 33, wherein each of the m amplifiers is a voltage follower circuit.

38. The display device according to claim 33, wherein the pixel portion is formed of pixels with a plurality of color components; and wherein the m monitor elements and the m amplifiers are provided for each of the plurality of color components.

39. The display device according to claim 33, wherein the m monitor element and the (n×m) light emitting elements are EL elements.

40. An electronic device having the display device according to claim 33 in a display portion.

41. A display device comprising:

a first signal line driver circuit electrically connected to n first signal lines;

a second signal line driver circuit electrically connected to m second signal lines;

a pixel portion comprising (n×m) pixels arranged in matrix corresponding to the n first signal lines and the m second signal lines, wherein each of the (n×m) pixels includes a light emitting element; and a voltage source circuit comprising:

m monitor elements arranged between the second signal line driver circuit and the pixel portion along the second signal line driver circuit so that each of the m monitor elements corresponds to each of m rows of (n×m) pixels;

m current sources each of which supplies a current to corresponding one of the m monitor elements;

m first switches, each of which controls supplying a current from a corresponding current source of the m current sources to a corresponding monitor element of the m monitor elements;

m amplifiers;

m capacitor elements, each of which is electrically connected to an input terminal of a corresponding amplifier of the m amplifiers; and m second switches, each of which controls an electrical connection between an input terminal of a corresponding amplifier of the m amplifiers and a corresponding current source of the m current sources, wherein each of the m amplifiers generates a first potential according to a second potential generated at an anode of corresponding one of the m monitor elements, wherein each of the m amplifiers applies the first potential to each of anodes of n light emitting elements included in a corresponding row of the (n×m) pixels, wherein each of the m monitor elements is connected in parallel to each of n light emitting element included in a corresponding row of (n×m) pixels, and wherein each of n and m is a natural number.

42. The display device according to claim 41, wherein the first signal line driver circuit is a source signal line driver circuit, and wherein the second signal line driver circuit is a gate signal line driver circuit.

43. The display device according to claim 41, wherein each of the (n×m) pixels further includes a thin film transistor.

44. The display device according to claim 41, wherein the light emitting element has a layer containing an organic compound sandwiched by a first electrode formed of a part of corresponding one of the n first signal lines and a second electrode formed of a part of corresponding one of the m second signal lines.

45. The display device according to claim 41, wherein each of the m amplifiers is a voltage follower circuit.

46. The display device according to claim 41, wherein the pixel portion is formed of pixels with a plurality of color components; and wherein the m monitor elements and the m amplifiers are provided for each of the plurality of color components.

47. The display device according to claim 41, wherein the m monitor element and the (n×m) light emitting elements are EL elements.

48. An electronic device having the display device according to claim 41 in a display portion.

* * * * *